US007211293B2

(12) United States Patent
Piana et al.

(10) Patent No.: US 7,211,293 B2
(45) Date of Patent: May 1, 2007

(54) METHODS, SYSTEMS AND COMPOSITIONS FOR FIRE RETARDING SUBSTRATES

(75) Inventors: Andrea Piana, Atlanta, GA (US); James L. Gaston, Spartanburg, SC (US)

(73) Assignees: Gaston International, Inc., Spartanburg, SC (US); Tintoria Piana U.S., Inc., Cartersville, GA (US)

( * ) Notice: Subject to any disclaimer, the term of this patent is extended or adjusted under 35 U.S.C. 154(b) by 8 days.

(21) Appl. No.: 10/723,828

(22) Filed: Nov. 26, 2003

(65) Prior Publication Data

US 2004/0121114 A1 Jun. 24, 2004

Related U.S. Application Data

(60) Provisional application No. 60/430,027, filed on Nov. 29, 2002.

(51) Int. Cl.
*B05D 1/38* (2006.01)

(52) U.S. Cl. ..... 427/240; 427/365; 427/393.3; 427/394; 427/396; 106/15.05; 106/18.11; 106/18.13; 106/18.14; 106/18.15; 106/18.16; 106/18.17; 106/18.18; 106/18.21; 106/18.22; 106/18.23; 106/18.26; 106/18.3; 106/18.31; 106/18.32; 106/18.33; 106/18.34

(58) Field of Classification Search ..... None
See application file for complete search history.

(56) References Cited

U.S. PATENT DOCUMENTS 3,944,688 A * 3/1976 Inman ..... 427/381
4,151,322 A * 4/1979 Rosenthal et al. ..... 442/197
4,194,032 A * 3/1980 Harper et al. ..... 427/341
4,372,002 A * 2/1983 Small ..... 8/156
4,801,405 A * 1/1989 Yamada et al. ..... 252/609
5,156,890 A 10/1992 Rock
5,389,309 A 2/1995 Lopez
5,723,515 A * 3/1998 Gottfried ..... 523/179
5,912,196 A * 6/1999 Radwanski et al. ..... 442/153
6,042,639 A * 3/2000 Valso et al. ..... 427/296

FOREIGN PATENT DOCUMENTS

WO WO-02/06021 A2 1/2002

OTHER PUBLICATIONS

Groves et al, Journal of the Water Pollution Control Federation, pp. 499-517, Mar. 1979.*
International Search Report Dated May 18, 2004, For WO 2004/050980.

* cited by examiner

*Primary Examiner*—Erma Cameron
(74) *Attorney, Agent, or Firm*—Whitham, Curtis, Christofferson & Cook, PC

(57) ABSTRACT

A closed-loop system and process is used for applying fire retardant chemicals to fibers. Fibers are preferably positioned in a vessel such as a dye machine which circulates the fire retardant chemicals. After absorption of the fire retardant composition, non-absorbed fire retardant chemicals are recovered and re-used on subsequent batches of fibers. Recovery can be achieved by directing the non-absorbed fire retardant composition into a second dye machine containing additional fibers, or by extracting the fire retardant composition by centrifugation or other means, or by a combination of the two processes. The process is environmentally friendly, and allows for higher throughput on impregnating fibers with fire retardant chemicals.

19 Claims, 1 Drawing Sheet

METHODS, SYSTEMS AND COMPOSITIONS FOR FIRE RETARDING SUBSTRATES

CROSS REFERENCE TO RELATED PATENT APPLICATIONS

This patent application is a Nonprovisional Patent Application that claims the benefit of, and priority from, prior pending U.S. Provisional Patent Application Ser. No. 60/430,027, filed with the U.S. Patent and Trademark Office on Nov. 29, 2002, and entitled "Flame Resistant Fibrous Materials," which is incorporated by reference in its entirety herein.

TECHNICAL FIELD OF THE INVENTION

The present invention relates to "closed loop" processes, systems and compositions for providing one or more fire retardant properties to, or for enhancing one or more fire retardant properties of, substrates containing at least about 5 weight percent of non-thermoplastic material, such as non-thermoplastic filaments, microfibers, fibers, fibrous compositions, threads, yarns, fabrics, textiles, materials, items of apparel, paper or tissue, or blends or products produced using any of the foregoing materials, and to substrates treated in accordance with the processes, systems or compositions of the invention.

The present invention also relates to methods for reducing or eliminating the burning of, and/or the amount or density of smoke produced by, one or more substrates containing at least about 5 weight percent of non-thermoplastic material when such substrates are exposed to a flame, or to some other combustion process.

BACKGROUND OF THE INVENTION

Fires

Fires are produced as the result of three components: heat, fuel, and oxygen. Heat produces flammable gases as a result of the pyrolysis (thermal degradation) of polymer, resulting in the breakage of covalent bonds and the formation of a range of intermediate products. An adequate ratio between the flammable gases and oxygen results in the ignition of the polymer. The resulting combustion of the polymer leads to a production of heat that is spread out and fed back. This heat feedback sustains the combustion, resulting in flame spread.

Pyrolysis products that are initially produced as a result of a fire generally consist of a complex mixture of combustible and non-combustible gases, liquids (which may subsequently volatilize), solid carbonaceous chars and highly reactive species, such as free radicals (highly energetic hydrogen and/or hydroxy radicals that propagate the overall combustion process).

Fires occur frequently throughout the world, often causing severe injuries or fatalities to human beings and animals. Each year, over three million fires leading to approximately 29,000 injuries and 4,500 deaths are reported in the United States alone.

In October of 2003, the largest wildfire outbreak in California history caused fires to rage completely out of control for about two weeks in locations within California, including Los Angeles, resulting in a two billion dollar disaster that claimed approximately 3,335 homes and 20 lives. Thousands of California residents were forced to evacuate their homes and relocate to shelters.

Real property (houses, commercial buildings, warehouses, barns and similar structures) and personal property (furniture, electronic devices, appliances, clothing, jewelry, pieces of art, livestock, crops and the like) that are damaged or destroyed by fires can be prohibitively expensive to repair or replace. Certain pieces of personal property, such as photographs, videotapes and pieces of jewelry, are often priceless and irreplaceable. The total annual costs resulting from property losses caused by fires in the United States has been estimated to be over one hundred billion dollars. Personal property losses occur primarily in residences, where furniture, wallcoverings and clothing fuel the fire. Large financial losses may also be incurred when commercial structures, such as office buildings and warehouses, burn. Fires can also produce significant financial losses when they occur in airplanes, trains, ships, buses and other motorized vehicles, where passengers and freight are generally confined, and have a limited means for egress.

Fires frequently cause buildings to collapse, thereby exposing occupants to a risk of severe injury or death from collapsed building materials and falling debris. Although both of the 110-story twin towers of the New York World Trade Center had survived powerful hurricane gusts, and one of them had also survived a bomb explosion in 1993 (creating a 22-foot wide, 5-story deep crater at its base), both of the twin towers collapsed after fires occurred in the buildings following the crash of airplanes into their sides on Sep. 11, 2001. Experts subsequently concluded that structural damage to the towers was caused predominantly by fires, and that this damage was apparently severe enough to overburden the lower sections of the buildings, causing them each to collapse. Thousands of people that had been in the twin towers on Sep. 11, 2001 lost their lives, or were severely injured, as a result of smoke inhalation, falling debris, burning or jumping from windows.

Smoke contains toxic gases, such as carbon monoxide. It is widely acknowledged that carbon monoxide, which incapacitates fire victims, is the most frequent cause of death in building-related fires. The remainder of the deaths in these fires are generally caused by burns and falling building structures.

Fires frequently spread rapidly across products that are present in buildings, such as draperies, rugs, carpeting, upholstery, furniture and other window, wall, floor and ceiling coverings, and produce dense, and often deadly, smoke. Growing concern over the problem of reducing the likelihood of substrates, such as foam in furniture and mattresses, from igniting has prompted the United States Consumer Product Safety Commission to draft proposals that would require these articles not to burn when contacted with an open flame.

Methods for enhancing the flame retardance of consumer goods have been developed to provide protection from fires, and to increase the available escape time from fires.

Flame Retardants

In most cases, organic materials that do not have any flame retardant properties decompose to volatile combustible products when they are exposed to heat and, thus, initiate or propagate fires.

Flame retardant agents can be added to products, such as clothing, to inhibit or suppress the combustion process. The principle effects of flame retardant agents are to inhibit the development of a fire, or to inhibit or delay the spread of fire over a burning material. In actual fires, flame retardant agents generally function to reduce: (a) the heat release rate of a material; (b) the rate of combustion, degradation and consumption of a material (fire extinction); and (c) smoke emission, and the evolution of toxic gases. As a result, flame retardant agents can significantly increase the available escape time before flashover or the development of an incapacitating atmosphere occurs and, thereby, reduce the exposure of human beings and animals to toxic gases and burning.

Flame retardants can act chemically (by reactions in either the gas or solid phase) and/or physically (by cooling, by formation of a protective layer or by dilution of a matrix), and at different times during the combustion process, to inhibit, interfere with and/or otherwise suppress one or more of the following stages of the combustion process in a manner that reduces flame spread over a material and/or the overall heat release: (a) heating; (b) decomposition; (c) ignition; (d) flame spread; and/or (e) smoke production.

Flame retardant compounds can be organic or inorganic compounds containing, for example, halogens, such as chlorine or bromine, phosphorous, alumina and/or antimony. The families of flame retardants include: (a) chlorinated flame retardants; (b) brominated flame retardants; (c) phosphorous based flame retardants; (d) metal hydroxides; (e) melamine based flame retardants; (f) zinc borate; (g) low melting glasses; and (h) silicon-based materials.

Flame Resistance for Fabrics and Textiles

The ability of fabrics, textiles and clothing to retard flame is a highly desirable characteristic to which considerable attention has been directed for public safety. The United States Federal Trade Commission is currently setting standards that require flame retardant fabrics for many end uses of apparel.

Methods are available for developing various types of flame retardant fibers and fabrics. However, these methods generally possess a variety of disadvantages, the principal disadvantage being that the methods are not very durable, particularly to home or industrial launderings or cleaning processes. Fibers and fabrics treated in accordance with these methods generally have an inability to retain flame retardant properties that have been added thereto, or enhanced, after one or more washings, launderings or dry cleaning operations. The added flame retardant properties (and flame retardant agents providing such properties) are generally rendered ineffective, or significantly less effective, as a result of such washings, launderings or dry cleaning operations. Another disadvantage of these methods is that they often result in a waste of large quantities of flame retardant agents, other process components and water, causing these methods to be expensive and potentially detrimental to the environment when they are disposed. The poor recovery rates of process chemicals and solvents employed in flame retarding processes, most of which are lost to municipal waste treatment facilities, as well as required secondary washing process steps, introduce economic, process control and environmental disadvantages to such operations.

Many of the woven and non-woven thermoplastic and non-thermoplastic fibers, fibrous compositions and fabrics that are commonly used today in connection with mattresses, furniture upholstery, insulation and construction materials, and in other commercial, industrial or residential applications, burn when contacted with an open or other flame, sometimes producing toxic gases as a by-product. When treated with a flame retardant composition, thermoplastic fibers, fibrous compositions or fabrics may not burn, but may still melt, producing a molten plastic that can cause deep skin burns. It is this melting of, for example, covering materials, such as the outer surfaces of mattresses, that may allow an open flame to come into contact with other materials, such as non-woven interior construction materials, that the covering materials are supposed to protect, and that may not have been treated with a flame retardant agent.

Another problem associated with non-thermoplastic fibers, fibrous compositions and fabrics is that many non-woven or woven substrate manufacturers do not have the necessary equipment or expertise to add flame retardant agents to these fibers, fibrous compositions and fabrics in their production processes. Increased costs to these manufacturers, thus, may be incurred when roll or other goods or parts need to be shipped elsewhere for flame retarding treatment.

Environmental Impacts of Clothing Manufacture

Several pollution issues currently exist in connection with the manufacture of fabrics, textiles and clothing. As a result, the manufacture of such products often causes one or more of a variety of negative impacts upon the environment. For example, 25% of the insecticides used globally are placed upon cotton plants, which grown cotton to produce the world's most popular fabric. Additionally, many synthetic fabrics, such as polyester, are manufactured from petroleum products that are not biodegradable. Further, many fiber or fabric finishing processes, such as a wide variety of dyeing processes, are highly toxic and polluting to the environment and, thus, are not "environmentally friendly" processes.

Description of the Art

U.S. Pat. No. 4,600,606 ("the '606 patent") describes a process for rendering non-thermoplastic fibers and fibrous compositions flame resistant when contacted with a hot molten material (to prevent severe burns and blisters to workers and others that are exposed to hot molten metals, glass or other materials). The process involves the application to the fibers and fibrous compositions of a flame retardant composition incorporating a water-insoluble, non-phosphorous solid, particulate mixture of brominated organic compound and either: (a) a metal oxide of the formula $Me_2O_n$ (wherein Me is aluminum, silicon, arsenic, bismuth, titanium, zirconium, molybdenum, tin or antimony, and n is the valence of the metal), such as antimony oxide ($Sb_2O_3$), in a water insoluble, particulate form (having an average size not exceeding about 20 microns); or (b) a metal oxide as described in (a) and a metal hydrate, such as a mixture of antimony oxide and alumina trihydrate. After materials are treated with the compositions described in the '606 patent, and excess composition is removed, the wet material is cured by a two-step process: (a) drying the material at a temperature between 80° C. and 130° C.; and (b) then, in a separate step, baking the material at a temperature between 140° C. and 180° C. for ½ to 5 minutes.

In contrast with the compositions of the invention, which need not contain a metal oxide in order to be effective, and which can contain phosphorous-containing and other non-brominated flame retardant substances, the compositions described in the '606 patent contain a metal oxide and only contain non-phosphorous flame retardant substances. Additionally, the '606 patent does not teach or suggest flame retardant compositions that do not contain an amount of a dye, or of any other chemical compound, substance, agent or composition, that could have the effect of contaminating the flame retardant compositions, fibers or fibrous compositions described therein. Further, in contrast with the processes and systems of the invention, which do not require a curing step or a separate baking step after the drying step, or the heating equipment or energy resources associated with such curing and baking steps, the process described in the '606 patent requires a curing process that includes both a drying step and a separate baking step. Still further, the process described in the '606 patent does not teach or suggest the use of a "closed loop" process or system for applying flame retardant compositions to substrates, or the recycling of flame retardant compositions and/or rinse liquids.

U.S. Pat. No. 5,224,966 ("the '966 patent") describes a process for the simultaneous dyeing and flameproofing of textile sheet materials made of polyester fibers using thermosol dyes. This patent also describes dye preparations that contain one or more disperse dyes in an amount of from 0.6 to 30 g/kg and one or more flame retardants in an amount of from 100 to 200 g/L, and that are employed to achieve different depths of shade. In contrast with the processes, systems and compositions of the present invention, the '966 patent does not teach or suggest: (a) the use of a flame retardant composition that does not contain an amount of a dye, or of any other chemical compound, substance, agent or composition, that could have the effect of contaminating the flame retardant compositions; (b) the use of an adhesion agent (or any weight percent thereof); (c) the use of a flame retardant substance in a particulate form (or having the size ranges described herein); (d) the reuse of a flame retardant composition that has been applied to one or more substrates; or (e) the use of a "closed loop" process or system in which flame retardant compositions and/or rinse liquids can be recycled.

U.S. Pat. No. 5,912,196 ("the '196 patent") describes a flame retardant composition for treating high pulp content non-woven web that includes soluble solids formed from inorganic salts, such as ammonium polyphosphate, and sulfur. The '196 patent does not teach or suggest the use of a "closed loop" process or system for applying flame retardant compositions to substrates or the recycling of flame retardant compositions and/or rinse liquids, and does not discuss the durability of treated substrates or latexes.

U.S. Pat. No. 6,042,639 ("the '639 patent") describes a method for impregnating combustible materials, such as wood, paper and textiles, with an aqueous fire retarding and smoke inhibiting composition. The composition comprises an aqueous solution of the reaction product of: (a) 0.5–90% by weight of an ammonium phosphate selected from monoammonium phosphate, diammonium phosphate and mixtures thereof; (b) 0.1–30% water soluble metal salts capable of forming water insoluble phosphate and ammonium phosphate salts; (c) 1–20% by weight acid, such as phosphoric acid; (d) 1–15% by weight dicyandiamide; and (e) up to 5% by weight additives, such as fungicides. Phosphoric acid and dicyandiamide are present in the composition in the form of the reaction product guanylureaphosphate. The method comprises impregnating a combustible material with the aqueous composition and drying the impregnated material to form fire retarding and smoke inhibiting characteristics in the material. In contrast with the processes, systems and compositions of the present invention, the '639 patent does not teach or suggest: (a) the use of an adhesion agent (or any weight percent thereof); (b) the use of a flame retardant substance in a particulate form (or having the size ranges described herein); (c) the reuse of a flame retardant composition that has been applied to one or more substrates; or (d) the use of a "closed loop" process or system in which flame retardant compositions and/or rinse liquids can be recycled.

Other patents or patent applications that describe inventions that are different from the compositions, processes, systems and/or substrates of the present invention include: (a) U.S. Pat. No. 1,339,488 (which describes a method for fire proofing fibrous materials using a solution containing preferably 6% or over of soluble borate to which a proportion of an alkali, such as potassium carbonate, has been added); (b) U.S. Pat. No. 4,756,839 (which describes an aqueous solution for projection (by spraying, pumping, etc.) onto an existing fire that includes potassium carbonate, a boron-containing compound, a potassium salt of an organic acid having from 1 to 6 carbon atoms and water, and that is stated to be effective in extinguishing fires, for example, grease fires on cooking surfaces or coal fires); (c) U.S. Pat. No. 4,961,865 (which describes methods and compositions for inhibiting the combustion of wood and other cellulosic materials by impregnating the materials with the compositions); (d) Patent Application Publication Number U.S. 2003/0017565 A1 (which describes methods and compositions for treating a porous article, such as wood, to provide flame retarding, rust-preventing, organism-repellant and other properties thereto by performing enzymatic macromolecularization reactions in the article using an enzyme having a polyphenol oxidizing activity (obtained by the cultivation of a fungus) in an alkaline pH region); (e) European Patent Application Publication No. 0 285 721 (which describes a method for protecting wood against fungal growth and fire that comprises applying to the surface of the wood an aqueous solution of sodium carbonate and sodium borate); (f) International Patent Application Publication No. WO 02/06021 A2 (which describes compositions comprising a boron source composition, a melamine binder resin and a urea casein activator resin that are stated to protect wood products from attack by termites, fungi, fire and flame, and methods for using these compositions); and (g) International Patent Application Publication No. WO 00/00570 (which describes a method for flame proofing insulating materials made with renewable raw materials).

Needs in the Art and Objects of the Invention

A need currently exists for methods, systems and compositions that can effectively flame retard substrates containing from about 5 to about 100 weight percent of non-thermoplastic material, such as non-thermoplastic filaments, microfibers, fibers, fibrous compositions, threads, yarns, fabrics, textiles, materials, items of apparel, paper or tissue, or blends or products produced using any of the foregoing materials, in an "environmentally-friendly," cost effective and durable manner. A need also exists for improving currently-available processes, systems and compositions for fire retarding non-thermoplastic substrates. There is also a need for substrates containing at least about 5 weight percent of non-thermoplastic material, such as non-thermoplastic fibers, to be effectively treated with flame retardant materials before a non-woven, woven or other production process.

Accordingly, it is an object of the present invention to provide compositions, processes and systems for providing one or more flame retardant properties to one or more substrates containing from about 5 to about 100 weight percent of non-thermoplastic material, such as non-thermoplastic filaments, microfibers, fibers, fibrous compositions, threads, yarns, fabrics, textiles, materials, items of apparel, papers or tissues, or blends or products produced using any of the foregoing materials, whether woven or non-woven, and whether natural or synthetic, in a manner that conserves flame retardant agents and other process chemicals and compositions, as well as solvents, and that is "environmentally friendly" and durable, before, during or after a woven, non-woven or other production process.

It is another object of the present invention to provide methods and systems for reducing or eliminating the burning of, and/or the amount and density of smoke (which generally contains toxic gases) produced by, one or more substrates containing at least about 5 weight percent of non-thermoplastic material that is exposed to an open or other flame or fire.

It is also an object of the present invention to provide one or more methods for the application of flame retardant substances to substrates containing at least about 5 weight percent of non-thermoplastic material, such as non-thermoplastic filaments, microfibers, fibers, fibrous compositions, threads, yarns or blends prior to being woven, knitted or otherwise formed into fabrics, textiles, materials, items of apparel or other products produced using the foregoing materials.

It is another object of the present invention to provide flame retardant compositions for use in flame barrier substrates (protective substrates) containing at least about 5 weight percent of non-thermoplastic material, such as non-thermoplastic fibrous compositions, fabrics or textiles employed as outer coverings for other substrates, materials or products, for example, the central foam or other portions of cushions, pillows or mattresses, that provide one or more flame retardant properties against an open or other flame by forming a charred protective layer (a char) on one or more surfaces of the protective substrates when exposed to, or contacted with, a flame.

It is another object of the present invention to extract and recycle used or spent flame retardant compositions, rinse liquids and/or other process components used in processes or systems for flame retarding substrates, thereby reducing or eliminating the waste or release into the environment of, or the costs associated with, flame retardant compositions, rinse liquids or other substances. Preferably, if a rinse liquid is employed in processes or systems within the invention, used flame retardant composition is transferred to one holding vessel and the rinse liquid is transferred to a separate holding vessel, so that both of the substances can be reused in one or more subsequent applications of the flame retardant compositions and/or rinse liquids to substrates. Because neither the flame retardant compositions nor the rinse liquids employed in the processes and systems of the invention generally contain an amount of any dye or other substance that could contaminate the processes or systems (and preferably contain no dyes or other substances that could contaminate the processes or systems), the processes and systems of the invention can be performed in a "closed loop" manner, rather than in an "open loop" manner. Such "closed loop" processes and systems advantageously recycle, and thereby, conserve flame retardant and other process chemicals and rinse liquids, which are often expensive, as well as water or other solvents, thereby significantly reducing costs that are generally otherwise associated with the flame retarding of substrates. These "closed loop" processes and systems also generally reduce or eliminate pollution to the environment, the requirement for pre-disposal processing of chemicals and liquids and the payment of waste disposal fees, and may generally be employed without the need for elaborate safety precautions.

The present invention provides processes, systems and compositions for effectively flame retarding substrates containing from about 5 to about 100 weight percent of non-thermoplastic material, such as those described above, in an "environmentally-friendly," cost effective and durable (or non-durable) manner prior to, during or after a woven, non-woven or other production process, without wasting large quantities of flame retardant chemical compounds or compositions, solvents or rinse liquids. Within the same processes or systems of the invention, both unused and recycled flame retardant composition can be separately employed to provide one or more flame retardant properties to one or more substrates, or to enhance the flame retardant properties of one or more substrates, whether the substrates being treated are the same or different, or are of the same or a different type. As a result of the recycling (reuse) of flame retardant composition in these processes and systems, it is generally possible to reduce the costs of the components employed in the flame retardant compositions, such as flame retardant chemicals, by at least about 75%, and often by at least about 90% (and possibly higher).

The present invention provides flame retardant compositions that, when applied to the surfaces, or other areas or components, of substrates containing at least about 5 weight percent of non-thermoplastic material, such as filaments, microfibers, fibers, fibrous compositions, threads, yarns, fabrics, textiles, materials, items of apparel, paper or tissue, or blends or products produced using the foregoing materials, prior to an exposure to an open or other flame or fire, or when added to, or mixed with, these substrates during their manufacture or other production, advantageously provide a flame retardant finish or coating to the substrates that reduces the amount of burning that occurs to the substrates, and/or the amount or density of smoke (and associated toxic gases) produced by the substrates, when they are exposed to and open or other flame or fire. These substrates may advantageously be blended with one or more other substrates that do not have any flame retardant properties to produce a homogeneously blended product containing at least some substrates that have been treated in accordance with the compositions, methods or systems of the invention uniformly throughout the blended product, such as a blended fabric containing treated and untreated fibers.

Thus, the processes, systems, compositions and substrates of the present invention should reduce or prevent injury or death to human beings and animals, and destruction to real and personal property, resulting from fires, particularly when the substrates are employed as flame barrier substrates with other materials that do not have any flame retarding properties.

The above and other objects and advantages of the compositions, methods and systems of the current invention should become apparent by way of examples, and otherwise, from the more detailed descriptions of the preferred embodiments of the invention described herein.

SUMMARY OF THE INVENTION

The foregoing objectives and others are accomplished according to the current invention by providing flame retardant substrates containing at least about 5 weight percent of non-thermoplastic material, such as non-thermoplastic filaments, microfibers, fibers, fibrous compositions, threads, yarns, fabrics, textiles, materials, items of apparel, papers, tissues, or blends or products produced using any of the foregoing materials, which are hereinafter sometimes collectively referred to as "non-thermoplastic compositions," having the properties described herein.

In a first aspect, the present invention provides a process for providing one or more flame retardant properties to one or more substrates having no flame retardant properties, or for enhancing one or more flame retardant properties of one or more substrates having one or more inherent or non-inherent flame retardant properties, comprising:

(a) applying a flame retardant composition to one or more substrates in an amount that is sufficient to provide one or more flame retardant properties to the substrates, or to enhance one or more flame retardant properties of the substrates, wherein the substrates contain at least about 5 weight percent of non-thermoplastic material;

(b) removing excess flame retardant composition from the substrates;

(c) optionally, rinsing the substrates with an amount of a rinse liquid that is sufficient to remove any remaining flame retardant composition that is not necessary or beneficial for providing one or more flame retardant properties to the substrates, or for enhancing one or more flame retardant properties of the substrates;

(d) optionally, removing excess rinse liquid from the substrates;

(e) permitting the substrates to dry for a period of time, and at a temperature, that permits the substrates to have a low moisture content; and (f) applying at least some of the excess flame retardant composition that is removed from the substrates to:

(1) one or more of the same substrates at least one additional time prior to, at the same time as, or after the substrates are permitted to dry; or (2) one or more other substrates of the same or different type;

in an amount that is sufficient to provide one or more flame retardant properties to such substrates, or to enhance one or more flame retardant properties of such substrates;

wherein the flame retardant composition is preferably a mixture of:

(1) one or more flame retardant substances in a combined amount that is sufficient to provide one or more flame retardant properties to the substrates, or to enhance one or more flame retardant properties of the substrates;

(2) an aqueous or non-aqueous liquid in an amount that is sufficient to permit the flame retardant substances to be applied to the substrates in a manner that provides one or more flame retardant properties to the substrates, or enhances the flame retardant properties of the substrates;

(3) one or more adhesion agents in a combined amount that is sufficient to permit the flame retardant substances to become adhered, or to enhance the adhesion of the flame retardant substances, to one or more surfaces, areas or components of the substrates;

(4) optionally, one or more stability enhancing agents in a combined amount that is sufficient to provide at least some stability to, or enhance the stability of, the flame retardant composition;

(5) optionally, one or more viscosity enhancing agents in a combined amount that is sufficient to increase the viscosity of the flame retardant composition; and (6) optionally, one or more wetting agents in a combined amount that is sufficient to enhance an ability of the flame retardant composition to penetrate into, or to spread over, one or more surfaces, areas or components of the substrates;

wherein neither the flame retardant composition nor any rinse liquids contain an amount of a dye or other agent that could contaminate the process.

Because neither the flame retardant composition nor any rinse liquids contain an amount of any dyes or other chemical compounds, agents, substances or compositions that could have the effect of contaminating the substrates or processes, and preferably do not contain any amount of such dyes, chemical compounds, agents, substances or compositions, one or more steps of this process can be repeated one or more additional times using the same flame retardant compositions (the excess flame retardant compositions that has already been applied to one or more substrates) and/or the same rinse liquids. If necessary or desirable, the flame retardant compositions and/or rinse liquids can be replenished.

In a second aspect, the present invention provides substrates, such as filaments, microfibers, fibers, fibrous compositions, threads, yarns, fabrics, textiles, materials, items of apparel, paper or tissue, or blends or products produced using any of the foregoing materials, comprising from about 5 to about 100 weight percent of non-thermoplastic material, that are produced in accordance with the processes and/or systems of the invention.

Substrates within the invention have an ability to retain one or more flame retardant properties after they have been washed, laundered and/or dry cleaned one or more times, and will not melt when exposed to an open or other flame or fire. Such substrates are durable when they are simultaneously or subsequently exposed to one or more aqueous-based liquids, such as water, washing detergents and/or dry cleaning during washings, launderings or dry cleanings.

In a third aspect, the present invention provides a fire retardant composition for application to one or more substrates prior to an exposure of the substrates to fire comprising a mixture of:

(1) one or more flame retardant substances in a combined amount that is sufficient to provide one or more flame retardant properties to one or more substrates, or to enhance one or more flame retardant properties of one or more substrates, wherein the substrates contain at least about 5 weight percent of non-thermoplastic material;

(2) an aqueous or non-aqueous liquid in an amount that is sufficient to permit the flame retardant substances to be applied to the substrates in a manner that provides one or more flame retardant properties to the substrates, or enhances the flame retardant properties of the substrates;

(3) one or more adhesion agents in a combined amount that is sufficient to permit the flame retardant substances to become adhered, or to enhance the adhesion of the flame retardant substances, to one or more surfaces, areas or components of the substrates;

(4) optionally, one or more stability enhancing agents in a combined amount that is sufficient to provide at least some stability to, or enhance the stability of, the flame retardant composition;

(5) optionally, one or more viscosity enhancing agents in a combined amount that is sufficient to increase the viscosity of the flame retardant composition; and (6) optionally, one or more wetting agents in a combined amount that is sufficient to enhance an ability of the flame retardant composition to penetrate into, or to spread over, one or more surfaces, areas or components of the substrates;

wherein the flame retardant composition does not contain an amount of a dye or other chemical compound, agent, substance or composition that could prevent the flame retardant composition from producing the same or very similar results between its application to the substrates and, after it has been applied to the substrates, its application at least one time to:

(a) one or more of the same substrates; or (b) one or more other substrates of the same or different type;

wherein the flame retardant composition has an ability to provide one or more flame retardant properties to one or more substrates that contain at least about 5 weight percent of non-thermoplastic material and that have no flame retardant properties, or to enhance one or more flame retardant properties of one or more substrates that contain at least about 5 weight percent of non-thermoplastic material and that have one or more inherent or non-inherent flame retardant properties, without containing a metal oxide, when it is first applied to one or more substrates (in an unused form) and also after it has been applied to one or more substrates (in a reused form);

and wherein the flame retardant composition can be applied to the substrates in a "closed loop" process or system for providing one or more flame retardant properties to one or more substrates having no flame retardant properties, or for enhancing one or more flame retardant properties of one or more substrates having one or more inherent or non-inherent flame retardant properties.

In a fourth aspect, the present invention provides a method for reducing the burning of, or the amount or density of smoke (and associated toxic gases) produced by, one or more substrates containing at least about 5 weight percent of non-thermoplastic material that is exposed to an open or other flame comprising applying a flame retardancy treatment of the invention to the substrates at least one time prior to the substrates being exposed to a flame or other combustion process. The combustion of materials that are adjacent with (or present near) such substrates, but that have not been flame retarded, may also be significantly reduced or prevented as a result of the flame retardant nature of the treated substrates (i.e., the treated substrates may function as flame barrier substrates). For example, the combustion of materials that have not been treated in accordance with the processes, systems or compositions of the invention, and that are present in pillow-top mattresses, cushions, pillows, furniture, clothing or construction products containing substrates that have been treated in accordance with the processes, systems or compositions of the invention, will generally be reduced in comparison with products that are the same, but that contain all non-treated materials. This phenomena occurs because the substrates that have been treated in accordance with the processes, systems or compositions of the invention can function to protect the non-treated materials from combustion, particularly when they are used as coverings for, or to encapsulate, the non-treated materials (such as a treated non-woven fibrous composition that encapsulates foam present in a mattress).

In a fifth aspect, the present invention comprises a "closed loop" system for providing one or more flame retardant properties to one or more substrates having no flame retardant properties, or for enhancing one or more flame retardant properties of one or more substrates having one or more inherent or non-inherent flame retardant properties, comprising:

(1) at least one means for applying a flame retardant composition to the substrates in an amount that is sufficient to provide one or more flame retardant properties to the substrates, or to enhance one or more flame retardant properties of the substrates;

(2) at least one means for removing excess flame retardant composition from the substrates;

(3) optionally, at least one means for rinsing the substrates with an amount of a rinse liquid that is sufficient to remove any remaining flame retardant composition that is not necessary or beneficial for providing one or more flame retardant properties to the substrates, or for enhancing one or more flame retardant properties of the substrates;

(4) optionally, at least one means for removing excess rinse liquid from the substrates;

(5) at least one means for applying at least some of the excess flame retardant composition that is removed from the substrates to:

(a) one or more of the same substrates at least one additional time prior to, at the same time as, or after the substrates are permitted to dry; or (b) one or more other substrates of the same or different type;

in an amount that is sufficient to provide one or more flame retardant properties to such substrates, or to enhance one or more flame retardant properties of such substrates, wherein such means may be the same or different means that is employed for initially applying the flame retardant composition to the substrates; and (6) optionally, at least one means for permitting the substrates to dry for a period of time, and at a temperature, that permits the substrates to have a low moisture content;

wherein the flame retardant composition is preferably a mixture of:

(1) one or more flame retardant substances in a combined amount that is sufficient to provide one or more flame retardant properties to the substrates, or to enhance one or more flame retardant properties of the substrates;

(2) an aqueous or non-aqueous liquid in an amount that is sufficient to permit the flame retardant substances to be applied to the substrates in a manner that provides one or more flame retardant properties to the substrates, or enhances the flame retardant properties of the substrates;

(3) one or more adhesion agents in a combined amount that is sufficient to permit the flame retardant substances to become adhered, or to enhance the adhesion of the flame retardant substances, to one or more surfaces, areas or components of the substrates;

(4) optionally, one or more stability enhancing agents in a combined amount that is sufficient to provide at least some stability to, or enhance the stability of, the flame retardant composition;

(5) optionally, one or more viscosity enhancing agents in a combined amount that is sufficient to increase the viscosity of the flame retardant composition; and (6) optionally, one or more wetting agents in a combined amount that is sufficient to enhance an ability of the flame retardant composition to penetrate into, or to spread over, one or more surfaces, areas or components of the substrates;

wherein the substrates preferably contain at least about 5 weight percent of non-thermoplastic material; and wherein neither the flame retardant composition nor any rinse liquids contain an amount of a dye or other agent that could contaminate the substrates or the system.

Processes and systems within the invention can be performed without more than about 20% of the flame retardant substances (or other chemicals) employed therein being wasted in some manner, for example, by being discarded after being applied to substrates, and can even be performed without any of the flame retardant substances (or other chemicals) being wasted. As a result, these processes and systems are generally more cost effective and friendly to the environment in comparison with other flame retarding processes and systems.

Flame retardant compositions that are applied to one or more substrates in accordance with the processes and systems of the invention will generally have an ability to form, or to assist in the formation of, at least some char on one or more of the surfaces (and/or other areas or components) of the substrates when the substrates are exposed to a flame. The resulting char will generally have an ability to reduce the amount, or rate, of burning that occurs to the substrates and/or the amount of smoke (and associated toxic gases) produced by the substrates.

These and other objects and features of the present invention will be apparent from the following detailed description of the preferred embodiments of the invention.

DETAILED DESCRIPTION OF THE PREFERRED EMBODIMENTS

Figure 1:
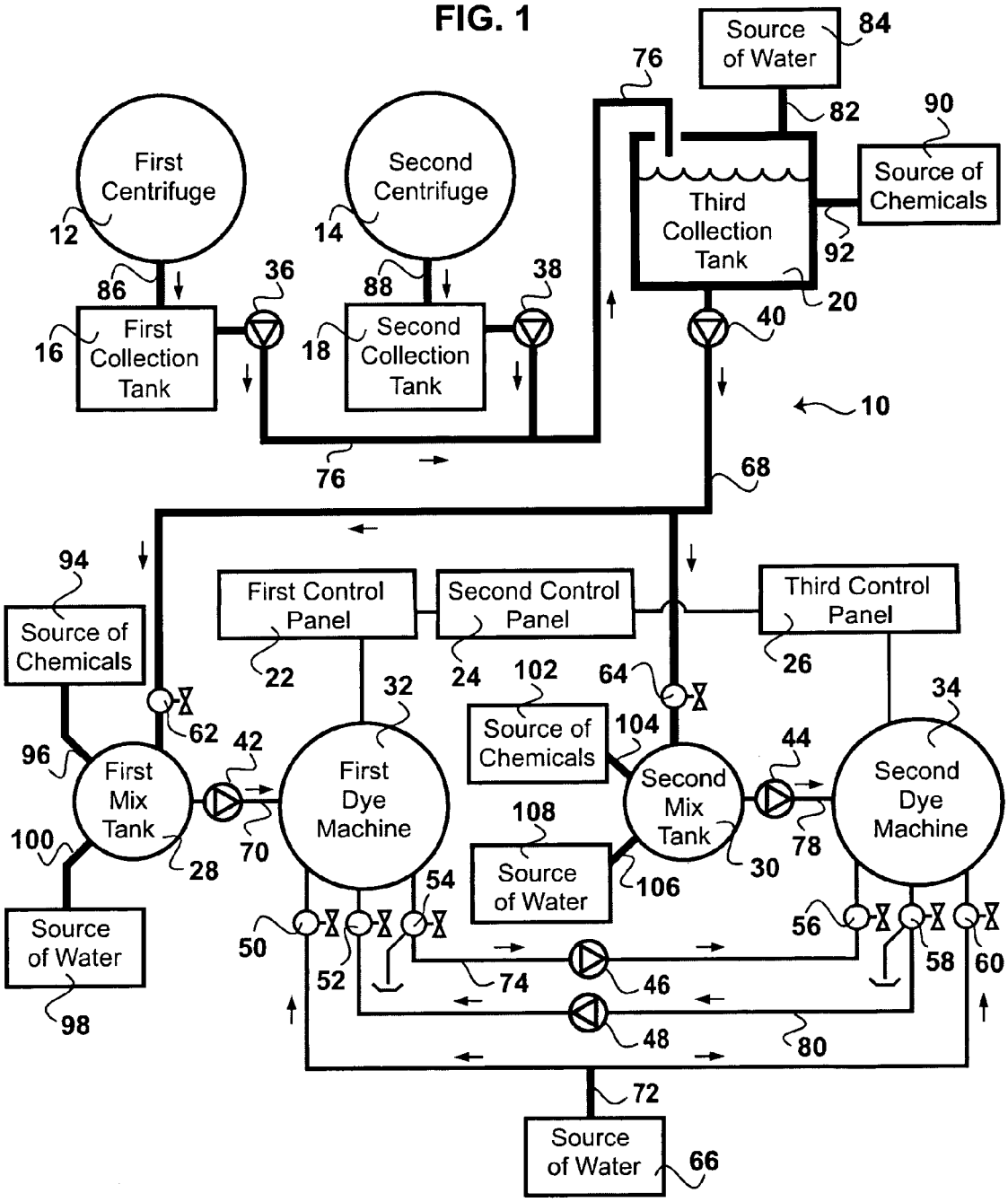
FIG. 1 is an illustration of an exemplary "closed loop" system of the invention for providing one or more flame retardant properties to, or for enhancing one or more flame retardant properties of, one or more substrates.

The present invention may be understood more readily by reference to the following detailed description of the preferred embodiments of the invention.

Definitions

For purposes of clarity, various terms and phrases used throughout this specification and the appended claims are defined in the manner set forth below. If a term or phrase used in this specification, or in the appended claims, is not defined below, or otherwise in this specification, the term or phrase should be given its ordinary meaning.

The terms "adhesion agent" and "binder" as used herein mean any organic or inorganic, natural or synthetic, element, chemical compound, substance or composition that:

(a) has the ability to adhere (bond or hold together) one or more elements, chemical compounds, agents, substances or compositions, such as one or more flame retardant substances, to one or more materials or items, such as one or more substrates, using, for example, interfacial forces, valence forces, surface attachment and/or interlocking action; and (b) that can suitably be used with a substrate. Adhesion agents are often soft at high temperatures and hard at room temperatures.

The phrase "afterflame" as used herein means the persistence of flaming of a substrate or material after the ignition source has been removed.

The term "apparel" as used herein means any item that covers, adorns and/or embellishes, including clothing, outer garments and/or other attire.

The terms "applied," "applying" and "application" as used herein in connection with flame retardant compositions, and processes and systems of the invention, mean: (a) the adding and/or mixing of the flame retardant composition with one or more substrates during the manufacture or other production of the substrates in a manner that results in the flame retardant composition (or flame retardant substances present therein) being present on one or more of the surfaces of, and/or being incorporated into, the substrates; (b) the treatment of one or more substrates with the flame retardant composition using any of a variety of saturation techniques, preferably soaking through the entireties of the substrates (including all internal portions or components thereof), such as immersing, dipping, drenching, soaking, impregnation (including pressure-vacuum impregnation and reduced pressure or pressure impregnation) and other penetration techniques; and/or (c) the placing or spreading of the flame retardant composition on or over one or more surfaces of the substrates (preferably uniformly covering all of the surfaces of the substrates), for example, using spraying (pressurized spray cans or pumps), wiping, painting, brushing, rolling, padding, knife coating, roller printing, screen printing or other similar techniques. The terms "applied," "applying" and "application" include the coating techniques described hereinbelow.

The phrases "aqueous-based liquids" and "aqueous liquid" as used herein means water and water-based (containing some water) liquids that are suitable for use with one or more substrates, which may be determined by those of skill in the art.

The phrases "batch processes" and "batch type processes" as used herein in connection with processes, systems and/or compositions of the invention mean processes in which a predetermined amount of one or more substrates is loaded into a system for applying, often via submersion, one or more compositions of the invention to the substrates in one, two, three, four, five or more separate, simultaneous, consecutive or other batches.

The phrase "being exposed to" as used herein means coming in the presence of, near to, or into contact with.

The phrase "bleaching" as used herein means a chemical process that eliminates unwanted color from substrates such as fibers, yarns or cloth. Bleaching can decolorize colored impurities that may not be removed by scouring, and may prepare the substrates for other processes.

The term "blend" as used herein in connection with filaments, fibers, microfibers, fibrous compositions, threads, yarns and/or other substrates means a combination or mixture of two or more different types of filaments, fibers, microfibers, fibrous compositions, threads, yarns and/or other substrates in connection with the production of a fabric, textile, item of apparel, material or other product, such as a polyester/cotton blend, another cotton blend or a blend of manufactured fiber and wool, using various blending techniques, for example, an intimate blend technique (a technique of mixing two or more dissimilar fibers in a very uniform mixture). Examples of fiber blends include polyester/cotton blends, linen fiber/silk blends and linen/spandex blends.

The terms "burn" and "burning" as used herein mean the production of heat, light and/or combustion, for example, by smoldering (burning with no flame or a slow fire), by charring, by scorching, by the production of a flame, or by the spread of smoldering or a flame (an increase in the area over which, or depth in which, smoldering or a flame is present), or that a material has been burned during the uninterrupted course of the "burn."

The terms "char" and "carbon-char" as used herein mean a substance or condition, usually in the form of a carbonaceous residue, that results on or near the surface of a flammable substrate from pyrolysis or the incomplete combustion of the flammable substrate, that generally functions as a protective coating on the substrate that acts as a physical barrier to flame, and that generally has an ability to reduce flammability and/or heat release, and/or volatilization of flammable materials, by thermally insulating the flammable substrate from heat, combustion and/or fire, thereby protecting the substrate from thermal degradation and reducing flame spread and/or penetration and, thus, the production of smoke (and associated toxic gases).

The terms "charred" and "charring" as used herein mean the act of producing char or carbon-char.

The phrases "closed loop" and "closed loop systems" as used herein in connection with processes and systems of the invention mean a process or system in which one or more compounds, compositions and/or other substances employed therein, such as flame retardant compositions and/or rinse liquids, are recycled (reused, with reconstitution if necessary or desired, in an application to one or more substrates after a prior application to one or more substrates), often being recirculated, for example, in a feed, return or other line, such that the compounds, compositions and/or other substances can be used at least one time again, and preferably several times again, and most preferably over and over again, resulting in an indefinite recycling loop (use again of the same compounds, compositions and/or other process components). The compounds, compositions and/or other substances may be recirculated within the system, for example, using a pump or other recirculating equipment known by those of skill in the art, and often result in a zero discharge from the system (with no compounds, compositions or substances ever exiting the system), rather than being disposed of in the waste stream. As a result, significantly reduced costs are generally incurred in connection with: (a) the purchase of flame retardant compounds, compositions and other process components (significantly reduced amounts of the flame retardant compounds, compositions and other substances need to be purchased because they are being reused, rather than being disposed of after a first use); (b) the waste handling costs associated with the disposal of the flame retardant compounds, compositions and other substances (which can be high, and which can be eliminated); and (c) labor associated with the operation of the processes and systems (because the processes and systems generally are easy to operate and require only minimal tasking). Second, because the flame retardant compounds, compositions and/or other process components employed in the closed loop processes and systems are recycled, these processes and systems reduce or eliminate environmental concerns in connection with the disposal and waste handling of the compounds, compositions and other substances (i.e., the processes and systems are "environmentally friendly" because they generally do not cause damage, or air, water or land pollution to the environment). Third, these processes and systems often reduce or eliminate the exposure of personnel to flame retardant chemicals, compositions and/or other process components. Fourth, these processes and systems are generally simpler, more efficient and more flexible in comparison with "open loop" systems, and with other systems for achieving the same results, and often result in high quality products. The "closed loop" processes and systems may maintain at least some flame retardant chemicals, composition and/or other process components separate from other chemicals, compositions and/or process components.

The term "combustible" as used herein means capable of burning.

The term "combustion" as used herein means a chemical change, especially oxidation, resulting from an exothermic reaction of a substance with an oxidizer, and generally accompanied by the production of heat, light, flames, glowing and/or the emission of smoke.

The term "composition" as used herein means a product that results from the combining of more than one ingredient.

The terms "contaminate" and "contamination" as used herein in connection with flame retardant compositions employed with the processes, systems or substrates of the invention mean the act of a chemical compound, agent, substance or composition, such as a dye pigment, a dye solution, dirt or oil, or of a condition, such as a change in pH, viscosity or surface tension of an aqueous or non-aqueous medium, to render the flame retardant composition reasonably unsuitable for reuse (recycling), for example, with the same type of substrates, after it has been applied to one or more substrates. This may occur, for example, by: (a) producing a different color shade or intensity on one or more substrates in comparison with the color shade produced on the substrates previously treated; (b) producing streaks, bands, lines or other defects on one or more substrates; (c) adding one or more impurities to the flame retardant compositions; (d) interfering with a property of the flame retardant compositions (pH, viscosity, weight percent of flame retardant substances or other components); (e) altering a surface, area or component of a substrate in a manner that inhibits or detrimentally alters the uptake of flame retardant substances; or (f) causing some other disadvantageous effect or result to one or more substrates. If a flame retardant composition is not contaminated, it will generally have the ability to achieve about the same, or very similar, results when it is reused in an application with one or more other substrates, particularly substrates of the same type as the substrates that had previously been treated with the same flame retardant composition. Those of skill in the art can determine whether a particular flame retardant composition would be reasonably unsuitable for use after it has been applied to one or more substrates.

The phrases "continuous processes" or "continuous methods" as used herein in connection with processes, systems and/or compositions of the invention mean processes in which one or more substrates are fed continuously into a system for applying one or more compositions of the invention to the substrates. A continuous production process, rather than the use of one or more batch lots, is employed. When the substrates are textiles, the textiles are fed into the system at speeds preferably ranging from about 5 to about 500 meters per minute, and more preferably ranging from about 20 to about 100 meters per minute.

The term "cure" as used herein means to alter one or more of the properties of a compound, substance or material by chemical reaction, such as condensation or addition. Curing is usually accomplished by the action of heat, of a catalyst or reactive agent ("curing agents"), or both, either with or without pressure.

The phrase "desizing" as used herein means the removal of sizing agents, such as PVA or starch, from substrates that may have had sizing materials applied thereto.

The term "dispersion" as used herein means a two-phase system in which one phase consists of generally finely divided particles (often in the colloidal size range) distributed throughout a bulk substance. The particles are the disperse or internal phase and the bulk substance is the continuous or external phase.

The phrase "dry cleaning agents" as used herein means elements, chemical compounds, solvents and/or other substances that are customarily employed to clean fabrics, textiles and/or items of apparel using dry cleaning processes.

The term "durable" as used herein means that a fire-retardant substrate or material, such as a substrate that has been treated in accordance with the compositions, methods and/or systems of the invention, has an ability to maintain one or more fire-retardant properties that have been added to the substrate, or enhanced, after at least about one washing, for example, using a home washer and/or tumble dryer, and generally after at least about 5 washings. In some cases, the fire-retardant substrate or material may have an ability to maintain its one or more fire-retardant properties after at least about 10, at least about 15, at least about 20, or at least about 50 washings, or indefinitely (after every washing).

The phrase "dyeing" as used herein means the process of applying color to filaments, fibers, fibrous compositions, thread, yarn, fabric, textiles or materials, with or without a thorough penetration of the colorant or dyestuff (pigment, reactive, vat, naphtol, disperse, highly-colored or similar substance) into the filaments, microfibers, fibers, fibrous compositions, thread, yarn, fabric, textiles or materials. Major methods of dyeing include bale dying, batik dyeing, beam dyeing, burl or speck dyeing, chain dyeing, cross dyeing, jig dyeing, package dyeing, piece dyeing, pad dyeing, pressure dyeing, random dyeing, raw stock dyeing, resist dyeing, skein dyeing, solution dyeing (cope dyeing or spun dyeing), space dyeing, stock dyeing, top dyeing, union dyeing, vat dyeing, yarn dyeing or dyeing in a Williams Unit.

The term "emulsion" as used herein means a generally stable mixture comprising at least one continuous phase, at least one disperse phase and, optionally, an emulsifier. For example, an emulsion may employ two liquids, one as a continuous phase and one as a disperse phase, such as oil-in-water or water-in-oil emulsions, or a liquid as the continuous phase and a solid as the disperse phase.

The phrases "environmentally clean" or "environmentally cleaner" as used herein in connection with compositions, processes and systems of the present invention mean that, without requiring pollution control equipment, the compositions, processes and systems:

(a) produce no environmental pollutants; or (b) produce smaller quantities of one or more environmental pollutants in comparison with the quantities of the same environmental pollutants produced by one or more "open loop" systems for achieving the same results under the same circumstances and using the same quantities of the same reagents.

The phrase "environmental pollutants" as used herein mean any element, chemical compound, gas, solid, liquid, substance, material, or blend or other combination thereof, that has the ability to contaminate (make less pure or clean), and/or cause damage or destruction to, any part of the environment (air, water, soil and the like), and includes air pollutants, such as criteria air pollutants, water pollutants and soil pollutants. Environmental pollutants include, but are not limited to, oxides of sulfur (SOx), such as sulfur dioxide ($SO_2$), oxides of nitrogen (NOx), such as nitric oxide (NO), nitrogen dioxide ($NO_2$), nitrous oxide ($N_2O$), carbon monoxide (CO), carbon dioxide ($CO_2$), hydrochloric acid (HCl), methane ($CH_4$), volatile organic compounds (VOCs), dioxin, ammonia ($NH_3$), benzene, hydrogen fluoride, hydrogen sulfide, poly-aromatic hydrocarbons (PAH), hexachlorobutadiene, ethylene dibromide, mercury, arsenic, lead, uranium and thorium, and isotopes thereof.

The phrase "excess flame retardant composition" as used herein in connection with a flame retardant composition that has been applied to a substrate means an amount of the flame retardant composition that is greater than that which is necessary or beneficial for achieving the desired results (providing one or more flame retardant properties to the substrate or enhancing one of more flame retardant properties of the substrate).

The phrase "excess rinse liquid" as used herein means an amount of a rinse liquid that has been applied to a substrate that is greater than that which is necessary or beneficial for achieving the desired result (removing remaining flame retardant composition that is not necessary or beneficial for providing one or more flame retardant properties to the substrate, or for enhancing one or more flame retardant properties of the substrate).

The term "fabric" as used herein means a manufactured assembly of one or more of the same or different filaments, microfibers, fibers, fibrous compositions, threads and/or yarns, which is generally planar, such as one or more layers of filaments, microfibers, fibers, fibrous compositions, threads and/or yarns in the form of a flat sheet. Fabrics include, for example, any woven, knitted, plaited, braided, felted or non-woven substance or material made of filaments, microfibers, fibers, fibrous compositions, threads and/or yarns. Fabrics can be knitted, made on a loom, needled, or constructed in one of a variety of other methods known by those of skill in the art.

The term "fiber" as used herein means the natural or synthetic substance that generally forms the basic or fundamental unit comprising a fabric, textile, item of apparel or other material, such as cotton, wool, straw, wood or paper. Fibers may be elongated single cell seed hairs like cotton, elongated multicellular structures like wool, an aggregation of elongated cells like flax, cellulosic fibers (straw and the like), or man-made filaments like nylon, polyester or rayon. Fibers may be natural or manufactured (synthetic) filament type structures (including filaments), and may be variant fibers or non-variant fibers. Fibers are generally capable, either alone or combined with other fibers in a blend, of being: (a) spun into yarn; (b) used to produce a non-woven fabric, textile or material; (c) used to produce a woven fabric, textile or material; or (d) used to produce another type of fabric, textile or material.

Examples of fibers include, but are not limited to: (a) flax; (b) cotton; (c) wool (which may be obtained, for example, from on or the forty or more different breeds of sheep, and which currently exists in about two hundred types of varying grades); (d) silk; (e) RAYON® (a man-made fiber that may include VISCOSE RAYON® and CUPRAMMONIUM RAYON®); (f) acetate (a man-made fiber); (g) NYLON® (a man-made fiber); (h) acrylic (a man-made fiber); (i) polyester (a man-made fiber); (j) triacetate (a man-made fiber); (k) SPANDEX® (an elastomeric man-made fiber); (l) polyolefin/polypropylene (man-made olefin fibers); (m) microfibers and microdeniers; (n) lyocell (a man-made fiber); (o) vegetable fiber (a textile fiber of vegetable origin, such as cotton kapok, jute, ramie or flax); (p) vinyl fiber (a manufactured fiber); (q) alpaca; (r) angora; (s) carbon fiber (suitable for textile use); (t) glass fiber (suitable for textile use); (u) raffia; (v) ramie; (w) sisal; (x) vinyon fiber (a manufactured fiber); VECTRAN® fibers (manufactured fiber spun from CELANESE VECTRA® liquid crystal polymer); and (z) waste fiber. Fibers are commercially available from sources known by those of skill in the art, for example, E. I. Du Pont de Nemours & Company, Inc. (Wilmington, Del.), American Viscose Company (Markus Hook, Pa.) and Celanese Corporation (Charlotte, N.C.).

The term "fibrous composition" as used herein means any composition or composite which has as a component at least one type of fiber. Examples of fibrous compositions include rope, yarn, thread, paper, certain filters and fabrics used in apparel, upholstery, bedding, carpeting, and other furnishings, as well as commercial and industrial applications, including, by way of example, automotive head and trunk liners, insulation, gaskets, awnings, banners, and flags.

The term "filament" as used herein means any natural or synthetic fiber having an aspect ratio (length to effective diameter) that is generally infinity (i.e., a continuous fiber or a fiber of indefinite length), such as acetate, RAYON®, NYLON®, or polyester. Filaments may generally be spun into yarn.

The term "fire" as used herein mean a chemical reaction that releases heat, light, flame and/or smoke, and that is often rapid and persistent, for example, the exothermic combination of a combustible substance with oxygen.

The term "flame" as used herein means a zone of combustion that is generally in the gaseous phase, and from which light is emitted.

The phrase "flame barrier substrate" as used herein means a substrate having one or more flame retardant properties that is used with another substrate or material, which other substrate or material may or may not have any flame retardant properties, and that has an ability to provide at least some flame retardant protection to the other substrate or material. For example, a pillow-top section of a mattress composed of a non-woven fibrous composition treated in accordance with the flame retardant compositions, processes or systems of the invention may be employed as a flame barrier substrate to provide at least some flame retardant protection to one or more other substrates or materials present in the mattress, such as foam, or to one or more other portions of the mattress, particularly to those substrates, materials or portions that do not have any flame retardant properties and that are located further inside (towards the center of) the mattress. Flame barrier substrates may be employed in a wide variety of products, such as mattresses, cushions, pillows, bedding, furniture, clothing (as linings), laminates, door frames and in other products having coverings or more than one layer or component, to provide a fire-proof or flame retardant barrier for other combustible substrates or materials against a flame or fire. If a flame barrier substrate is employed to cover, encapsulate, enclose or otherwise protect another material or substrate, and the flame barrier substrate does not burn, the flame barrier substrate will generally prevent the other material or substrate from burning.

The phrases "flame resistant substance," "flame retardant substance," "fire resistant substance" and "fire retardant substance" as used herein mean any element, chemical compound, agent, substance or composition which, when added to a substrate or material, provides one or more flame retardant properties to the substrate or material, or enhances one or more of the flame retardant properties previously existing in the substrate or material.

The phrases "flame resistant," "fire resistant," "flame retardant" and "fire retardant" as used herein mean: (a) having an ability to not support a flame, fire and/or combustion, either while a flame or fire is present, or once a source of heat or ignition is removed; and/or (b) being retardant to, or incapable of, burning (being fireproof—undergoing virtually no change when exposed to flame, fire and/or combustion process). A flame resistant substrate or other material may char and/or melt.

The phrase "flame retardant chemical", and "flame resistant substance" as used herein means an element, chemical compound, agent or substance that has the ability to reduce or eliminate the tendency of a substrate to burn when the substrate is exposed to a flame or fire, and that is suitable for use with one or more substrates, which may be determined by those of skill in the art.

The phrase "flame spread" as used herein means the propagation of a flame front.

The phrase "flame spread rate" as used herein means the distance traveled by a flame front during its propagation per unit of time under specified test or other conditions.

The term "flammability" as used herein means a measure of the extent to which a substrate or material will support combustion under specified test or other conditions.

The phrase "heat release" as used herein means the calorific energy released by a material or substrate during combustion.

The phrase "hybrid fabric" as used herein means a fabric for composite manufacture in which two or more different yarns are used in fabric construction.

The phrase "industrial fabric" as used herein means: (a) fabrics employed in one or more industrial processes, such as filtering, polishing or absorption; (b) fabrics combined with other materials to produce a different type of product, such as rubberized fabric for hoses, belting and tires; (c) fabrics combined with synthetic resins to be used for timing gears and electrical machinery parts; (d) coated or enameled fabrics for automobile tops and book bindings; (e) fabrics impregnated with adhesive and dielectric compounds for applications in the electrical industry; and/or (f) fabrics incorporated directly into a finished product (sails, tarpaulins, tents, awnings and specialty belts for agricultural machinery, airplanes and conveyors).

The phrases "intumescent substances" and "intumescent chemicals" as used herein mean elements, chemical compounds, substances, agents and/or compositions that generally cause the foaming and/or swelling of substrates and/or other materials when they are exposed to high surface temperatures or flames. When, for example, they are applied to the fabrics as backcoatings on mattresses and furniture, and the coated fabric is exposed to an open flame, the intumescent substance generally reacts to form a thermal barrier that prevents the ignition of the underlying foam or other material. Intumescent substances generally have three basic ingredients, a carbon source, an acid source and an expanding agent. For example, the carbon source may be a polyol such as starch or pentaerythritol, the acid source may be ammonium phosphate and the expanding agent may be melamine.

The phrase "latex" as used herein means an aqueous suspension of a hydrocarbon polymer occurring naturally in some species or trees, shrubs or plants, or made synthetically, which is often white in color, and which generally is tacky. One example of a natural latex is that of the tropical tree *Hevea braziliensis*, which provides a source of rubber. It is comprised of globules or rubber hydrocarbon coated with protein. The particles have an irregular shape, generally varying from about 0.5 to about 3 microns in diameter. The suspension is stabilized by electric charges. This latex contains about 60 weight percent of water, about 35 weight percent of hydrocarbon, about 2 weight percent of protein and low percentages of sugars and inorganic salts. For commercial purposes, rubber latex can be concentrated by evaporation or centrifugation using techniques known by those of skill in the art. Ammonia may be added as a preservative, and coagulation may be induced by the addition of acetic acid or formic acid. Latex may be present in the form of a liquid emulsion, which may be further diluted with some type of a solvent, such as water.

The term "lining" as used herein means a material that is used to cover one or more inner surfaces, for example, when an inner surface is of a different material than the outer surface. Linings, such as felt or velvet, may be used, for example, for garments, boxes and coffins.

The phrases "manufactured fiber" and "man-made fiber" as used herein mean fibers (including filaments) that are generally chemically produced using fiber-forming substances which may be, for example: (a) polymers synthesized from chemical compounds, such as acrylic, nylon, polyester, polyethylene, polyurethane and/or polyvinyl fibers; (b) modified or transformed natural fibers, such as alginic and cellulose-based fibers, including acetates and rayons; and/or (c) minerals, such as glasses.

Depending upon the context, which will be evident to a person of skill in the art, the term "material" as used herein means:

(a) its ordinary meaning; or (b) any type of washable or non-washable, elastic or non-elastic, hybrid or nonhybrid, plated or non-plated fabric, textile, cloth, yarn good or other item that:

(1) can be produced by combining two or more of the same or different filaments, microfibers, fibers, threads, yarns, fibrous compositions or blends together using woven, non-woven or other techniques, which are known by those of skill in the art, for example, by knitting, weaving, felting, air conditioning or the use of an air jet loom;

(2) is capable of at least partially burning (has the ability to partially or fully burn); and (3) can be employed either alone or in combination in any one or more of a wide variety of useful products.

A material may be employed, for example, in clothing and other items of apparel (night and/or day clothing), shoes and diapers for babies and toddlers, children's play, dress and dress-up clothes, Halloween (and other) costumes, undergarments, girdles, garters, sports and other types of bras, lingerie, nightgowns, robes, pajamas, pants, jeans, shorts, shirts, dress shirts, golf shirts, blouses, skirts, dresses, suits, blazers, sweaters, coats, jackets, simulated or fake furs, stoles, shawls, capes, socks, hats, hoods, gloves, ear muffs, ties, scarves, other neck wear, exercise wear, sportswear, bathing suits, aprons, work uniforms (medical, construction, restaurant, transportation, geotextiles, high technology vocations and the like), military uniforms, aerospace uniforms, table wear (tablecloths, napkins), bedding (crib bumpers, crib mobiles, mattress covers, linens, sheets, blankets, bed covers, bed spreads, comforters, quilts, quilting, pillows, pillow cases and the like), pieces of art, window coverings (curtains, draperies, shades, other window coverings and treatments and the like), wall coverings, other residential and commercial furnishing fabrics, upholstery, floor coverings (carpet products, carpets, area and other rugs, mats and carpet backing), fishnets, ropes, twines, string, cables, packings, mosquito nets, grain sacks, cement sacks, power puffs, linings, medical supplies (gauze, bandages, wraps for limbs, medical tape and the like), bathing supplies (wash clothes, towels or sponges), school supplies (book bags, book covers, backpacks and lunch boxes), cleaning supplies (cleaning cloths, polishing cloths, dusters), insulation, boat accessories (sails, covers, sun shades), hammocks, tents, in sewing projects, or as a base fabric for needlework or industrial fabrics.

A material may be employed within, on or in connection with another item, structure or material, for example, as a lining of clothing, as a component of a commercial or residential vehicle (automobile, truck, motor home, motorcycle and the like) or as a component of, or cover or encapsulating material for, an item, such as a mattress, a piece of furniture (cushion, divan, ticking, foam, filling for a pillow-top or other portion of a mattress), a piece of bedding (pillow or filling for a pillow or comforter), a stuffed animal, a carpet product, an appliance, an electronic device, an umbrella or a cigarette filter.

The term "microfiber" as used herein means an ultrafine fiber that is generally of less than about 1.0 denier per filament or 0.1 tex per filament, or having a diameter of less than about 10 microns. Microfibers are generally used to produce ultrasoft, lightweight fabrics.

The phrase "natural fiber" as used herein means fibers (including filaments), such as cotton, wool, silk, flax and the like, that are not chemically produced. Natural fibers are generally obtained from: (a) animals (silk and wool); (b) minerals (asbestos); or (c) vegetable origins (cotton, kapok, flax, jute and ramie).

The phrase "non-aqueous liquids" as used herein means liquids that are suitable for use with one or more substrates, which may be determined by those of skill in the art, and that do not contain any water, such as methyl chloride and carbon tetrachloride.

The phrase "non-thermoplastic" as used herein in connection with a filament, microfiber, fiber, fibrous composition, thread, yarn, fabric, textile, item of apparel or other material or substrate means one that is not made from, and does not contain any, thermoplastic components or materials.

The term "non-woven" as used herein in connection with fabrics, fibrous compositions, textiles, materials, products and similar items means a structure that is produced by attaching, bonding and/or interlocking two or more of the same or different components, such as filaments, microfibers, fibers, fibrous compositions, threads or yarns, together, generally by loosely bonding them together, and using one or more of a variety of techniques that generally does not involve weaving or interlacing, but employs mechanical, chemical, thermal and/or solvent means, for example, using known needlepunching, meltblowing, spunbonding, wet-forming and various bonded carded web processes. Non-woven materials may be manufactured using fusing or chemical bonding techniques (with the use of binding agents, such as PVA or polyester) or similar techniques, which are known by those of skill in the art. This term generally does not include fabrics, textiles, fibrous compositions or materials that are woven, knitted, tufted, or those made using wool or other felting processes.

The phrases "open loop process" and "open loop system" as used herein mean a process or system in which the compounds, compositions and/or other substances employed therein, such as flame retardant compounds and rinse liquids, are not recycled (not reused or recirculated). Such compounds, compositions and other substances are, thus, generally discarded.

The phrase "package dyeing" as used herein means a dyeing method that is similar to skein dyeing, except that the yarns are generally wound on perforated packages, and the dye stuff is generally forced under pressure from inside the package through the yarn.

The phrase "piece dyeing" as used herein means a method that may be used, for example, for dyeing carpet or another substrate after it is woven. Color is generally applied from a dye beck (stainless steel tank) on unfinished carpet generally consisting only of primary backing and undyed yarns. ("Bath piece dyeing" is similar to "piece dyeing," except that the carpet is moved in and out of a single or other dye bath by a motorized reel. "Continuous piece dyeing" is similar to "piece dyeing," except that the dye is generally applied to the substrate via a polished roller rotating in a continuously fed, full width dye trough.)

The term "printing" as used herein means a method that can be used to apply intricate patterns or designs to cloth or prepared fabric. A variety of known machinery and techniques can be used in printing (pigment printing, wetprinting, discharge printing, carpet printing and the like). In "roller printing," a substrate is placed on a moving belt and dye is squeezed from a roll or drum through a pattern attachment. In "screen printing," a substrate is placed upon a flatbed and the dye stuff is forced through screens by an electromagnetic system. In "jet printing," jets intermittently inject color into the substrate in response to signals sent by a computer.

The phrase "protective colloid" as used herein means a hydrophilic high polymer whose particles (molecules) are of colloidal size, such as protein or gum. Protective colloids may be either naturally present in such systems as milk and rubber latex, or may be added to, or added as a component of, a mixture as a stabilizing, suspending and/or thickening agent to stop or reduce coagulation or coalescence of particles or of other dispersed material, or to perform some other function. Examples of protective colloids include hydrocarbon particles of latex that are covered with a layer of protein which keeps them from cohering, carboxy methyl cellulose, methoxy cellulose, ethoxy cellulose, gelatin, sodium alginate and gum arabic.

The term "pyrolysis" as used herein means the generally irreversible chemical decomposition of a substrate or material due to an increase in temperature without oxidation.

The term "rayon" as used herein means a synthetic fabric that is generally silk-like, and that is made from cellulose fibers, such as cellulose acetate fibers (acetate rayon) or viscose (cellulose xanthate) fibers (viscose rayon). It is a wood-based fabric that often burns rapidly when exposed to a flame.

The term "recycle" as used herein means to reuse (to put or pass through a cycle) at least one time again (preferably several times again, and more preferably over and over again without limitation).

The terms "reduce," "reducing," "retard" and "retarding" as used herein in connection with the burning of, or the amount or density of smoke (and associated toxic gases) produced by, one or more substrates that have been treated in accordance with the processes, systems or compositions of the present invention means that: (a) the amount of burning of, flame spread over or through, and/or heat released by, the substrates, and/or the amount or density of smoke (and associated toxic gases) produced or generated by the burning substrates, is less than would have occurred under the same circumstances and conditions with substrates that are the same, but that had not been treated in accordance with the processes, systems or compositions of the invention; and/or (b) the amount of time that it takes for smoldering, and/or for a flame to spread over or through the substrates, and/or for the substrates to otherwise burn, and/or for smoke (and associated toxic gases) to be produced or generated from the substrates when they are burning, is less than would have occurred under the same circumstances and conditions with substrates that are the same, but that had not been treated in accordance with the processes, systems or compositions of the present invention. Such results may be determined by methods known by those of skill in the art, such as by the various test methods set forth by the American Society for Testing and Materials, or by Underwriters Laboratories, Inc., and other similar known test methods, for example, Test Method NFPA 701, California Standard TB603 or TB604 or British Standard 5852.

The phrase "rinse liquid" as used herein means an element, chemical compound, composition, agent or substance in liquid form, such as water or an aqueous or non-aqueous solvent, that is suitable for use with one or more substrates, which may be determined by those of skill in the art, and that: (a) has the ability to remove, or is employed to remove, one or more elements, chemical compounds, compositions, agents or substances that have previously been applied (applied prior to the rinse liquid) to a substrates (and possibly contaminants as well); and (b) is not necessary for providing one or more flame retardant properties to the substrates, or enhancing one or more flame retardant properties of the substrates.

The term "scouring" as used herein means a cleaning process that removes impurities, such as lubricants, dirt, antistatic agents and fugitive tints used for yarn identification, from substrates such as fibers, yarns or cloths.

The phrase "self-extinguishing" as used herein means a substrate, fabric or material that will burn in the presence of a flame, but that will extinguish itself within a specified period of time after the flame is removed.

The phrase "singeing" as used herein means a dry process used on woven goods that removes fibers protruding from yarns or fabrics. The fibers are generally burned off by passing them over a flame or heated copper plates. Singeing generally improves the surface appearance of woven goods and reduces pilling.

The phrase "skein" as used herein means a length of thread or yarn that is generally wound in a loose, elongated coil.

The phrase "skein dyeing" as used herein means the dyeing of a skein, generally as orders are obtained.

The term "smoke" as used herein means a generally visible suspension of solid, liquid or other particles in gases resulting from combustion or pyrolysis. Smoke resulting from a fire generally contains deadly gases, such as carbon monoxide.

The term "solution" as used herein means a generally uniformly dispersed mixture of one or more substances (solutes) in one or more other substances (solvents). Solutions may be, for example, liquid/liquid, solid/liquid or solid/solid. The proportion of substances in a solution generally depends upon their limits of solution. The solubility of one substance in another is the maximum amount that can be dissolved at a given temperature and pressure, which can readily be determined by those of skill in the art. A solution that contains such a maximum amount is saturated.

The phrase "solution dyeing" as used herein means that a fiber or other substrate is dyed in its liquid or other state before it is spun into yarn or made into some other form. This method is commonly employed with olefins (polypropylenes) and polyesters.

The term "stability" as used herein in connection with an element, chemical compound, substance, composition, solution, dispersion, suspension, emulsion, mixture, or any mixture of the foregoing, means an ability to partially or fully maintain its form, chemical nature or equilibrium, for example, maintaining an emulsion in the form of an emulsion, or preventing solids in a solution from agglomerating and/or precipitating.

The phrase "stability enhancing agent" as used herein means one or more elements, chemical compounds, substances, compositions or agents that has an ability to provide stability to, or to enhance the stability of, an element, chemical compound, substance, composition, solution, dispersion, suspension, emulsion, mixture or any mixture of the foregoing, such that the solids present therein are prevented from agglomerating or precipitating. Examples of stability enhancing agents include surfactants, emulsifying agents and/or mixtures thereof.

The phrase "stock dyeing" as used herein means that, after fibers or other substrates are made, they are dipped into a bath of dye, where heat and pressure force color into the fibers or other substrates, before they are spun into yarn or made into some other form.

The term "substrate" as used herein means any item, material or product that is suitable for flame retardancy treatment in accordance with processes, systems and/or compositions of the present invention, which may be readily determined by those of skill in the art. Substrates include, for example, natural or synthetic (including cellulose containing) filaments, microfibers, fibers, fibrous compositions, threads, yarns, fabrics, textiles, materials, items of apparel, wood, papers or tissues, or blends or products that may be produced using one or more of the foregoing materials, such as fibers, fibrous compositions or fabrics of flax, kenaf, ramie, caroa, bagasse, ficque, banana fiber, cotton, wool, linen, jute, coconut fiber, rayon, silk, denim, khaki, drill, duck, velveteen, voile, barathea, gabardine, galatea, bathrobe blanketing, canton flannel, chino, jaspé, raminé, ticking, metalized fabric (fabric containing metalized yarn), hemp, wood, wood pulp, straw, recycled paper, cellulose-based waste product, and/or mixtures thereof. The substrate may be in a new, natural (containing natural colors), raw (not treated in any manner), treated (treated in some manner, such as with one or more flame retardant compounds), untreated, dyed (fully or partially), not dyed, bleached or unbleached condition, may be woven or non-woven, and may or may not be crush-resistant, wrinkle-resistant, shrinkage resistant, crisp or soft in hand, water-repellant, embossed or patterned.

The term "suspension" as used herein means a system in which particles (solid, semisolid or liquid), which are generally small, are more or less uniformly dispersed in a liquid medium. Suspensions may contain protective colloids (to prevent precipitation and/or agglomeration of solids).

The term "surfactant" as used herein means any element, chemical compound, agent, substance or composition that has the ability to reduce surface tension when dissolved or dispersed in water, or in water-based solutions or dispersions, and/or that reduces interfacial tension between two liquids, or between a liquid and a solid, including detergents, wetting agents and emulsifiers, and that that are suitable for use with one or more substrates, which may be determined by those of skill in the art.

The term "textile" as used herein means any fabric or cloth, whether woven or non-woven. Textiles are generally fibrous in nature, and may be produced using a wide variety of woven or non-woven techniques, such as weaving, felting, knitting, crocheting, spun bonding, meltblowing or airlaid, wetlaid or carding processes using, for example, looms, knitting machines, needles or other equipment known by those of skill in the art.

The phrase "thermoplastic" as used herein means a component, substrate, material or product contains, or is produced using, thermoplastic polymers that have a melting point and a glass transition temperature such that they may be heated and molded into forms and shapes without crosslinking.

The phrase "thread" as used herein means a specialized type of yarn that is generally used for some definite purpose, such as sewing, basting or embroidery work. Two common threads in use today are three-ply thread and six-ply thread.

The phrase "ticking" as used herein means a fabric that is often used for covering box springs, mattresses and pillows, and that is generally woven.

The term "unbleached" as used herein in connection with fabrics, textiles or materials means that the fabrics, textiles or materials are in a natural, unbleached condition.

The phrases "viscosity enhancing agent" and "thickness enhancing agent" as used herein mean an element, chemical compound, agent, substance or composition, such as a protective colloid, that has the ability to enhance (increase) the viscosity (the internal resistance to flow exhibited by a fluid) of a fluid, and that is suitable for use with one or more substrates, which may be determined by those of skill in the art. Water is the primary viscosity standard, and has an accepted viscosity at 20° C. of 0.01002 poise. Many methods and devices are known by those of skill in the art for measuring viscosity, for example, Engler, Saybolt, Redwood, Brookfield and Krebs-Stormer viscometers.

The phrase "washing detergents" as used herein means chemical compounds and/or other agents that are normally employed as cleaning substances in connection with fabrics, textiles and/or items of apparel, such as detergents.

The term "weave" as used herein means the particular manner in which a fabric is formed by interlacing filaments, fibers, fibrous compositions and/or yarns.

The phrase "wetting agent" as used herein means a surface-active element, chemical compound, agent, substance or composition that, when added with an aqueous or non-aqueous liquid, causes the liquid to penetrate more easily into, or to spread more easily over one or more surfaces of, another material, such as a substrate, generally by reducing the surface tension of the liquid, which may be determined by those of skill in the art. Soaps, alcohols and fatty acids are examples of wetting agents.

The term "woven" as used herein means the joining of two or more filaments, fibers, microfibers, fibrous compositions, threads or yarns together using one or more of a variety of weaving or interlacing techniques, such as plain weave, unbalanced plain weave, basket weave, diagonal weave, special weave, satin weave, twill weave, double cloth and/or dobby loom techniques, using, for example, one of a variety of different looms or other weaving equipment. Examples of woven fabrics include, but are not limited to flannel, denim, jean, donegal, velvet fabric, art linen, batiste, calico, chambray, duck, cheesecloth (gauze), herringbone, hopsacking, madras, nainsook, lame, marquisette, ottoman, oxford cloth, pebble-weave fabric, sailcloth, shadecloth, percale, shadow weave, toile, tropical worsted fabric, shantung, union cloth, velvet carpet and velour. Woven fabrics are generally produced by interlacing strands of filaments, fibers or yarn at more or less right angles.

The term "yarn" as used herein means an assembly of natural and/or manufactured fibers, filaments or fibrous compositions, generally in a twisted form, to form a continuous strand of product that is suitable for use in weaving, knitting or otherwise interweaving into fabrics, textiles and other materials.

DESCRIPTION OF PREFERRED EMBODIMENTS

Substrates

The substrates that are employed or treated in accordance with processes, systems or compositions of the invention preferably contain at least about 5 weight percent non-thermoplastic material, and more preferably contain at least about 20 weight percent of non-thermoplastic material, and still more preferably contain at least about 40 weight percent of non-thermoplastic material. Thus, the substrates may contain, for example, 100% non-thermoplastic material. When the substrates employed are fibers, it is preferred that the fibers contain at least about 20 weight percent non-thermoplastic material.

During testing, the weight percent of non-thermoplastic material that is present in the substrates has been shown to influence the quantity and nature of char that is formed upon one or more surfaces of the substrates upon an exposure of the substrates to a flame, with a char having better flame retarding characteristics generally being formed when more than about 5 weight percent of non-thermoplastic material is present in the substrates. Substrates that contain less than about 5 weight percent of non-thermoplastic material, such as substrates containing 100% thermoplastic material, will generally disadvantageously melt away from a flame, rather than forming a protective char, and leave a void or opening for the flame to penetrate into other materials that may not be flame retardant, such as untreated non-thermoplastic materials. Such result is particularly undesirable when the substrates are to be employed as flame barrier substrates.

Flame Retardant Substances

Any flame retardant substance, such as the chemical compounds described below, or combination of one or more flame retardant substances, that has the ability to provide one or more flame retardant properties to a substrate having no flame retardant properties, or to enhance one or more flame retardant properties of a substrate having one or more flame retardant properties, can generally be employed in the compositions, processes, systems and substrates of the present invention, which may readily be determined by those of skill in the art.

Certain flame retardant substances may exhibit an enhanced performance with particular substrates. Factors such as the quantity, type and physical and chemical nature of the substrates being treated (porosity of surfaces, hydrophilic nature and like characteristics), the chemical nature of the flame retardant substances, the viscosity and surface tension of the aqueous or non-aqueous fluid medium, the amount and nature of other components that are present in the flame retardant compositions, the application method being employed, the function that the final product should perform and like considerations may influence the performance of a particular flame retardant substance with a particular substrate. However, those of skill in the art may readily determine the flame retardant substances that should achieve a desired performance or result in connection with a particular substrate. Several other factors may also influence the selection of a flame retardant substance to be used in a specific application, such as the flammability of the substrate being treated, processing and performance requirements and possible hazards to human, animal and environmental health.

Chlorinated flame retardant compounds, such as chlorinated hydrocarbons, chlorinated phosphate esters, chlorinated polyphosphates, chlorinated organic phosphonates, chloroalkyl phosphates, polychlorinated biphenyls, polychlorinated dibenzo-p-dioxins and dibenzofurans are molecules containing a high concentration of chlorine that generally act chemically in the gas phase. They are often used in combination with antimony trioxide and/or zinc borate as a synergist. Three main families of chlorinated compounds include: (a) chlorinated paraffins; (b) chlorinated alkyl phosphates; and (c) chlorinated cycloaliphatic compounds.

Examples of chlorinated compounds include dodecachlorodimethano-dibenzocyclooctane, tris (2-chloroethyl)phosphate, tris (2-chloro-1-methylethyl)phosphate, tris (2-chloro-(chlromethyl)ethyl)phosphate (TDPP), tris (chloropropyl)phosphate, tris (2-chloroethyl) phosphite, ammonium chloride, chiorendic acid, chiorendic anhydride, tris (dichlorobropropyl) phosphite, Bis (hexachlrocyclopentadieno)cyclooctane, tris (dichloropropyl) phosphite, bis [bis(2-chloroethoxy)-phosphinyl]isopropylchloro-ethyl phosphate and MIREX® (1,1a,2,2,3,3a,4,5,5a,5b,6-dodecachloroocatahydro-1,3,4-metheno-1H-cyclobuta(cd)pentalene).

Brominated fire retardant compounds, such as brominated organic compounds and brominated hydrocarbons, exhibit fire retardant efficiency in many materials. The three main families of brominated fire retardants include: (a) aliphatic brominated compounds; (b) aromatic brominated compounds; and (c) brominated epoxy fire retardants. Aliphatic brominated compounds include, for example, trisbromoneopentylphosphate, trisbromoneopentyl alcohol, dibromoneopentyl glycol, hexabromocyclohexane, hexabromocyclododecane, tetrabromo cyclopentane, hexabromo cyclohexane, hexabromo cyclooctane, hexabromo cyclodecane and hexabromo cyclododecane. Aromatic brominated compounds include, for example, hexabromo benzene, decabromobiphenyl, octabromodiphenyl oxide, hexabromobenzene, tris (tribromophenyl)triazine, tetrabromobisphenolA bis (2,3 dibromo propyl ether), dibromoneopentyl glycol, poly(pentabromobenzyl acrylate), pentabromodiphenyl ether, octabromodiphenyl oxide, octabromodiphenyl ether, decabromodiphenyl, decabromodiphenyl ethane, decabromodiphenyl oxide, decabromodiphenyl ether, tetrabromobisphenol A and brominated trimethylphenyl indan. Brominated epoxy fire retardants include brominated epoxy oligomers and polymers.

Other brominated fire retardant compounds include brominated diphenyl ethers, polybrominated diphenyl ethers, dimethyl-3-(hydroxymethylamino)-3-oxopropyl phosphonate, pentabromo toluene, tetrabromo chlorotoluene, pentabromo phenol, tribromo aniline, dibromobenzoic acid, pentabromotoluene, decabromodiphenyl oxide, tribromophenol, hexabromocyclododecane, brominated phosphorous, ammonium bromide, decabromobiphenyl oxide, pentabromobiphenyl oxide, decabromobiphenyl ether, 2,3-dibromopropanol, octabromobiphenyl ether, octabromodiphenyl oxide, tetrabromobiphenyl ether, hexabromocyclododecane, bis (tetrabromophthalimido) ethane, bis (tribromophenoxy) ethane, brominated polystyrene, brominated epoxy oligomer, polypentabromobenzyl acrylate, tetrabromobisphenol compounds, dibromopropylacrylate, dibromohexachlorocyclopentadienocyclooctane, $N^1$-ethyl(bis)dibromononboranedicarboximide, decabromodiphenyloxide, decabromodiphenyl, hexabromocyclohexane, hexabromocyclododecane, tetrabromo bisphenol A, tetrabrombisphenol S, N'N'-ethylbis(dibromononbomene) dicarboximide, hexachlorocyclopentadieno-dibromocyclooctane, tetrabromodipenta-erythritol, pentabromoethylbenzene, decabromodiphenyl ether, tetrabromophthalic anhydride, hexabromobiphenyl, octabromobiphenyl, pentabromophenyl benzoate, bis-(2,3-dibromo-1-propyl)phthalate, tris (2,3-dibromopropyl) phosphate, N,N'-ethylene-bis-(tetrabromophthalimide), tetrabromophthalic acid diol [2-hydroxypropyl-oxy-2-2-hydroxyethylethyl-tetrabromophthalate], polybrominated biphenyls, tetrabromobisphenol A, tris (2,3-dibromopropyl)phosphate, tris(2-chloroethyl)phosphite, tris(dichlorobromopropyl)phosphite, diethyl phosphite, dicyandiamide pyrophosphate, triphenyl phosphite, ammonium dimethyl phosphate, bis (2,3-dibromopropyl)phosphate, vinylbromide, polypentabromobenzyl acrylate, decabromodiphenyl oxide, pentabromodiphenyl oxide, 2,3-dibromopropanol, octabromodiphenyl oxide, polybrominated dibenzo-p-dioxins, dibenzofurans and bromo-chlorinate paraffins.

Phosphorous-based fire retardants are compounds that include phosphorous, such as halogenated phosphates (chlorinated phosphates, brominated phosphates and the like), non-halogenated phosphates, triphenyl phosphates, phosphate esters, polyols, phosphonium derivatives, phosphonates, phosphoric acid esters and phosphate esters, which are the largest class of phosphorous flame retardant compounds. Phosphorous-based fire retardants are usually composed of a phosphate core to which is bonded alkyl (generally straight chain) or aryl (aromatic ring) groups. Halogenated phosphate compounds are often introduced to decrease total halogen concentration. Non-halogenated phosphate compounds include, for example, red phosphorous, inorganic phosphates, insoluble ammonium phosphate, ammonium polyphosphate, ammonium urea polyphosphate, ammonium orthophosphate, ammonium carbonate phosphate, ammonium urea phosphate, diammonium phosphate, ammonium melamine phosphate, diethylenediamine polyphosphate, dicyandiamide polyphosphate, polyphosphate, urea phosphate, melamine pyrophosphate, melamine orthophosphate, melamine salt of boron-polyphosphate, melamine salt of dimethyl methyl phosphonate, melamine salt of dimethyl hydrogen phosphite, ammonium salt of boron-polyphosphate, urea salt of dimethyl methyl phosphonate, organophosphates, phosphonates and phosphine oxide. Phosphate esters include, for example, trialkyl derivatives, such as triethyl phosphate and trioctyl phosphate, triaryl derivatives, such as triphenyl phosphate, and aryl-alkyl derivatives, such as 2-ethylhexyl-diphenyl phosphate.

Other examples of phosphorous-based fire retardants include methylamine boron-phosphate, cyanuramide phosphate, cresyl diphenyl phosphate, tris (1-chloro-2-propyl) phosphate, tris (2-chloroethyl) phosphate, tris (2,3-dibromopropyl) phosphate, triphenyl phosphate, magnesium phosphate, tricresyl phosphate, hexachlorocyclopentadiene, isopropyl triphenyl phosphate, tricresol phosphate, ethanolamine dimethyl phosphate, cyclic phosphonate ester, monoammonium phosphate and diammonium phosphate, which permit a char formation as a result of esterification of hydroxyl groups with the phosphoric acid, trialkyl phosphates and phosphonates, such as triethyl phosphate and dimethyl, aryl phosphates, such as triaryl phosphates, isopropyl triphenyl phosphate, octylphenyl phosphate, triphenylphosphate, ammonium phosphates, such as ammonium phosphate, ammonium polyphosphate and potassium ammonium phosphate, cyanuramide phosphate, aniline phosphate, trimethylphosphoramide, tris (1-aziridinyl) phosphine oxide, triethylphosphate, Bis (5,5-dimethyl-2-thiono-1,3,2-dioxaphosphorinamyl) oxide, Bis (2-chloroethyl) vinyl phosphate, dimethylphosphono-N-hydroxymethyl-3-propionamide, tris (chloropropyl) phosphate, tris (2-butoxyethyl) phosphate, tris (2-chloroethyl) phosphate, tris (2-ethylhexyl) phosphate, tris (chloropropyl) phosphate, tetrakis (hydroxymethyl) phosphonium salts, such as tetrakis (hydroxymethyl) phosphonium chloride and tetrakis (hydroxymethyl) phosphonium sulfate, n-hydroxymethyl-3-(dimethylphosphono)-propionamide, urea phosphate, melamine pyrophosphate, a melamine salt of boron-polyphosphate, an ammonium salt of boron-polyphosphate, dicyandiamide pyrophosphate, triphenyl phosphite, ammonium dimethyl phosphate, fyroltex HP, melamine orthophosphate, ammonium urea phosphate, ammonium melamine phosphate, a urea salt of dimethyl methyl phosphonate, a melamine salt of dimethyl methyl phosphonate, a melamine salt of dimethyl hydrogen phosphite, polychlorinated biphenyls, a variety of alkyl diaryl phosphates and mixtures of monomeric chloroethyl phosphonates and high boiling phosphonates.

Metal hydroxide fire retardants include inorganic hydroxides, such as aluminum hydroxide, magnesium hydroxide, aluminum trihydroxide (ATH) and hydroxycarbonate.

Melamine-based fire retardants are a family of non-halogenated flame retardants that include three chemical groups: (a) melamine (2,4,6-triamino-1,3,5 triazine); (b) melamine derivatives (including salts with organic or inorganic acids, such as boric acid, cyanuric acid, phosphoric acid or pyro/poly-phosphoric acid); and (c) melamine homologues. Melamine derivatives include, for example, melamine cyanurate (a salt of melamine and cyanuric acid)), melamine-mono-phosphate (a salt of melamine and phosphoric acid), melamine pyrophosphate and melamine polyphosphate. Melamine homologues include melam (1,3,5-triazin-2,4,6-triamine-n-(4,6-diamino-1,3,5-triazine-2-yl), melem (2,5,8-triamino 1,3,4,6,7,9,9b-heptaazaphenalene) and melon (poly [8-amino-1,3,4,6,7,9,9b-heptaazaphenalene-2,5-diyl). Other melamine-based fire retardant compounds are set forth hereinabove.

Borate fire retardant compounds include zinc borate, borax (sodium borate), ammonium borate, and calcium borate. Zinc borate is a boron-based fire retardant having the chemical composition $xZnO_yB_2O_3zH_2O$, with the most commonly used grade having the structure $2ZnO.3B_2O_3zH_2.3,5H_2O$. Zinc borate can be used alone, or in conjunction with other chemical compounds, such as antimony oxide, alumina trihydrate, magnesium hydroxide or red phosphorous. It acts through zinc halide or zinc oxyhalide, which accelerate the decomposition of halogen sources and promote char formation.

Silicon-based materials include linear and branched chain-type silicone with (hydroxy or methoxy) or without (saturated hydrocarbons) functional reactive groups.

Phosphonic acid derivatives include phosphonic acid, ethylenediamine salt of phosphonic acid, tetrakis hydroxymethyl phosphonium chloride and n-methyl dimethylphosphono propionamide.

Examples of intumescent substances include, but are not limited to, ammonium polyphosphate, boric acid, chlorinated paraffin, DI-pentaerythritol, melamine, monoammonium phosphate, pentaerythritol, phosphate esters, polytetrafluoroethylene, tributoxyethyl phosphate, triethyl phosphate, tris (2-ethylhexyl) phosphonate, urea, xylene and zinc borate.

Examples of powdered metal containing flame retardant substances, which can be employed alone or in combination with other flame retardant substances, include, but are not limited to, magnesium oxide, magnesium chloride, talcum, alumina hydrate, zinc oxide, zinc borate, alumina trihydrate, alumina magnesium, calcium silicate, sodium silicate, zeolite, magnesium hydroxide, sodium carbonate, calcium carbonate, ammonium molybdate, iron oxide, copper oxide, zinc phosphate, zinc chloride, clay, sodium dihydrogen phosphate, tin, molybdenum and zinc.

Examples of fire retardant substances also include boric acid, boron oxide, calcium borate, alumina trihydrate (alumina hydroxide), alumina carbonate, hydrated aluminum, aluminum hydroxide, antimony oxide, antimony trioxide, antimony pentoxide, sodium antimonate, magnesium carbonate, potassium fluorotitanate, potassium fluorozirconate, zinc oxide, hunite-hydromagnesite, ammonium octamolybdate, ammonium bromide, ammonium sulfate, ammonium carbonate, ammonium oxylate, barium metaborate, molybdenum trioxide, zinc hydroxystannate, sodium tungstate, sodium antimonate, sodium stannate, sodium aluminate, sodium silicate, sodium bisulfate, ammonium borate, ammonium iodide, tin compounds, molybdic oxide, sodium antimonate, ammonium sulfamate, ammonium silicate, quaternary ammonium hydroxide, aluminium tryhydroxide, tetrabromobisphenol A, titanium compounds, zirconium compounds, other zinc compounds, such as zinc stannate and zinc hydroxy-stannate, dioxins, diethyl phosphite, methylamine boron-phosphate, cyanoquanidine, thiourea, ethyl urea, dicyandiamide and halogen-free phosphonic acid derivatives.

Preferred flame retardant substances for use in the processes, systems, compositions and substrates of the present invention include boric acid, sodium borate, decabromodiphenyl ether, hexabromocyclododecane, potassium fluorotitanate, potassium fluorozirconate, ammonium bromide, aluminium hydrate, halogenated compounds (polybrominated diphenyl ethers, chlorinated paraffins and the like), organic phosphates (tri-alkyl phosphates, tri-aryl phosphates, trichloroalkyl phosphates, dialkyl phosphites, tetrakis (hydroxymethyl) phosphonium chloride and the like), ammonium carbonate phosphate, di-ammonium phosphate, sodium tungstate, pentabromodiphenyl ether, pentabromotoluene, tetrabromophthalic acid diol [2-hydroxypropyl-oxy-2-2-hydroxyethyl-ethyltetrabromophthalate], tetrabromophthalic anhydride, N,N'-ethylene-bis-(tetrabromophthalimide), bromo-chlorinate paraffins, dimethylphosphono-N-hydroxymethyl-3-propionamide, cyclic phosphonate ester, dimethyl-3-(hydroxymethylamino)-3-oxopropyl phosphonate, Bis (5,5-dimethyl-2-thiono-1,3,2-dioxaphosphorinamyl) oxide, Bis(2-chloroethyl) vinyl phosphate, sodium stannate, sodium aluminate, sodium silicate, sodium bisulfate, ammonium borate, ammonium polyphosphate, ammonium iodide, dibromopropylacrylate, tetrabromodipenta-erythritol, pentabromoethylbenzene, tris(2,3-dibromopropyl)phosphate, tris (dichloropropyl) phosphite, bis-(2,3-dibromo-1-propyl)phthalate, trimethylphosphoramide, tris (1-aziridinyl) phosphine oxide, bis [bis(2-chloroethoxy)-phosphinyl]isopropylchloro-ethyl phosphate, tris (dichloropropyl) phosphite, tris-(2-chloroethyl)-phosphite, polybrominated diphenyl ethers, intumescent chemicals, alumina trihydrate, brominated aromatic organic compounds, brominated cycloaliphatic organic compounds and fire retardant substances described in Examples 1–14 hereinbelow, or otherwise described as being preferred herein.

The most preferred flame retardant substances for use in the processes, systems, compositions and substrates of the invention are phosphoric acid, halogen-free phosphoric acid derivatives (such as ammonium polyphosphate or triarylphosphate esters), phosphonic acid, halogen-free phosphonic acid derivatives (such s 3-(dimethylphosphono) proprionic acid methyl amide), ammonia, ammonia phosphate, ammonium molybdate, ammonium borate, organophosphorus chemicals (such as triethyl or trioctyl phosphate, triaryl derivatives, including triphenyl phosphate, and arylalkyl derivatives, such as 2-ethylhexyl-diphenyl phosphate), melamine, melamine chemicals (such as cyanurotriamide, cyanotriamine, melamine cyuranat, melamine borate, melamine pyrophosphate, melamine polyphosphate or isomelamine), intumescent chemicals, alumina trihydrate, urea, guanidine, dicyandiamide, ethyl urea, ethylamine, thiourea, diethylenediamine, ethylenediamine, brominated aromatic organic compounds (such as tetrabromobisphenol or decabromodiphenyl ether), brominated cycloaliphatic organic compounds (such as hexabromocyclododecane) and various mixtures thereof.

Because they generally result in enhanced flame retardancy and/or durability properties in comparison with other forms (liquids, pastes, waxes or the like), it is preferred that the one or more flame retardant substances be in a particulate (solid) form at room temperature. Additionally, it is preferred that a mixture of two, three, four, five or more flame retardant substances be employed in the processes, systems, compositions and substrates of the invention. Further, it is preferred that the flame retardant substances not be toxic, disease producing or otherwise dangerous to human beings or animals, or to the environment.

When they are employed in the form of a solid, and the solid dissolves in the aqueous or non-aqueous liquid that is employed in the compositions, processes or systems of the invention, the particle size of the flame retardant substance should not be an important characteristic. However, when the solid does not dissolve in the aqueous or non-aqueous liquid, the flame retardant substances may range in size, depending upon the performance characteristics desired, which may be varied in a manner known by those of skill in the art. If necessary or desired, the flame retardant substances may be size reduced to an average particle size ranging from about 1 to about 200 microns, and more preferably ranging from about 1 to about 100 microns, and most preferably ranging from about 1 to about 70 microns. It may be possible to achieve enhanced flame retardancy and/or durability properties of treated substrates when solid flame retardant substances, and the foregoing particle sizes, are employed. Known methods or devices for making particle size measurement determinations, such as Colter counters, Fisher counters or microscopic measurements, may be employed.

The quantity of the one or more flame retardant substances (either alone or in combination) that should be present in the flame retardant compositions is a combined amount (when more than one is employed) that is sufficient to provide one or more flame retardant properties to a substrate having no flame retardant properties, or to enhance the flame retardant properties of a substrate having one or more flame retardant properties. Such an amount may vary depending upon a variety of factors, such as the quantity, type and physical and chemical natures of the substrates being treated (porosity of the surfaces, hydrophilic nature, etc.), the viscosity and surface tension of the aqueous or non-aqueous fluid medium being employed, the particular chemical components, and amounts thereof, being employed in the composition, the application method being employed, the function that the final product should perform and like considerations, and may readily be determined by those of skill in the art. However, such an amount preferably ranges from about 0.5 to about 75 weight percent of the flame retardant composition, and more preferably ranges from about 1 to about 50 weight percent of the composition, and may readily be adjusted (reduced) by the addition of aqueous or non-aqueous liquid (solvent). A substrate having very closed and less hydrophilic surfaces may require a different weight percent (higher) of flame retardant substance in the aqueous or nonaqueous medium in comparison with highly reactive substrates, such as protein fiber (wool, silk and the like) to achieve the same results.

Flame retarded fiber for furniture can often be achieved with only about 1% solids, while flame retardant fiber for thermoforming application should preferably be treated with at least at about 50% solids. For example, a flame retardant application device may contain about 1,000 gallons of flame retardant composition, having a typical substrate charge of 400# against about 10,000# water.

Methods and devices are known in the art for determining the percent solids of a liquid mixture either directly, by a gravimetric method, or indirectly, by a calculation based upon known quantities of components in the mixture. In the gravimetric method, a measured volume of liquid is weighed. A heat source is generally used to encourage rapid evaporation of the solvent or diluent, keeping such drying temperatures below the thermal degradation temperature of the known components. After evaporation, the container is cooled in a desiccator to prevent moisture regain before reweighing. The heating, cooling and weighing steps are repeated until the measured weight of the dried sample becomes consistent. Percent solids is calculated as L−s/L*100=S %, where L is the weight of the liquid sample, s is the weight of the dried sample and S is the percentage of solids in the mixture.

The percentage of solids in a liquid mixture may also be determined indirectly by a calculation. For this calculation, the percentage of solids or active ingredients in any liquid ingredients must be known. That value multiplied by the actual amount of that component added to the mixture is the amount of solids added to the mixture, "s" in the above equation. "L" can also be calculated by multiplying the density of liquid ingredients by the amount (volume) added to the mixture and adding this to the actual weight of all solid ingredients. Percent solids, S%, is then calculated in the same manner.

The above-described, and other, flame retardant substances are commercially available from sources known by those of skill in the art, such as Rhone-Poulenc (Mississauga, ON), Occidental Chemical Corp. (Dallas, Tex.), Albright & Wilson Americas (Richmond, Va.), Akzo Nobel Chemicals, Inc. (Dobbs Ferry, N.Y.), Elf Atochem (Philadelphia, Pa.), Ferro Corp. (Hammand, Ind.), Alcan Chemicals Ltd. (Saguenay, PQ), U.S. Borax, Inc. (Valencia, Calif.) and IMC Chemical (Overland Park, Kans.). Most grades of flame retardant substances are commercially available in liquid, paste and waxy solid forms. Descriptions of flame retardant substances, such as halogen-free phosphoric acid and phosphonic acid derivatives, that may be employed in the processes, systems, compositions and substrates of the invention, may be found in Kirk-Othmer, Encyclopedia of Chemical Technology, Volume 10 (John Wiley and Sons, Ltd., New York, 4th Edition).

Aqueous or Non-Aqueous Liquid

A wide variety of known aqueous or non-aqueous liquids may be employed in the processes, systems and compositions of the invention, as will be recognized by those of skill in the art. Those of skill in the art can readily determine which aqueous or non-aqueous liquids will be compatible with particular substrates (containing at least about 5 weight percent of non-thermoplastic material), and with other process components. The aqueous or non-aqueous liquids function as liquid mediums (solvents) within which other components of flame retardant compositions can be mixed. If a flame retardant substance dissolves in the aqueous or non-aqueous liquids, the result will be a solution. If it does not, the result may be a dispersion, an emulsion, a suspension or some other mixture.

The amount of aqueous or non-aqueous liquid that may be employed in the compositions, processes and systems of the present invention is an amount that is sufficient to permit the one or more flame retardant substances to be applied to one or more substrates in a manner that provides one or more flame retardant properties to the substrates, or enhances one or more flame retardant properties of the substrates. Such an amount may vary depending upon the particular flame retardant substances employed, the particular substrates being treated, the particular application method being employed and the function that the final product should perform, and may be determined by those of skill in the art. However, such an amount generally ranges from about 0.5 to about 70 weight percent of the composition of the invention, and preferably ranges from about 2 to about 50 weight percent of the composition, and most preferably ranges from about 2 to about 30 weight percent of the composition.

The aqueous or non-aqueous liquid acts as a diluent that aids in the application and spreading of the compositions of the invention within, and/or over the surfaces of, substrates.

If water is employed as an aqueous liquid, the water may be tap, deionized, distilled or otherwise purified water, all of which are inexpensive. It is generally not necessary to pretreat the water in any manner.

The aqueous or non-aqueous liquid employed in the processes, systems and compositions of the invention should be in a liquid state (i.e., not frozen), and its temperature should be no higher than about 180° C. The temperature of the aqueous or non-aqueous liquid employed in the processes, systems and compositions of the invention preferably ranges from about ambient temperature to about 100° C., with about 80° C. being most preferred.

Adhesion Agents

Any adhesion agent, or combination of adhesion agents, such as naturally occurring latexes and other aqueous emulsion polymers, that have the ability to permit one or more flame retardant substances to become adhered, or to enhance the adhesion of one or more flame retardant substances, to one or more surfaces or portions of a substrate, may be employed in the processes, compositions, systems and substrates of the present invention.

Adhesive agents, such as high molecular weight polymers, which may be present in aqueous or non-aqueous solutions, suspensions, dispersions or emulsions include, but are not limited to, non-crosslinking or crosslinking: (a) inorganic binders (such as soluble silicates, phosphate cements, calcium oxide silica, mortar, gypsum, silica-boric acid); (b) natural organic binders (hide and bone glue, fish glue, blood and casein glues, soybean starch cellulosics, rubber latex, rubber solvent, gums, terpene resins, mucilages and hydrocarbon resins); and (c) synthetic organic binders (elastomeric-solvent cements, polysulfide sealants, polyethylene, isobutylene, polyamides, polyvinyl acetate, epoxy, phenoformaldehyde, polyvinyl butyral, cyanoacrylates and silicone polymers and cements).

If durable substrates or treatments are desired, crosslinking adhesion agents, such as polyvinyl acetate, formaldehyde polyacrylates, polyurethanes, urea-formaldehyde, polyepoxide resins and melamine formaldehyde should be employed in the processes, systems, compositions and substrates of the invention. The crosslinking adhesion agents will generally form bonds and produce a lattice structure that becomes less labile, or even immune, to chemical degradation, for example, by solvents. Substrates treated in this manner will generally be durable without the requirement of any drying, baking or curing step other than the drying processes described herein, and will generally exhibit a reduced amount of "dusting" when they undergo subsequent unrelated secondary processing. The flame retardant substances adhered to the treated substrates will generally not become rubbed off or "flaked off" by mechanical working of the substrates after they have been flame retarded in this manner (formation into a product, etc.), which indicates that the flame retardant substances become very tightly bound to the substrates when treated in accordance with the processes and systems of the invention. When the substrates being treated are fibers, the flame retardant substances appear to become adhered to the ends of the fibers, as well as to the surfaces of the fibers. When non-crosslinking binders, such as starch or polyvinyl alcohol, are employed, the treated substrate will generally be non-durable, and may not exhibit the reduced "dusting" described above. Under some conditions, it could be beneficial to employ a secondary curing step (using heat and/or curing agents).

Preferred adhesion agents for use in the processes, systems, compositions and substrates of the present invention include: (a) natural latexes; (b) synthetic latexes (also known as high molecular weight polymers or "emulsion polymers"); and (c) polymeric adhesive binders, and particularly the crosslinking adhesion agents described above.

The high molecular weight polymers can be the result of the homo- or co-polymerization of monomers such as acrylic acid, acrylonitrile, methacrylic acid, acrylamide, acrylic and methacrylic acid esters, vinyl chloride, vinyl esters, such as vinyl acetate, vinyl copolymers, vinylidene chloride, styrene, butadiene, maleic or fumaric acids and esters of the same, for example, styrene butadiene copolymer, butyl acrylate copolymer, polyvinyl acetate, polytoluene diisocyanate, polyacrylonitrile and polyvinyl chloride latex. Such polymers can be homopolymers or copolymers of the above described monomers. These polymers are commercially available in differing grades depending on the ultimate properties desired, such as viscosity, ability to crosslink and glass transition temperature. They have in common the fact that they generally form films at room (ambient) or elevated temperatures, alone or in the presence of plasticizers.

The preferred monomers for use in the polymerization reactions described above (to produce emulsion polymers) are acryl/and methacryl amides, acrylonitrile, acrylic and methacrylic acids, maleic or fumaric acids, vinyl and vinylidene chlorides, styrene, butadiene and alkyl esters of the foregoing acids. A further discussion of high molecular weight polymers is set forth hereinbelow.

Examples of polymeric adhesive binders that can be employed in the processes, systems and compositions of the invention include emulsions, dispersions or suspensions containing high molecular weight polymers, such as polyacetals, polyamides, polycarbonates, polystyrenes, polymethyl methacrylates, polyvinyl chlorides, styrene butadiene, diethylene glycol, modified starch, urea-formaldehyde resin, phenol-formaldehyde resin, an aqueous suspension of vinyl acetate, flexible polyepoxy resin, flexible polyepoxy resin, polyamide resin, aqueous polyurethane resin, polyvinyl alcohol, melamine-formaldehyde resin, resorcinol resin, sodium silicate, methyl cellulose, polyacrylate resin, casein, polysulfide resin, polymethacrylate, and mixtures of the foregoing.

The amount of adhesion agent, or mixture of two or more adhesion agents, that may be employed in the processes, systems, compositions and substrates of the invention is a combined amount that is sufficient to permit the one or more flame retardant substances to become adhered, or to enhance the adhesion of the one or more flame retardant substances, to one or more surfaces and/or portions of one or more substrates. Such an amount may vary depending upon the particular flame retardant substances employed, the particular substrates being treated, the particular application method employed and the function that the final product should perform, and may be determined by those of skill in the art. However, such an amount generally ranges from about 0.5 to about 70 weight percent of the composition of the invention, and preferably ranges from about 2 to about 40 weight percent of the composition, and most preferably ranges from about 2 to about 30 weight percent of the composition.

If the adhesion agent employed is a natural or synthetic latex, or some other aqueous or nonaqueous liquid containing a polymer, it is preferable that the adhesion agent contain from about 35 to about 65 weight percent, and more preferably from about 45 to about 55 weight percent, of the polymer.

Stability Enhancing Agents

Optionally, one or more stability enhancing agents may be employed in the processes, systems and compositions of the invention.

Examples of stability enhancing agents that may be employed in the processes, systems and compositions of the invention include, but are not limited to surfactants and emulsifying agents.

It is preferable that surfactants and/or emulsifiers employed in the processes, systems and compositions of the invention be in the form of nonionic surface active agents (surfactants that do not form ions when present in water) or anionic surface active agents (surfactants that form negative ions when present in water), or combinations of nonionic and anionic surfactants.

Nonionic surfactants include, for example: (a) alkylphenol ethoxylates, which are derived from propylene (and usually contain a branched nonyl group) or butylene (usually containing a branched octyl group), for example, ethoxylated nonyl phenol, alkylphenol ethoxylate (APEO) or nonylphenol ethoxylate (NPE); (b) alcohol ethoxykfes, which are derived from ethylene, propylene, butylene or vegetable triglycerides, for example, alcohol ethoxylate (AE) or linear alcohol ethoxylate (LAE); (c) tertiary thiol ethoxylate (TTE); and (d) diethanol cocoamide (DEC).

Anionic surfactants include, for example: (a) sulfates, such as alcohol sulfates, for example, sulfated ethoxylated alcohol (SEA); (b) sulfamates; (c) sulfonates, such as alkylbenzene sulfonate, for example, dodecyl benzene sulfonic acid (DDBSA); (d) sulfosuccinates; (e) phosphate esters; (f) methyl taurines; (g) carboxy methylates; (h) metallic soaps; and (i) amine soaps. Illustrative anionic surfactants that may be employed include the alkali metal sulfates of long chain fatty acids, e.g. those containing from about 7 to about 16 carbon atoms, such as sodium lauryl sulfate and sodium myristyl sulfate, and napthalene sulfonic acid (NSA).

Other nonionic or anionic surface active agents that may be employed include: (a) the ethoxylated derivatives of adducts of alkyl substituted phenols containing, illustratively, from about 7 to about 18 carbon atoms, for example, nonyl phenol ($C_9H_{19}C_6H_4OH$) and ethoxylated nonyl phenol; (b) adducts containing from about 1 to about 20 or more moles of ethylene oxide per mole of phenol; and (c) polyoxypropylene-polyoxy-ethylene copolymers (PLURONIC® polyols).

It is recommended that cationic surfactants (surfactants that form positive ions when present in water) not be used because such surfactants generally exhibit high aquatic toxicity, and are not compatible with anionic surfactants. Cationic surfactants include alkyl ammonium salts and quarternary ammonium compounds such as alkyl dimethyl benzyl ammonium chloride (ADBAC) and tallow amine ethoxylate (TAE).

Other commercially-available surfactants that may be employed in the processes, systems and compositions of the present invention are available from BASF (worldaccount-.basf.com) or are described in *Emulsifiers & Detergents*, Vol. I (McCutcheon, 2002).

Emulsifying agents, such as ethanol amines, alyl alkanol amines and isopropyl amines, may be employed in the processes, systems and compositions of the invention to encourage substances that are not soluble in a solvent, such as water, to become "mixable" in the solvent.

The amount of stability enhancing agents that may be employed in the processes, systems and compositions of the invention is a combined amount that is sufficient to provide at least some stability to, or enhance the stability of, the mixture of the one or more flame retardant substances and the aqueous or nonaqueous liquids employed in the processes, systems and compositions of the invention. Such an amount may vary depending upon the particular flame retardant substances employed, the particular substrates being treated, the particular application method employed and the function that the final product should perform, and may be determined by those of skill in the art. However, such an amount generally ranges from about 0 to about 20 weight percent of the composition of the invention, and preferably ranges from about 0 to about 10 weight percent of the composition, and most preferably ranges from about 0 to about 8 weight percent of the composition.

Viscosity Enhancing Agents

Optionally, one or more viscosity enhancing agents may be employed in the processes, systems and compositions of the invention. Viscosity enhancing agents may enhance the ability of flame retardant compositions of the invention, or flame retardant compositions employed in processes or systems of the invention, to uniformly wet the surfaces (or other components or areas) of the substrates being treated, which may enhance the ability of flame retardant substances that are present in the compositions to precipitate onto the surfaces (or other components or areas) of the substrates.

Examples of viscosity enhancing agents that may be employed in the processes, systems and compositions of the invention include, but are not limited to, protective colloids, such as carboxy methyl cellulose, methoxy cellulose, ethoxy cellulose or hydroxyethyl cellulose, preferably having a viscosity ranging from about 500 to about 25,000 cps, and preferably ranging from about 750 to about 15,000 cps, at room temperature.

The protective colloids that may be employed in the processes, systems and compositions of the invention preferably have a molecular weight that permits them to achieve an optimum viscosity of the mixture being produced, or already produced, and to prevent solid particles present in the mixture from settling.

The amount of viscosity enhancing agents that may be employed in the processes, systems and compositions of the invention is a combined amount that is sufficient to increase the viscosity of the mixture of the one or more flame retardant substances and the aqueous or non-aqueous liquids employed in the processes, systems and compositions of the invention. Such an amount may vary depending upon the particular flame retardant substances employed, the particular substrates being treated, the particular application method employed and the function that the final product will need to perform, and may be determined by those of skill in the art. However, such an amount generally ranges from about 0 to about 15 weight percent of the composition of the invention, and preferably ranges from about 0 to about 10 weight percent of the composition, and most preferably ranges from about 0 to about 5 weight percent of the composition.

The viscosity of the compositions of the present invention preferably ranges from about 50 to about 1,500 centipoises (cps), and more preferably ranges from about 100 to about 1,000 cps, and is most preferably about 500 cps. Such a viscosity permits mixtures having high solids levels (high levels of flame retardant substances), such as from about 40 to about 60 weight percent, to remain in solution. It also aids in maintaining flame retardant substances on a substrate, such as a fabric or web, until the substrate dries when the flame retardant mixture is applied via spray or pad application techniques.

Wetting Agents

Optionally, and preferably, one or more wetting agents may be employed in the processes, systems and compositions of the invention. The use of a wetting agent is generally not necessary or beneficial when hydrophilic substrates are being treated in accordance with the processes, systems and compositions of the invention. However, it is preferred that from about 2 to about 5 weight percent of a wetting agent be employed when hydrophobic substrates are being treated in accordance with the processes, systems and compositions of the invention.

Examples of wetting agents that may be employed in the processes, systems and compositions of the invention include, but are not limited to, polyethylene stearate, ammonium lauryl sulfate and Ethal DA-6.

The amount of wetting agents that may be employed in the processes, systems and compositions of the invention is a combined amount that is sufficient to enhance an ability of the mixture of the one or more flame retardant substances and the aqueous or non-aqueous liquids employed in the processes, systems and compositions of the invention to penetrate into, and/or to spread over one or more surfaces of, one or more substrates. Such an amount may vary depending upon the particular flame retardant substances employed, the particular substrates being treated, the particular application method employed and the function that the final product should perform, and may be determined by those of skill in the art. However, such an amount generally ranges from about 0 to about 5 weight percent of the composition of the invention, and preferably ranges from about 0.1 to about 3 weight percent of the composition, and most preferably ranges from about 0.1 to about 0.15 weight percent of the composition.

Other Optional Components

It is contemplated that a wide variety of other natural or synthetic ingredients and/or components may, optionally, be employed in the processes, systems, compositions and/or substrates of the invention. Such ingredients or components include, for example, any element, chemical compound, agent, substance or composition that is suitable for use with one or more substrates, which can be determined by those of skill in the art, and which, either alone, or in combination with other ingredients or components, preferably imparts a desirable benefit to the processes, systems, compositions and/or substrates of the invention. Such ingredients or components include, for example, pigments, fillers, plasticizers, catalysts, fungicides and the like. The amount and/or type of these ingredients and or components may depend upon the desired benefit that is being provided to the processes, systems, compositions and/or substrates of the invention, and may be determined by those of skill in the art. Examples of optional ingredients or components that may be employed in the processes, systems, compositions and/or substrates of the invention include $MgCl_{12}$, $ZnCl_{12}$, tributyl phosphonate and powdered fillers. Such optional ingredients and/or components will generally be commercially available from sources known by those of skill in the art.

Powdered fillers having a diameter of less than about 50 microns may, optionally, be employed in the compositions, processes or systems of the invention as mixing beads, abrasives, fillers or the like, as is described in the examples hereinbelow. Powdered fillers include wood power, expandable graphite, phenol-formaldehyde resins, urea formaldehyde resins, melamine formaldehyde resin, carbohydrates, coke, fuel ash, gypsum, mica, chalk, apatite, glass beads, silicate beads and aluminum silicate hollow beads.

Other optional ingredients and components, and other flame retardant substances, adhesion agents, stability enhancing agents, viscosity enhancing agents, wetting agents and powdered fillers that may be employed in the processes, systems, compositions and/or substrates of the invention, may be determined by those of skill in the art using known sources, such as *Lang's Handbook of Chemistry* (Thirteenth Edition, McGraw Hill Book Company, New York, 1985).

pH

The pH of the compositions of the invention, and of the compositions employed in the processes and systems of the invention, should generally range from about 2 to about 11, and preferably ranges from about 2.5 to about 6.5. The pH of the compositions can be reduced using acidic agents, such as sulfuric acid, hydrochloric acid, bromic acid, formic acid, acetic acid, phosphoric acid and the like, and can be raised using alkaline agents, such as ammonium carbonate, ammonium hydroxide and the like.

Mixing

To prepare flame retardant compositions of the invention, the one or more flame retardant substances are mixed or otherwise agitated together with the aqueous or non-aqueous liquid, the one or more adhesion agents, and the optional one or more stability enhancing agents, viscosity enhancing agents and/or wetting agents, in any suitable order, and preferably with continuous mixing, for a sufficient time to cause these components to be mixed together, and preferably until a uniform blend of these mixture components is achieved. The foregoing components will generally become mixed together in a period of time ranging from about 60 seconds to about 60 minutes, and more usually ranging from about 5 minutes to about 60 minutes, and may depend upon the quantities of the various components of the mixtures being employed, upon the type, size and speed of the mixing equipment being employed, and upon other like considerations.

The above mixing step can be performed using any suitable mixing equipment or methods for mixing and/or blending ingredients together, such as stirring with a suitable utensil or apparatus, a blender or a high speed, high shear mixer. Preferably, the mixing occurs under conditions of strong agitation.

The mixing step may generally be performed at a temperature ranging from about 4° C. to about 100° C., and preferably ranging from about 20° C. to about 50° C., with ambient temperature generally being most preferred.

Those of skill in the art will recognize that other methods may be utilized to prepare the compositions of the present invention, and that the temperatures, pressures, times and order of steps employed in preparing the compositions may be varied. Further, in the case in which the manufacturer of a particular component employed in the compositions of the invention provides recommendations regarding the use of the component, it is generally preferred that these recommendations be followed. Using the information provided herein, those of ordinary skill in the art will also readily be able to manufacture the compositions of the invention in bulk quantities.

Compositions of the invention may usually be stored in suitable containers, such as metal cans or containers, indefinitely prior to use under reasonable conditions (situations in which no intense heat, or intense cold, or like unusual conditions are present). However, in order to achieve the most beneficial and uniform distribution of active components within the compositions of the invention in, or over, materials to which they are applied, it is preferable that the compositions be in the form of a homogeneous mixture when they are applied to the substrates. This may be achieved, for example, by shaking or otherwise agitating the compositions, by mixing the compositions, or by other methods known by those of skill in the art, just prior to applying the compositions to substrates.

The mixture of components or ingredients employed to form the flame retardant compositions used in the processes and systems of the invention may be in the form of a solution, a dispersion, a suspension or an emulsion, or in any other suitable mixture or form, which may be determined by those of skill in the art.

Application

Prior to treating substrates in accordance with the processes, systems and compositions of the invention, the substrates may, optionally, undergo one or more preliminary cleaning treatments, such as desizing, scouring, bleaching and/or singeing, which are procedures known by those of skill in the art. Those of skill in the art will know whether or not it is desirable to carry out any of the foregoing or other preliminary cleaning treatments with a particular substrate.

The compositions of the invention are applied to one or more substrates, in the manner initially produced and/or in a "recycled" form, at least one (one, two, three or more) time prior to the substrates being exposed to an open or other flame, fire, combustion or other burning process in an amount that is sufficient to provide one or more flame retardant properties to, or to enhance one of more flame retardant properties of, the substrates.

It is preferable that the flame retardant compositions are applied to the substrates in an amount, in a manner, and for a period of time that will permit a uniform distribution of the composition over every surface of the substrate, and more preferably that the substrate will be impregnated (completely penetrated) with the composition. Those of ordinary skill in the art will readily be able to determine the surface or other characteristics of a particular substrate (or other portion or area thereof), such as the level of porosity, that will permit such application of the flame retardant compositions to the particular substrates being treated in an optimum manner (so that the substrate will have the beneficial flame retardancy properties described herein).

The compositions of the invention (initially used or recycled) should be applied to the one or more substrates for a period of time and in a manner that is sufficient to permit the substrates to take up a sufficient amount of flame retardant substance to provide one or more flame retardant properties to the substrates, or to enhance one or more flame retardant properties to the substrates. Such an amount of time may vary widely depending upon a variety of factors, such as the quantity, type and physical and chemical natures of the substrates being treated (density and flexibility of the substrates, whether the substrates are woven or non-woven and, if woven, whether the substrates have a loose or tight weave, porosity of the surfaces and whether the substrates are hydrophilic or hydrophobic), the viscosity and surface tension of the aqueous or non-aqueous fluid medium being employed, the particular chemical components, and amounts thereof, being employed in the compositions of the invention, and like considerations, and may readily be determined by those of skill in the art. However, such time generally ranges from about 8 minutes to about 120 minutes, and more usually ranges from about 8 minutes to about 60 minutes. If the substances and agents that are present in the compositions of the invention, such as flame retardant substances and adhesion agents, have an affinity for the substrates, this will generally cause them to leave the medium in which they are in (solution, suspension, dispersion, emulsion or the like) and enter the substrates fairly rapidly, usually in a period of time ranging from about 8 minutes to about 60 minutes.

The compositions of the invention are preferably applied to one or more substrates at a temperature ranging from about 4° C. to about 180° C., and more preferably at a temperature ranging from about 25° C. to about 100° C., and most preferably at a temperature of about 80° C.

The treatment of filaments, fibers, fibrous compositions, threads and/or yarns with compositions of the invention may precede, or may occur after, the formation of the filaments, fibers, fibrous compositions, threads and/or yarns into some other form, such as the spinning of the yarn or the production of a fabric, cloth, other textile or other form, and/or some other treatment of these substrates (or of other substrates), such as the dyeing of one or more of these components. The treatment of filaments, fibers, fibrous compositions, threads and/or yarns with compositions of the invention prior to formation into a fabric, cloth, other textile or other form advantageously permits others to purchase pre-treated (flame retarded) filaments, fibers, fibrous compositions, threads and/or yarns.

It is preferred that the compositions of the invention be applied to one or more substrates, such as filaments, fibers or fibrous compositions in a manner that the substrates are penetrated (become impregnated) by the compositions (i.e., that the compositions go partially, and preferably completely, through the substrates), and preferably in a manner that achieves a uniform distribution of the flame retardant substances in and on the substrates, rather than only being applied to one or more surfaces of the substrates, for example, using spraying methods. Although it is generally not necessary to achieve or enhance flame retarding properties of the substrates, and it is not preferable, the substrates may be treated in accordance with the processes, systems and compositions of the invention more than one time, for example, two times.

Generally, only about 10% of the one or more flame retardant compositions that are applied to one or more substrates, for example, about 10% of the flame retardant composition that is present in the first dye machine, or in the second dye machine, shown in FIG. 1, becomes depleted (used up) during a treatment of substrates. However, this amount may vary. Such an amount of the flame retardant compositions becomes present in and/or on the substrates. The remaining quantity of the flame retardant compositions (generally about 90%) can be recycled in the manner described herein, and is preferably replenished with the amount of flame retardant composition that has been depleted (generally about 10%). If the remaining quantity of the flame retardant compositions were not reused, it would generally be discarded (thrown away), resulting in a significant waste of flame retardant composition and, thus, in a significant expense.

When compositions within the invention are properly applied to one or more substrates, such as non-thermoplastic fibers, fibrous compositions and/or fabrics, prior to substrates being exposed to an open or other flame or fire, these compositions will generally effectively reduce the amount of burning that occurs to the substrates, the flame spread and/or the amount or density of smoke (and associated toxic gases) produced by the substrates, when the substrates are exposed to an open flame or fire. They generally can also function as "flame barrier substrates" or "protective substrates" (substrates that have an ability to protect one or more other substrates that have not been treated in accordance with the processes, systems and compositions of the invention, or that otherwise are not flame retardant, from burning when exposed to an open flame or fire) in a wide variety of different items, such as in mattresses, furniture, insulation, construction materials and similar items.

In the processes and systems of the invention, flame retardant compositions may be applied to one or more substrates separately, independently or concurrently in a manner that produces no, or low quantities of waste, and that is "environmentally friendly," before, during or after a woven, non-woven or other production process, preferably in a durable manner, to reduce or eliminate the spread of flame, and/or the amount or density of smoke (and associated toxic gases) produced, when the substrates are exposed to an open flame or fire.

Removal of Excess Composition from Substrates

After the one or more substrates have been treated with one or more compositions of the invention, excess composition of the invention (composition that is not necessary or beneficial to provide one or more flame retardant properties to the substrates, or to enhance the flame retardant properties of the substrates) may be removed from the substrates using any of a wide variety of methods, which are known by those of skill in the art, such as removing the substrates from a treatment tank, using squeeze rollers to squeeze the substrates between two rollers, using centrifugation techniques, using moisture vacuum extraction techniques and/or other means, or a combination of methods. For example, the substrates may be removed from a treatment tank and then squeezed between rollers, and the excess flame retardant composition remaining in the treatment tank may be combined with the excess flame retardant composition that is squeezed from the substrates and transferred to a holding tank. Excess flame retardant composition may then be applied (after being reconstituted, if necessary or desired) separately to the same substrates again, or to one or more other substrates of the same or different type, rather than being discarded. As long as the excess flame retardant composition does not contain an amount of one or more contaminants, such as a dye pigment, that makes it reasonably unsuitable for reuse, it can generally be used one or more times again and, thus, be recycled. Tve-Escale (Dalton, Ga.) manufactures a moisture vacuum extraction system for removing moisture from fabric.

Some methods of applying the compositions of the invention to one or more substrates, such as spraying, brushing, painting or rolling the compositions onto one or more surfaces of the substrates, may result in a smaller quantity of excess composition being present on the substrates in comparison with other methods.

When the substrates are squeezed between two rollers, they are preferably squeezed at a pressure, and for a period of time, that permits the excess composition to be removed from the substrates. Such pressure and period of time may depend upon a variety of factors, such as the type of substrates being treated, the amount of composition that has been applied to the substrates, the particular components contained in the compositions and like considerations. However, the pressure will often range from about 1 psig to about 150 psig, and the period of time will often range from about 0.5 seconds to about 1 minute. More usually, such pressure will range from about 10 to about 100 psig, and such period of time will range from about 0.5 seconds to about 0.5 minutes.

Rinsing

After excess composition of the invention has, optionally, been removed from the substrates, the substrates may, optionally, be rinsed with a rinse liquid, such as water or another aqueous or nonaqueous liquid, in an amount, and under conditions, that is sufficient to remove any remaining composition that is not necessary or beneficial for providing one or more flame retardant properties to the substrates, or for enhancing one or more flame retardant properties of the substrates. This may be done using any of a wide variety of methods, which are known by those of skill in the art, such as spraying a rinse liquid onto the substrates, or immersing the substrates into a rinse liquid. The rinse liquid chosen for use should be compatible with the substrates being treated, and with the particular flame retardant composition being employed. It will generally be preferred to use the same aqueous or nonaqueous liquid that has been employed as the liquid medium in the flame retardant compositions as a rinse liquid (without other components of the flame retardant composition). The type and amount of rinse liquid employed, and the rinsing conditions employed, may vary and can readily be determined by those of skill in the art.

If a flame retardant treatment that is performed in accordance with the processes or systems of the invention is not durable (results in treated substrates that are not durable), or is only partially durable, it is preferable that the substrates not be rinsed with a rinse liquid (or otherwise) because such rinsing could have the effect of removing one or more flame retardant substances from the substrates (rinsing them off) and, thereby, rendering the flame retardant treatment ineffective or less effective. However, if such treatment is durable (results in treated substrates that are durable), such rinsing may, optionally, be performed, and generally will not remove one or more flame retardant substances from the substrates or render the treatment ineffective.

Further, with some methods of applying the compositions of the invention to one or more substrates, such as spraying, brushing, painting or rolling the compositions onto one or more surfaces of the substrates, it is preferable not to rinse the substrates prior to drying, whether or not the treatment is durable.

Removal of Excess Rinse Liquid from Substrates

If one or more substrates have, optionally, been rinsed with a rinse liquid, excess rinse liquid (rinse liquid that is not necessary or beneficial for rinsing the substrates) may optionally, but preferably, be removed from the substrates prior to the drying of the substrates. This may be accomplished using any of a wide variety of methods, which are known by those of skill in the art, such as using squeeze rollers (squeezing the substrate between two rollers) or centrifugation techniques in the manner described above in connection with the removal of excess composition of the invention from the substrates, or other means.

Drying

After the compositions of the invention have been applied to one or more substrates (and after the substrates have had excess composition removed therefrom and, optionally, been rinsed and had excess rinse liquid removed therefrom), the substrates are preferably dried to a low moisture content, which may vary depending upon the particular substrates that have been treated. The moisture content of the treated substrates will generally range from about 0 to about 30 weight percent, and more preferably ranging from about 2 to about 20 weight percent, and still more preferably ranging from about 2 to about 5 weight percent, with about 2 weight percent being most preferred. Substrates that have durable treatments (that are durable) will generally have a moisture content of about 20 weight percent or less. A commercially-available moisture meter can be employed to measure the weight percent of moisture that is present in a treated substrate.

The final moisture content of the treated substrates may vary depending upon the characteristics of the substrates. For example, hydrophobic substrates may have a moisture content of about 0 weight percent, while hygroscopic substrates, such as polyesters, may retain moisture after drying. Hygroscopic substrates will often have a final moisture content ranging from about 0 to about 3 weight percent. Hydrophilic substrates, such as cellulosics, generally contain structural water, and may have a moisture content that varies with the environment, and may rise rapidly to equilibrium after removal from a drying oven.

The temperatures at which, and the amount of time during which, treated substrates will generally dry to the above-described moisture content may vary depending upon the particular flame retardant substances employed, the particular substrates being treated, the amount of substrates employed, the particular application method employed, the function that the final product should perform and like considerations, and may be determined by those of skill in the art. The temperatures should be high enough to allow the substrates to dry (to achieve the moisture level described herein), but not so high that the substrates will be subjected to conditions of burning. For example cotton fabric generally begins to decompose at a temperature of about 148° C., and thermoplastic materials have thermal melting points that should be considered when selecting a drying temperature. Generally, various types of substrates may be dried to the moisture content described herein by exposing them to air at a temperature generally ranging from about 4° C. to about 180° C., and preferably ranging from about 70° C. to about 130° C. Room temperature drying may take up to about 24 hours, depending upon the size of the treated batch of the substrate. Generally, a 100-gram substrate sample can be dried in a period of time ranging from about 1 to about 5 minutes in an oven, while a ton of treated product can be dried in a commercial scale gas-fired oven in a period of time ranging from about 30 to about 60 minutes. Drying times, however, may be affected by a number of parameters, including, but not limited to, the hydrophilic nature of the fibrous content of the treated substrate, by the density of the substrate construction, and by the amount of flame retardant treatment taken up by the substrate.

Commercially-available ovens, steam heated conveyer dryers, hot air generators, superheated steam generators, infrared radiation devices, yankee dryers, steam cans, microwaves, hot-air or through-air devices, as well as other drying equipment known by those of skill in the art, can be employed to dry the wet substrates. A gas fired conveyor oven having multiple 4 to 5 zone heating is preferred for use. The drying step of the process may or may not a part of a "closed loop" process or system, and may occurs separately, for example, using separate devices, apparatuses or other drying equipment.

The processes and systems of the invention do not generally require the performance of any additional steps, such as a separate baking step or curing step, after the above drying process, which render these processes and systems less time consuming and more cost effective in comparison with other flame retardant processes and systems.

The weight percent of solid flame retardant substances that may be taken up by, and be distributed within, or on one or more surfaces of, substrates that have been treated and dried in accordance with the processes and systems of the invention may vary, depending upon one or more of the characteristics described hereinabove. However, such weight percent of solids will preferably range from about 1% to about 40% for non-durable treatments and substrates (with between about 5% and 20% being most preferred), and from about 5% to about 20% for durable treatments and substrates. For durable treatments, it is preferred that at least about 70% of the dry flame retardant substance add on is retained following a washing or cleaning cycle of the treated substrate. For example, if a treated material has about a 15% dry add-on, the dry weight of the treated fabric is 1.15× the dry weight of the pre-treated fabric and the additional weight is the flame retardant treatment chemicals. After a washing cycle, then the remaining dry weight of the flame retardant chemicals would be 10.5% versus the starting 15%. Likewise, if the dry add-on for the flame retardant treatment is 20%, after washing the dry add-on would be about 14%. A commercially-available refractometer may be employed to perform these measurements.

"Closed Loop" System

The system of the present invention may comprise a wide variety of stationary, rotating and/or movable components to achieve the desired result of reusing (recycling) the chemical compounds, compositions of the invention and/or rinse liquids employed therein (and possibly other agents, substances and/or compositions).

Components that may be employed in the systems of the invention, in any of a wide variety of combinations and/or configurations, include, but are not limited to, one or more of the components set forth below.

(a) Storage Tanks, Vessels or other Containers

Storage tanks, vessels, containers or other means for storing and/or containing items may be employed to separately store or contain one or more flame retardant substances, one or more aqueous liquids, one or more adhesion agents, one or more stability enhancing agents, one or more viscosity enhancing agents and/or one or more wetting agents, one or more compositions of the invention, one or more rinse liquids and/or one or more other desired (optional) elements, chemical compounds, substances, agents or compositions. Such containers are preferably made of stainless steel, and preferably contain one or more level sensors.

(b) Feed, Return or other Lines

Feed lines, return lines, other lines or other means for permitting one of the items discussed above in (a), or spent (used) items, such as a flame retardant composition that has been applied to one or more substrates and that is being recycled for application to one or more other substrates (of the same or different type), to flow or otherwise travel from one location, component or area, such as an application tank or a centrifuge collection tank, to another location, component or area, such as a different application tank or a flame retardant composition collection tank. These lines can be partially or fully hollow tubes of, for example, rubber, plastic and/or metal. They can be employed, for example, to permit items contained in storage tanks, vessels or other containers to preferably travel separately to one or more mixing and/or treatment tanks, vessels, other containers, devices or apparatuses (in which one or more steps of the processes of the invention are performed, such as the mixing of one or more flame retardant substances with one or more aqueous liquids, one or more adhesion agents and, optionally, one or more stability enhancing agents, viscosity enhancing agents and/or wetting agents, the treatment of one or more substrates with one or more compositions of the invention and/or rinse liquids, and/or the replenishing of spent elements, chemical compounds, agents, substances or compositions, such as compositions of the invention and/or rinse liquids).

(c) Mixing Tanks, Vessels or other Containers

Mixing tanks, vessels, containers and other means for permitting the mixing of two or more elements, chemical compounds, agents, substances or compositions together, such as one or more flame retardant substances with one or more aqueous liquids, may be employed. Mixing and other tanks, vessels or containers, which are generally made of stainless steel, preferably have volume marks, such as in 5- or 10-gallon increments, on the inside thereof so that any desired amount of a mix can be formulated.

(d) Mixing Devices or Apparatuses

Mixing devices, apparatuses or other means for mixing two or more elements, chemical compounds, agents, substances or compositions together, such as one or more flame retardant substances with one or more aqueous liquids, one or more adhesion agents and, optionally, one or more stability enhancing agents, viscosity enhancing agents and/or wetting agents, and/or to perform any other desired mixing steps, such as a high speed, high shear mixer, can be employed.

(e) Treatment Tanks, Vessels or other Containers

Treatment tanks, vessels, containers, apparatuses or other means for containing and/or applying one of more flame retardant compositions of the invention to one or more substrates, such as kettles, dye tanks or dye machines, can be employed.

(f) Application Devices or Apparatuses

Application devices, apparatuses or other means for applying one of more flame retardant compositions of the invention to one or more substrates, such as paint or other rollers or brushes and sprayers, can be employed. Stock dye and package dye machines are preferred for use.

(g) Holding Tanks, Vessels, Containers or Collection Devices

Holding tanks, vessels, containers, collection devices (collection pans and the like) or other means for collecting, housing and/or containing one or more spent (used) elements, chemical compounds, agents, substances or compositions used in the processes and systems of the invention, such as compositions of the invention or rinse liquids, prior to their next use or other subsequent uses, can be employed.

(h) Rinse Liquid Tanks, Vessels or other Containers

Rinse liquid tanks, vessels, containers or other means for housing or containing one or more rinse liquids can be employed.

(i) Rinsing Devices or Apparatuses

Rinsing devices, apparatuses or other means for rinsing one or more substrates with one or more rinse liquids, such as sprayers, hoses, shower-head type devices and components of dye machines, can be employed.

(j) Devices for Removing Excess Composition and/or Rinse Liquid

Devices and other means for removing excess composition of the invention and/or rinse liquids from substrates, such as squeeze rollers, other compression devices or centrifuges, may be employed.

(k) Transfer or other Pumps and Circulation Devices

Transfer or other pumps, other circulation or flow devices, and other means for causing one or more of the items discussed in (a) above to flow or otherwise travel (often as a result of pressure, and usually in a feed, return or other line) from one location or component of the system to another location or components of the system, such as from one or more storage tanks to one or more treatment tanks, may be employed.

(l) Valves

Valves, for example, shut down valves, check valves or three-way valves, for water or compositions of the invention, or other means for permitting, terminating and/or otherwise regulating and/or controlling the flow or travel, or the rate thereof, of various elements, chemical compounds, agents, substances or compositions, such as one or more compositions of the invention, or one or more rinse liquids, within various feed lines, return lines and other devices and/or apparatuses employed in the systems of the invention, or into or out of various tanks, vessels or containers employed in the systems of the invention, may be employed.

(m) Motorized (or Non-Motorized) Reels

Motorized and/or non-motorized reels, and other means for moving substrates or other items in and/or out of single, multiple or other tanks, vessels or other containers containing one or more compositions of the invention, one or more rinse liquids or one or more other agents, substances or compositions, or to move one or more agents, substances, compositions or rinse liquids from one location to one or more other locations, can be employed.

(n) Pressure, Temperature, Light, Quantity, Level or other Sensors

Pressure, temperature, light, quantity, level and other types of sensors or detection means can be employed to regulate the operations of one or more steps in the processes or systems of the invention, for example, to regulate pressure, temperature, the quantity of an element, chemical compound, agent, substance or composition or some other variable in the systems of the invention.

(o) pH Meters pH meters or other means for measuring and/or controlling the pH level of substances, agents, compositions and/or mixtures employed in the processes and systems of the invention can be employed.

(p) Flowmeters

Flowmeters or other means for measuring and/or controlling the flow of substances, agents, compositions and/or mixtures employed in the processes and systems of the invention can be employed.

(q) Filters

Filters or other means for filtering or removing debris, build-up, deposits, substrates (such as coarse cellulose fibers) or similar materials that may become present in flame retardant compositions or rinse liquids being recycled may be employed.

(r) Components of Known Dyeing Machines

Components of dye machines that are not described above, or whole dye machines, as is shown in FIG. 1, may also be employed.

Known dyeing machines include, but are not limited to, Beam, Beck, Continuous, Jig, Jet, Package, Stock and Pad-Batch dye machines, all of which are commercially available from sources known by those of skill in the art, such as Braun, Inc. (Syracuse, N.Y.), TVE Escale USA (Dalton, Ga.), IPA Southern (Easley, S.C.) and Republic Textile Equipment Company (www.reptex.com). Any type of dye machine that has the capability of applying one or more flame retardant compositions to one or more substrates, for example, by drenching, saturating or impregnating the substrates, may be employed. Preferably, dye machines containing pressurized vessels that have the ability to impregnate loose substrates, such as loose fibers, loaded within one or more baskets, with one or more flame retardant compositions, such as stock dye machines, are employed. Dye machines may vary in size and other characteristics. For example, stock dye machines may be 90" in diameter×50" deep, with a pressure expansion tank and microprocessor controller, 70" in diameter×50" deep, with a pressure expansion tank and a Cyclegog controller, 54" in diameter×24" deep, with a Morton pressure expansion tank and a Cyclegog controller, 40" in diameter×24" deep, with a pressure expansion tank and a microprocessor controller, or of some other size and/or type.

Components of dye machines that may be useful in "closed loop" processes and systems of the invention include, for example, pumps that can cause one or more flame retardant compositions to penetrate substrates, such as fibers, dye machine controllers (in stand alone or hosted modes, and preferably containing one or more color, touch screen displays), dye and chemical dispensing systems, barcode scanners, scales drum or other dryers. The foregoing components are commercially available from sources known in the art, such as Cubex, Inc. (Fort Mill, S.C.).

(s) Computers and Control Panels

Commercially-available computers, software programs and control panels can be used to initiate and/or terminate the operation of, and/or control or monitor, dye machines and other devices that may be employed in the processes and systems of the invention, including one or more application, rinse or other cycles thereof. The recommendations of the manufacturer, such as dye machine manufacturers that market dye machines and associated control panels and/or computer software, should generally be followed.

One, two, three or some other plurality of application devices, such as dye machines, or components thereof (or other components), and/or related components, may be employed in the "closed loop" systems of the invention. One example of a "closed loop" system of the invention is shown in FIG. 1. The system shown therein has two separate dye machines and related components, permitting the same flame retardant solution to be applied to a first group of one or more substrates in the first dye machine, and subsequently (afterwards) to be applied to a second (separate) group of one or more substrates in the second dye machine.

In contrast with the "closed loop" processes and systems of the invention, dyebath reuse (the recycling of a dye bath) disadvantageously carries a significant risk of shade variation because impurities can accumulate in the dyebath and decrease the reliability of the process.

Blends of Treated Substrates and Untreated Substrates

One or more substrates, such as non-thermoplastic filaments and fibers, that have been treated in accordance with the processes, systems and/or compositions of the present invention may be mixed or otherwise combined with one or more substrates that have not been treated in accordance with any of these processes, systems and/or compositions (or that otherwise do have any flame retardant properties, or that have flame retardant properties that can be enhanced), to produce a substrate, such as a fabric, textile or item of apparel, that contains at least some (from more than about 0% to less than about 100%) treated substrates and at least some (from more than about 0% to less that about 100%) untreated (or otherwise non-flame retardant or less flame retardant) substrates. Such blended substrates should, therefore, have at least one or more flame retardant properties added thereto, or one or more enhanced flame retardant properties, in comparison with the same substrates, but in which no treated substrates were employed.

Additional Description

In a preferred embodiment, the substrates to be treated in accordance with the processes, systems and/or compositions of the invention, for example, non-thermoplastic fibers, fibrous compositions or fabrics, have one or more flame retardant properties added thereto and are, thereby, made to be flame retardant, by coating one or more surfaces and/or other components of the substrate with, or otherwise incorporating into the substrate, a flame retardant substance comprising a mixture of two or more flame retardant compounds selected primarily from the group consisting of halogen-free phosphoric acid derivatives, halogen-free phosphonic acid derivatives, ammonium polyphosphate, organophosphorus chemicals, melamine chemicals, intumescent chemicals, alumina trihydrate, brominated aromatic compounds and brominated cycloaliphatic organic compounds. One or more of the foregoing or other flame retardant substances is mixed with an aqueous liquid or non-aqueous liquid, one or more adhesion agents and, optionally, with one or more stability enhancing agents, one or more viscosity enhancing agents and/or one or more wetting agents to produce a mixture, which may be a solution, a suspension, a dispersion, an emulsion or in some other solid/liquid or liquid/liquid form, in a "closed-loop" system. The one or more adhesion agents may be, for example, polymeric adhesive binders. The one or more stability enhancing agents may be, for example, surfactants, emulsifying agents and the like. The one or more viscosity enhancing agents may be, for example, protective colloids and the like. The one or more wetting agents may be, for example, Ethal DA-6.

The one or more non-thermoplastic or other substrates, such as fibers, fibrous compositions or fabrics, are coated with the resulting flame retardant composition of the invention, are soaked in such composition, or otherwise have the composition applied thereto, preferably in a manner that permits the one or more flame retardant substances to become incorporated into the substrates. The terms "coated" and "coating" as used herein, unless otherwise specified, includes: (1) applying a flame retardant composition of the invention to one or more of the surfaces of one or more substrates, such as non-thermoplastic fibers, fibrous compositions or fabrics, using coating techniques, for example, brushing, painting, spraying, wiping, rolling or other coating techniques known by those of skill in the art; and (2) incorporating the flame retardant composition of the invention into one or more substrates, such as non-thermoplastic fibers, fibrous compositions or fabrics, for example, by immersing, drenching, permeating or soaking the substrate with such composition, or using other incorporation techniques known by those of skill in the art. Also, the term "fibrous composition," unless otherwise specified, is intended to mean any material comprising fibers and includes without limitation woven, nonwoven, air-formed, or felted material.

After the non-thermoplastic or other substrates, such as fibers, fibrous compositions or fibers, are coated with one or more compositions of the invention, excess liquid that may be present within, or on, the substrates is preferably removed therefrom, and the resulting mass (or other form or configuration) of the substrates is dried. The excess liquid may be transferred to a holding vessel to be reused at a later time. Flame retardant substances that are present in the compositions of the invention become left on, or permeated into or through, the substrates, such as non-thermoplastic fibers, fibrous compositions and fabrics.

The non-thermoplastic or other substrates, such as fibers, fibrous compositions and fabrics, that are made flame retardant by coating, or otherwise applying, the substrates with one or more flame retardant composition, including mixtures thereof, according to this invention may be distinguished by having surprisingly good fire characteristics as compared to others in the art.

Non-thermoplastic substrates, such as fibers, fibrous compositions and fabrics, are generally highly flammable. Thus, it is of primary importance to coat or otherwise apply the compositions of the invention to these substrates. Thus, this problem, which is significant, can be accordingly solved by the processes, compositions and systems of the present invention. The desired flame retardant protection can be achieved by coating or otherwise applying the non-thermoplastic substrates, such as fibers, fibrous compositions and fabrics, with a flame retardant composition of the invention, including mixtures thereof, as described above. The result is that when the treated non-thermoplastic substrates, such as fibers, fibrous compositions or fabrics, are exposed to flames or fire, a char or intumescent mass is generally produced, usually on one or more of the surfaces of the substrates, but sometimes on or in one or more of the other components or areas of the substrates. The char or intumescent mass generally reduces, retards, inhibits, slows and/or stops the burning of the substrates, such as non-thermoplastic fibers, fibrous compositions or fabrics, regardless of what flame retardant or other protection may or may not have been provided by thermoplastic filaments, fibers, fibrous compositions, fabrics, textiles or materials intended to protect the non-thermoplastic substrates. That is, although the substrate, such as a material, may char and, thus, form an intumescent mass thereon or therein when exposed to flame or fire, the substrate will generally not melt, and will, therefore, generally act to block an open or other flame or fire. The char alone, or the mass that results from melted intumescent materials on a substrate surface, can provide flame retardant protection to a labile non-thermoplastic substrate, regardless of the presence of any thermoplastic materials which may be present. The substrate can be used as a cover intended to protect the non-thermoplastic material from a flame.

A similar result can be achieved by creating a fibrous composition, fabric or other substrate that is not formed entirely of non-thermoplastic materials, but incorporates therein, or contains, both: (a) thermoplastic materials; and (b) non-thermoplastic materials, wherein the latter (non-thermoplastic materials) have been treated according to the processes, systems and/or compositions or the current invention. Such mixed substrates, such as fabrics, when exposed to flame or fire, may partially melt, but the treated non-thermoplastic material component(s) of the substrates generally will not melt, and will generally help to prevent further exposure to the open or other flame or fire. Preferably, such mixed substrates do not contain more than about 80 weight percent of thermoplastic materials, and more preferably do not contain more than about 60 weight percent of thermoplastic materials.

The flame retardant substrates, such as non-thermoplastic fibers, fibrous compositions and fabrics, that are produced in accordance with the processes, systems and compositions of the present invention may be used in a wide variety of different applications, for example, in or on furniture, mattresses, bedding, window, wall and floor treatments, fire barriers, items of apparel, uniforms, textile coatings, laminates, linings, tents and/or in the other items and/or applications described hereinabove in the definition of "material," as insulators, and in other uses.

After applying the flame retardant composition of the present invention to one or more substrates, the spent (used) liquid flame retardant composition is preferably removed from the vessel in which it is contained, and the substrates, such as non-thermoplastic fibers, fibrous compositions or fabrics, may be rinsed with a rinsing liquid. Spent (used) rinse liquid may be removed from the vessel in which it is contained and transferred to another vessel for reuse. This series of events generally results in a loss of flame retardant composition (because the liquid becomes depleted as a result of the treatment of the substrates). The solids content (% solids) of the reclaim liquid (liquid to be reused) may be checked using a refractometer. The flame retardant composition is preferably replenished by the addition of flame retardant composition contained in a master mix batch. After this liquid addition, the match of the original solids of the liquid may be confirmed using a refractometer. Preferably, the amount of a composition of the invention or rinse liquid that is employed to replentish the depleted composition of the invention or rinse liquid will be the same amount of the composition of the invention or rinse liquid that has been used up during the process of treating the substrate. For example, if one ounce of the composition of the invention, or of the rinse liquid, becomes depleted during the treatment process, then one ounce of the composition of the invention, or rinse liquid, respectively, will generally be added to the process or system to replentish or replace the depleted composition of the invention, or rinse liquid. While this method of treatment is similar in some aspects to the use of a dye bath, there are significant differences between the two types of processes. Disadvantageously, in dye bath processes, the dye mixture remaining after the treatment of filaments, fibers, fibrous compositions, fabrics or textiles generally have to be discarded, rather than being reused, resulting in a waste of the remaining dye mixture, which substantially increases the costs associated with this process. The remaining dye mixture often cannot easily be reconstituted or recycled because of its nature. The reuse or recycling of the remaining dye mixture often produces a differing color quality (a miscoloration resulting in a color that is too dark, too light or otherwise different) in comparison with the originally used dye mixture. Such dye bath processes are, therefore, "open loop" type processes, in which the remaining dye mixture has to be discarded. This often results in environmental concerns or required and costly pre-disposal treatments.

A batch type or continuous process may be employed in connection with the processes, systems and compositions of the current invention for imparting one or more flame retardant qualities to non-thermoplastic and other substrates, such as fibrous materials. Due to the nature of the flame retardant compositions of the invention used, the compositions remaining after treatment of one batch of non-thermoplastic or other substrates, such as fibrous materials, can generally be effectively recycled and re-used in at least one, and preferably in multiple (2, 3, 4, 5, 6, 7, 8, 9, 10, 15, 20, 25, 30, 35, 40, 45, 50), subsequent applications of the compositions to substrates. Both the flame retardant compositions and the rinse liquids can be recirculated and reused in the next or other subsequent applications since neither contains any dye that would contaminate the processes or systems of the invention, or the substrates employed. Moreover, the liquid compositions according to the current invention can be easily and cost-effectively reconstituted and, thus, re-used. The processes and systems according to the present invention are, therefore, generally "closed loop" systems, conserving chemicals and rinse liquids, thereby reducing or eliminating many costs that generally must be incurred in other fire retardant processes and systems, such as costs of chemicals and rinse liquids, chemical predisposal treatment costs, chemical disposal costs and the like.

One aspect of the current invention relates to a new method of creating flame retarding non-thermoplastic and other substrates, such as fibers, fibrous compositions and fabrics (sometimes generally referred to herein as "fiber materials"), using a method that has some similarities to methods commonly employed in pigment printing and dyeing. Through the use of an aqueous or nonaqueous liquid containing one or more adhesion agents (primary binders) that serve as adhesives to adhere one or more flame retardant substances to one or more given non-thermoplastic or other substrates, such as fiber materials, the compositions of the invention generally provide one or more excellent flame retarding properties to the substrates and/or enhance one or more flame retardant properties of the substrates. In addition, this technique can advantageously serve to render the adhesion agents or primary binders flame retardant. Surprisingly, these aqueous liquids containing the adhesion agent or primary binders are often emulsions of synthetic polymeric materials that are highly flammable, and that typically actually contribute to the flammability of flame retardant substrates. However, they may also be in other forms, such as solutions, suspensions, dispersions and the like.

While the processes and systems of the present invention may utilize one or more techniques for applying dyes using batch type overdye equipment, such as techniques employing a package dyer, a stock dyer, a dyebeck, a skein dye machine, a paddle dyer or continuous dye operations, they are unique in that the processes and systems use no dye bath. Spent flame retardant composition that results from the processes and systems of the invention can be transferred to a first or other holding vessel, and the rinse liquid can be transferred to a separate hold vessel. Both the flame retardant compositions and the rinse liquids can generally be reused in one or more subsequent applications because neither generally contains an amount of a dye or other material that would contaminate the processes, systems or substrates. The result is a "closed loop" process that conserves chemicals and rinse liquids.

The flame retardant compositions of the current invention contain two important components: (a) one or more flame retardant substances; and (b) one or more adhesion (binding) agents.

With respect to the first component (the flame retardant substances), in a preferred embodiment of the processes, systems and compositions of the invention, the flame retardant substances comprise one or more chemical compounds, including mixtures thereof, preferably selected from the group consisting of halogen-free phosphoric acid derivatives, halogen-free phosphonic acid derivatives, ammonium polyphosphate, organophosphorus chemicals, melamine chemicals, intumescent chemicals, alumina trihydrate and brominated organic compounds, which may or may not be present in an aqueous medium. One or more stability enhancing agents, such as one or more surfactants and/or emulsifying agents, may, optionally, be included in the mixture to provide stability thereto, or to enhance the stability of the mixture, along with one or more optional viscosity enhancing agents, such as protective colloids (to function as a thickening agent). These are combined together with an adhesion agent, such as a high molecular weight polymer, for example, latex. After the composition of the invention is applied (in original form or in a recycled form) to one or more non-thermoplastic or other substrates, and the substrates are dried, for example, by heating or by exposure to air at ambient temperature, a film generally becomes formed on one or more surfaces of the substrates, or on, or in, one or more other components of the substrates, which generally protects the substrates, such as non-thermoplastic fibers, when exposed to conditions of fire or flame. This film generally renders the substrates, such as non-thermoplastic fibers, fibrous compositions or fabrics, retardant to an open or other flame or fire by forming a charred protective layer thereon and/or therein upon contact with an open or other flame or fire. The flame retardant composition may be durable, partially durable or non-durable when exposed to water, cleaning agents, dry cleaning agents or solvents or the like, depending upon the type of adhesion agents used in the flame retardant composition. In preferred processes, systems and compositions of the invention, the adhesive agent is selected to enhance the durability of the flame retardant treatment. The flame retardant substances may be reduced to a small particle size, and an extremely small particle size where desired, by conventional means, such as grinding, crushing, shear cutting, granulating, pelletizing, dicing, pulverizing, high speed impact shattering or other methods.

Halogenated organic flame retardant compounds are well known in this art and are only described here in a detail sufficient to an understanding of the current invention. Also present, as indicated heretofore, is an aqueous or nonaqueous medium and optionally, to afford stability, a surfactant, and preferably a nonionic or anionic surface active agent.

Suitable carbonization auxiliaries, such as phosphoric acid, phosphonic acid, phosphoric acid derivatives and phosphonic acid derivatives, ammonium polyphosphate, organophosphorus chemicals, melamine chemicals and intumescent chemicals are compounds that, in the presence of fire, assist the formation of a carbonization foam or char.

The "second" component used in the processes, systems and compositions of the invention is: (a) an aqueous suspension, dispersion or emulsion containing an adhesion agent, such as a high molecular weight polymer, in water or in another suitable liquid solvent; or (b) an aqueous emulsion polymer, which is commonly referred to as a latex.

Due to the fact that latexes or latices possess extremely good adhesive properties, they are normally used for bonding purposes. At the same time, in the finished state when they are dried and adhered to the fabric or other substrate to which they are applied, the latexes, when bonding or incorporating the flame retardant substances described herein to or within a substrate, hold the flame retardant substances on and/or in the substrate, and allow for the formation of a charred protective layer on and/or in the substrate, which generally prevents the substrate from burning when exposed to an open or other flame or fire. Latexes are also used for the bonding of pigments on difficult-to-dye substrates, to bond fibers with fibers, to obtain non-woven fabrics, to bond fibers to fabrics to produce flocked fabrics, and to bond fabrics to fabrics, fabrics to foams, fabrics to films, non-wovens, etc. to obtain laminated fabrics. They are also used for fabric backcoating to achieve various effects, such as dimensional stability, to prevent raveling, to give fabrics non-slipping characteristics with a filler, to impact opacity to fiber material, for finishing to achieve dimensional stability, to increase strength, to decrease air permeability, to impart water and water repellency, and for other purposes.

The present invention relates to at least the following different uses of the fire retardant substances and the latex or other adhesion agents:

(a) to use the adhesion agents, such as latex adhesive materials, to bond one or more flame retardant substances to non-reactive substrates, such as non-thermoplastic filaments, fibers, fibrous compositions, threads, yarns, fabrics, textiles, items of apparel, materials and/or blends;

(b) to use the flame retardant substances to render latex or other films produced from the application of adhesion agents, such as latex adhesive materials, to substrates non-combustible or self-extinguishing; and/or (c) to provide a latex or other film (resulting from the application of an adhesion agent to a substrate) which covers and/or permeates the substrate, such as fabric fibers and, while permitting the passage of air through the interstices between the individual components of the substrate, such as fibers, partially occludes these passages, and provides a charred protective layer in and/or on the substrate when in contact with an open or other flame or fire.

In the processes and systems of the invention, spent flame retardant composition is preferably transferred (by being pumped or otherwise caused to move or flow) to a holding vessel or, alternatively, to a second or other system or machine, after being used in an application to one or more substrates, such as coating non-thermoplastic fibers, fibrous compositions or fabrics. Additionally, one or more rinse liquids that have been used to rinse the substrates after being treated with one or more compositions of the invention are preferably transferred to a separate holding vessel. Thereafter, both the flame retardant composition of the invention and the rinse liquids can be reused in one or more subsequent application to substrates because neither generally contains an amount of dyes or other substances or agents that would contaminate the compositions, rinse liquids, process and/or system. The result is a "closed loop" process that conserves flame retardant and other chemicals, as well as rinse liquids.

The compositions of the invention, which are generally latex or other adhesion agent film-forming compositions, comprise one or more flame retardant substances, and preferably include a blend of one or more of the following flame retardant substances: (a) halogen-free phosphoric acid derivatives (including phosphoric acid); (b) halogen-free phosphonic acid derivatives (including phosphonic acid) (c) ammonium polyphosphate; (d) organophosphorus chemicals; (e) melamine chemicals; (f) intumescent chemicals; (g) alumina trihydrate; and (h) brominated organic compound. The compounds may be in a solid, particulate or liquid form and, in the compositions of the invention, are generally dissolved, dispersed, suspended or otherwise present in an aqueous or non-aqueous medium. In a preferred embodiment of the compositions of the invention, the one or more flame retardant compounds are present in a dispersed phase that is maintained through the use of one or more nonionic or anionic surfactants and/or emulsifiers, or mixtures thereof. The one or more flame retardant substances, which are preferably dispersed in an aqueous emulsion polymer, such as an aqueous emulsion having a high molecular weight polymer as the solid phase and water as the liquid phase, for example, a latex, upon drying, generally result in flame retardant substrates, such as non-thermoplastic fibers, fibrous compositions or fabrics, that have a charred protective layer formed thereon or therein which, when in contact with an open or other flame or fire, functions to prevent the substrates from burning.

Preparation

If not present in a size reduced form, the one or more flame retardant substances employed in the compositions of the invention are preferably size reduced to the size described hereinabove in a manner known by those of skill in the art.

The size reduced (pulverized, micropulverized, etc.) solid or liquid flame retardant substances, such as brominated organic flame retardants, are mixed with, and preferably become dispersed within, an aqueous or non-aqueous liquid, as well as with one or more adhesion agents and, optionally, one or more stability enhancing agents, one or more viscosity enhancing agents and/or one or more wetting agents using commercially available mixing equipment, such as a high speed, high shear mixer, and preferably under conditions of strong agitation. The various components of the mixture may be added in any suitable or convenient order. For example, one or more wetting agents may be mixed with the aqueous liquid, and thereafter the one or more flame retardant substances and one or more adhesion agents may slowly be added thereto and mixed therewith. After the addition of the one or more flame retardant substances and the one or more adhesion agents has been completed, the resulting mixture, for example, a dispersion, can have its viscosity increased (and can be stabilized) by adding small quantities of a protective colloid (commonly also called a "thickener"), such as carboxy methyl cellulose, methoxy cellulose or ethoxy cellulose, of selected molecular weight to achieve an optimum viscosity and further prevent the solid particles present in the mixture from settling.

The one or more viscosity enhancing agents, such as one or more protective colloids, are included as an optional component in the processes, systems and compositions of the invention, and may be added, illustratively, before or after addition of the latex or other components to the aqueous liquid. Protective colloids and other viscosity enhancing agents may be incorporated as a component of the compositions of the invention for the purpose of facilitating conventional printing and/or coating steps in which the compositions of the invention are included, or for achieving other desired results.

The viscosity of the flame retardant composition that may be adjusted upon dilution with water (or other suitable aqueous or non-aqueous solvent) to bring the weight percent of the flame retardant compositions to 100%. The viscosity of the mixture of the adhesion agent, such as latex, with the other components of the compositions of the invention should preferably be within the range of from about 50 to about 1,500 cps, and more desirably be within the range of from about 100 to about 1,000 cps, with a particularly preferred viscosity being 500 cps. A viscosity of not less than about 50 cps is preferred in order to achieve a desirable shelf-life for the mixtures formulated in accordance with the processes, systems and compositions of the invention. Such shelf life may vary depending upon the particular substrates being treated, the particular compositions employed to treat the substrates, the particular methods of application employed and other like considerations. The foregoing viscosity ranges are not absolute, because the desired viscosity may be varied in accordance with the type of substrate, such as non-thermoplastic fiber material, being treated, the particular use for which the treated substrate is intended and other like considerations. The flame retardant composition so prepared may be diluted with water or another suitable solvent to a predetermined strength. Sufficient adhesion agent is mixed with the other components of the compositions of the invention to achieve adhesion of the one or more flame retardant substances to one or more substrates. The upper end of the above-described viscosity range generally provides a more effective and thicker coating or film on substrates when a composition of the invention having such a viscosity is applied to substrates, such as non-thermoplastic fabrics. The lower end of the above-described viscosity range generally provides a lighter, more flexible and porous substrate, such as non-thermoplastic fibers, fibrous compositions or fabrics, but still generally effectively produces a charred protective layer on the substrate when in contact with an open or other flame or fire.

The compositions of the invention, which may be in the form of various types of mixtures, such as dispersions, have been found to have particular utility as adhesive flame retardant compositions for application to one or more substrates, such as non-thermoplastic fibers, fibrous compositions and/or fabrics, that are used as "protective substrates" for mattresses, furniture, insulation, construction materials and similar items.

The resulting composition of the invention, which may be in the form of a dispersion, can be applied to one or more substrates, such as non-thermoplastic fibers, fibrous compositions or fabrics, in any suitable manner, such as by the dipping of the substrate into the composition with removal of the excess composition therefrom using any suitable methods, which are known by those of skill in the art, such as using squeeze rolls, i.e. squeezing between two rollers, or other means. The spent composition is preferably transferred (by being pumped or otherwise being caused to move or flow) to the container from which it came originally, to a different holding vessel or to a second or other system or machine. The resulting substrate may be rinsed in the same or different system or machine in which it was treated with one or more flame retardant compositions to remove any additional composition that is not necessary or beneficial for providing one or more flame retardant properties to the substrates, or for enhancing one or more flame retardant properties of the substrates, and excess rinse liquid removed from the substrates using any suitable methods, such as those described above. The spent rinse liquid is preferably transferred (by being pumped or otherwise being caused to move or flow) to the container from which it came originally, to a different holding vessel or to a second or other system or machine. The substrate is preferably removed from the treatment or rinse tanks, or from other components of the system or machine, and the composition of the invention and the rinse liquids are preferably replenished and returned to the treatment and rinse vessels, respectively. As a result of the absorption of the compositions of the invention onto or into one or more substrates, make-up (replenishing) quantities of compositions of the invention may be employed. Commercially available equipment can be used to determine the amounts of compositions of the invention, and components contained therein, that should be used to replentish used or lost compositions. The substrate, which will generally be wet, with excess composition having been removed therefrom, should then be dried to achieve a low moisture content, such as 0 weight percent. This may be performed by air or other drying the substrate at any suitable or convenient temperature, for example, at a temperature ranging from about 70° C. to about 180° C. for a period of time of at least about 5 minutes, or a temperature ranging from about 100° C. to about 180° C. for a period of at least about 60 minutes and, most desirably in terms of efficient operation, at a temperature ranging from about 125° C. to about 180° C. for a period of time ranging from about 30 minutes to about 60 minutes.

The resulting material, which will generally be a film coated substrate, such as a fabric, will generally exhibit flame retardant properties when tested by commonly used flammability tests. Further, when a crosslinking adhesion agent is employed in the processes, systems and/or compositions of the invention, the flame retardant properties of the substrates are generally not lost after one or more, such as multiple, launderings and/or dry cleanings. The flame retarded substrate, however, can be made non-durable, if desirable, by selecting a non-crosslinking adhesion agent, as illustrated in the examples set forth below.

Thus, the flame retardant, non-adhesive, thermal moderating dispersion prepared as described herein, may be diluted with water (or with another solvent employed as the aqueous or non-aqueous liquid), the latex is added and the viscosity adjusted by the use of a thickener, if desired.

One or more compositions of the invention may be applied to non-thermoplastic or other substrates, such as fibers, fibrous compositions and/or fabrics, by any of a wide variety of different techniques, depending on the final effect desired, for example, in a treating or other batch, or in a continuous process. The compositions can be applied, for example, using batch type overdye or other equipment, which are known by those of skill in the art, and which are commercially available, such as a stock dyer, a package dyer, a dyebeck, a skein dye machine, or a pad dyer, using continuous dye operations or using no dye bath. The compositions can be padded, knife coated, roller coated, sprayed, roller printed, screen printed, applied by saturation or applied by other methods to the substrates. After excess flame retardant compositions are removed from the substrates, the substrates are air or otherwise dried, as described hereinabove. Spent flame retardant composition can be transferred to a holding vessel, and any rinse liquids employed can be transferred to a separate holding vessels. Both the spent flame retardant composition and the rinse liquids can advantageously be reused in the next application to one or more substrates, and generally in one or more other subsequent applications to one or more of the same or other substrates, since neither the spent flame retardant composition nor the used rinse liquids generally contain an amount of a dye or other substance, agent or composition that would contaminate the process or system. Solids (and other components) contained in the flame retardant compositions, such as solid flame retardant substances, solid adhesion agents (or components thereof), solid stability enhancing agents, solid viscosity enhancing agents, solid wetting agents and the like, are preferably adjusted to the original (starting) level. The amounts of the various solids (and other components) that have been depleted during the last (or other) treatment process can be measured using methods known by those of skill in the art. Then, the same or similar amounts of the solids (and other components) that have been depleted can be added to the spent composition of the invention. The result is a "closed loop" process that advantageously conserves chemicals and rinse liquids, which can be quite expensive. The substrates can then be dried at any convenient temperature in the manner described above.

The processes, systems and compositions described herein can be employed, for example, when the one or more substrates to which one or more compositions of the invention are applied: (a) are intrinsically flame retardant; (b) are not intrinsically flame retardant; (c) have been flame-retarded and/or flame-proofed in one or more separate operations; and/or (d) have not been flame-retarded or flame-proofed in one or more separate operations.

The processes, systems and compositions of the invention can advantageously be used to flame retard adhesion agents, such as latexes and/or latices, which may be employed, for example, as flocking adhesives, for fabric backcoating, for pigment dyeing or printing, for bonding and/or for non-woven fabric lamination and the like.

The processes, systems and compositions of this invention can be applied to natural, synthetic and/or cellulosic, non-thermoplastic and other substrates, for example, to textile materials (and in textile processes and systems), staple, tow, yarn fiber, woven fabrics, non-woven fabrics, circular and/or flat knits, and the like, and to paper, other cellulosic materials and the like.

The substrates that are preferred for use in connection with the processes, systems and compositions of the invention (in the preparation of flame retardant substrates, such as fabric) are cellulose materials, for example, cellulose fibers or fabrics, particularly the naturally occurring cellulosic fiber, flax, and yarns, fabrics, textiles, items of apparel and the like, produced using flax or a flax blend. Other cellulose substrates, such as fibers and/or fabrics, include kenaf, ramie, caroa, bagasse, ficque, banana, cotton, linen, jute, coconut fiber, rayon, hemp, wood pulp, straw, recycled paper or other cellulose-base waste products and mixtures thereof.

Naturally-occurring polypeptides and/or proteinaceous substrates, such as filaments, fibers, fibrous compositions and/or fabrics, such as wool and silk, are also preferred substrates for used in accordance with the processes, systems and compositions of the invention, particularly in apparel and/or decorative end use applications.

For the reasons described hereinabove, thermoplastic substrates (containing 100% thermoplastic material), and substrates that are a blends containing above about 95% by weight of thermoplastic material, such as some synthetic fabrics, for example, polyamides, acrylics, polypropylene and polyesters, generally should not be used with the processes, systems and compositions of the invention.

Brominated organic compounds that may be employed as flame retardant substances in the processes, systems and compositions of the invention include, for example, substituted and unsubstituted, brominated aromatic, saturated, unsaturated or cycloaliphatic: (a) phenols; (b) ethers; (c) esters; (d) amines; (e) hydrocarbons and/or the like. Preferred aromatic or non-aromatic, brominated or other, flame retarding substances for use in the processes, systems and compositions of the invention are further described below.

The processes, systems and compositions of the present invention preferably utilize brominated aromatic and cycloaliphatic compounds as flame retarding substances. The brominated compounds of particular utility, and that are particularly preferred for use in the practice of the processes and systems of the invention, for example, for incorporation into "molten metal flame retardant" fabrics (fabrics that may be used alone or in a product to protect against splashes or other contact with a molten metal, for example, in an apron that a smelt or metal rolling mill worker may wear to protect against contact with molten metal) and other substrates are: (a) polybrominated diphenyl oxides, e.g. decabromodiphenyl oxide; (b) polybrominated biphenyls or diphenyls, e.g. decabromodiphenyl; (c) polybrominated cycloalkanes, and most desirably, polybrominated cyclohexanes, e.g. hexabromocyclohexane, or polybrominated cyclododecane, e.g. hexabromocyclododecane, and, more particularly, 1, 2, 5, 6, 9, 10-hexabromocyclododecane, (polybrominated cyclopentane, polybrominated cyclooctane, and polybrominated cyclodecane are also useful); (d) polybrominated bisphenols, e.g. tetrabromo bisphenol A or tetrabromo bisphenol S; (e) N, N'-alkyl bis (polybrominated nonborene) dicarboximide, e.g. N,N'-ethyl bis (dibromo nonborene) dicarboximide, and other polybrominated derivatives thereof; and (f) polyhalogenated cyclopentadieno-polybrominated cycloalkanes e.g. hexachlorocyclopentadieno-dibromocyclooctane and other polychloro and polybrominated derivatives thereof.

In a particularly advantageous embodiment, the flame retardant compositions of the invention contain phosphorous, and latices that may result from the application of such compositions to one or more substrates incorporate phosphorous therein.

It is preferred that flame retardant substances other than antimony oxide be employed in the processes, systems and compositions of the invention.

Particularly preferred for use as a flame retardant substance in the processes, systems and compositions of the present invention is alumina trihydrate, preferably having a median particle size within the range of from about 0.5 to about 70 microns. Alumina trihydrate within this particle size range is readily available commercially. The density of the alumina trihydrate for use in the processes, systems and compositions of the present invention will preferably be within the range of from about 2,000 to about 3,000 grams per liter and, if alpha alumina trihydrate is employed, the density of the alpha alumina trihydrate will preferably be about 2,420 grams per liter.

Surfactants that may, optionally, be employed in forming the compositions of the invention, which may be in the form of solutions, suspensions, dispersions, emulsions and the like, include, as indicated, nonionic surface active agents, such as: (a) the ethoxylated derivatives of adducts of alkyl substituted phenols containing, illustratively, from about 7 to about 16 carbon atoms, such as nonyl phenol ($C_9H_{19}C_6H_4OH$); (b) adducts containing from about 1 to about 20 or more moles of ethylene oxide per mole of phenol; or (c) polyoxypropylene-polyoxy-ethylene copolymers (PLURONIC® polyols).

Illustrative anionic surfactants that may be useful in the practice of the invention include the alkali metal sulfates of long chain fatty acids, e.g. those containing from about 7 to about 16 carbon atoms, such as sodium lauryl sulfate, and sodium myristyl sulfate. Combinations of nonionic and anionic surfactants may also be employed.

Thickening agents or protective colloids that may, optionally, be employed in the processes, systems and compositions of the invention include, as indicated elsewhere herein, carboxy methyl cellulose, methoxy cellulose and ethoxy cellulose, preferably having a viscosity of from about 500 to about 25,000 cps, and more preferably from about 750 to about 15,000 cps.

Adhesion agents, such as high molecular weight polymers (also referred to as "emulsion polymers" or synthetic latexes or latices), that may be employed in the processes, systems and compositions of the invention can be the result of emulsion homo- or co-polymerization of monomers, such as acrylic acid, acrylonitrile, methacrylic acid, acrylamide, methacrylic acid, acrylic and methacrylic acid esters, vinyl chloride, vinyl esters, such as vinyl acetate, and vinyl copolymers, vinylidene chloride, styrene, butadiene, maleic or fumaric acids and esters of the same and the like. Such polymers can be homopolymers or copolymers of the above described monomers. These polymers are commercially available in differing grades depending on the ultimate properties desired. They have in common the fact that they generally form films at room (ambient) or elevated temperatures, alone or in the presence of plasticizers. The properties of the film depend on the chemical composition of the same.

Preferred monomers for use in the polymerization reactions (to produce emulsion polymers) are alkyl esters of acrylic and methacrylic acids, acryl/and methacryl amides, acrylonitrile, acrylic and methacrylic acids, maleic or fumaric acids and alkyl esters of the same, vinyl and vinylidene chlorides, styrene and butadiene.

Due to the infinite number of possible combinations that they may form, the high molecular weight polymers can be classed into the following groups:

(a) Acrylic Latices (Cross-linking, Self-Cross Linking or Thermosetting Latices)

Acrylic latices are mainly homo- or co-polymers of alkyl esters of acrylic or methacrylic acids, and can also contain acrylic or methacrylic acid, acrylonitrile, acrylamide, n-methylol acrylamide, vinyl and vinylidiene chlorides and the like. The alkyl group of the esters can also contain hydroxyl groups. These types of polymers are referred to as cross-linking, self-cross linking or thermosetting latices. Examples of acrylic latices include Arotex®2416, Arotex®42, Latekoll®D and Flexcryl®1625 acrylic latices.

(b) Acrylonitrile Latices

Acrylonitrile latices have acrylonitrile as a major ingredient, which can exist as homo- or co-polymers. An example of acrylonitrile latice is ACRINAL®35D acrylonitrile latice.

(c) Vinyl Chloride Latices

Vinyl chloride latices have the monomer vinyl chloride homo- or co-polymerized as the major constituent. Examples of vinyl chloride latices include AIRLEX®4500, AIRLEX®4530 and AIRLEX®4514 vinyl chloride latices.

(d) Vinylidine Chloride Lattices

Vinylidine chloride lattices have the monomer vinylidine chloride homoor co-polymerized as the major constituent.

(e) ABS (Acrylonitrile-Butadiene-Styrene) Latices

ABS (acrylonitrile-butadiene-styrene) latices have the monomers acrylonitrile, butadiene and styrene as the principal constituents, which can be homo-polyinerized or co-polymerized with other monomers. An example of an acrylonitrile-butadiene-styrene latice is ACRINAL® S 504.

(f) SBR (Styrene-Butadiene-Rubber) Latices

SBR (styrene-butadiene-rubber) latices have the monomers styrene, butadiene and rubber as the principal constituents, which can be homo-polymerized or co-polymerized with other monomers. Examples of such latices include STYROFAN®4710 and STYRONAL®ND656 styrene-butadiene-rubber latices.

(g) Emulsion Polymers Prepared by Reacting Polyisocyanate with an Aliphatic Polyol Another group of emulsion polymers includes those obtained by the reaction of a polyisocyanate with an aliphatic polyol, which can be a polyether, a polyester, or a polycaprolactone. The preferred polyisocyanate for use in the reaction is a mixture of isomers of toluene diisocyanate, and the preferred aliphatic polyol for use in the reaction is a polyethylene glycol condensate having a molecular weight in excess of about 3,000, which is commonly referred to as a polyurethane latex.

The above-described monomers may be blended together to produce polymers having varying film properties, such as the following:

(a) Feel or Hand of Film

The "feel or hand of film" film property can vary from soft to hard, and from tacky to dry. These parameters can be evaluated by the glass transition temperature (T.G.) or, in some cases, by $T_{300}$ (temperature at which the torsional modulus of an air dried film is 300 kg/cm$^2$). Both of these temperatures are evaluated in ° C., and can generally range from about −100° C. to about +100° C. As a general rule, the lower the TG or $T_{300}$, the softer the film, with the film becoming harder with increasing temperatures.

(b) Solvent Swelling Resistance

The "solvent swelling resistance" film property relates to the durability of the film (and, therefore, of the flame retardant substances and of the substrate). Latices are known to swell when wetted with organic, especially chlorinated, solvents, generally resulting in a lack of durability, for example, to dry cleaning. The durability of the film can be improved by introducing cross-linkable sites into the molecule of the polymer. This can be accomplished by methods known by those of skill in the art.

(c) Film Strength

The strength of the film can be improved by increasing the molecular weight of the polymer by the introduction of crosslinkable sites which are made to react by heat and/or catalysts. This can be accomplished by methods known by those of skill in the art.

(d) Adhesion of Film

The adhesion of the film to a substrate is important because the durability of the flame retardant substances employed in the compositions of the invention will depend upon this film property.

The particle size of the one or more flame retardant substances, such as brominated organic compounds and halobrominated organic compounds, employed in the processes, systems and compositions of the invention, and mixed with the one or more adhesion agents, such as a natural or synthetic latex, can be of particular significance with respect to advantages derived in connection with flame retardancy and durability. An increased durability to washing and/or dry cleaning may be achieved when solid flame retardant substances having the particle size described below are employed in the processes, systems and compositions of the invention in contrast with the use of liquid, paste, wax or other forms of flame retardants, such as tris-dibromopropyl phosphate (a liquid which is available in a self-emulsifiable form as a fifty percent product in one or more solvent containing emulsifiers), as a result of the solid, particulate nature of the flame retardant substances. Such solid flame retardant substances have manifested a surprisingly and unexpectedly effective durability and flame retardancy in the practice of the processes, systems and compositions of the invention when employed in an average particle size preferably ranging from about 0.25 to about 70 microns, and more preferably ranging from about 2 to about 10 microns, with about 10 microns being most preferred. It has been discovered, additionally, that in the treatment of fibrous substrates, such as the cellulosic and protein or polypeptide substrates described elsewhere herein, and particularly cotton and wool, that the utilization of a brominated flame retardant having an average particle size preferably ranging from about 0.25 to about 70 microns, and more preferably ranging from about 2 to about 10 microns, with about 10 microns being most preferred, results in a fabric having a very effective flame retardancy in the presence of an open or other flame or fire.

In one preferred embodiment of the processes, systems and compositions of the invention for flame retarding non-thermoplastic or other substrates, such as fibers, fibrous compositions or fabrics, from about 0.5 to about 90 weight percent of one or more flame retardant substances is dissolved in from about 0.5 to about 70 of water with mild agitation. To this solution, from about 0.5 to about 70 weight percent of a natural or synthetic latex (as an adhesion agent) containing from about 35 to about 65 weight percent, and preferably from about 45 to about 55 weight percent, of a high molecular weight polymer is added. At this point, any other needed or desired auxiliaries, such as stability enhancing agents, viscosity enhancing agents (thickeners), wetting agents, pigments, fillers, plasticizers, catalysts and the like, can be incorporated in any required or desired proportion, and the solution mixed. In treating hydrophobic substrates, it is preferably that from about 0.1 to about 0.15 weight percent, and preferably from about 2 to about 5 weight percent, of a wetting agent is added to the mixture. This treatment batch of composition can be applied to non-thermoplastic or other substrates, such as fibers, fibrous compositions or fabrics using any of the different techniques described herein.

The above treating solution, and other compositions of the invention, can be applied to one or more non-flame retardant or other woven or nonwoven substrates containing at least about 5%, and preferably about 20%, non-thermoplastic material, such as non-thermoplastic fibers, fibrous compositions and/or fabrics, by any convenient way, such as padding, coating, printing, saturation and the like. The resulting substrates, which are generally wet, may have excess composition removed therefrom, be rinsed and have excess rinse liquid removed therefrom. They are then dried as described above.

In a continuous dye type operation, non-flame retardant or other woven or non-woven substrate containing at least about 20 weight percent non-thermoplastic material to be treated can be dipped into a flame retarding composition of the invention, such as a solution, and the excess composition can be removed by squeezing the substrate between two rollers, or using other methods known by those of skill in the art. The excess composition can be transferred to a separate holding vessel, and can be reused in the next application, or in one or more other subsequent applications of the composition to one or more other substrates (the same or different), since it generally does not contain any dye or other agents, substances or compositions that would contaminate the process or system. Solid and other components of the flame retardant compositions can be adjusted to the original level, as described hereinabove. The substrates, such as fibers, fabrics or fibrous compositions, can now be air dried or dried in an oven or other similar type of equipment at a temperature, for example, ranging from about 80° C. to about 130° C. for a period of time ranging from about ½ to about 5 minutes, or from about 100° C. to about 110° C. for a period of time ranging from about ½ to about 3 minutes.

Exemplary "Closed Loop" System of the Invention

For the purpose of illustrating the processes and systems of the present invention, there is shown in FIG. 1, which form a material part of this disclosure, an exemplary and preferred "closed loop" system of the invention, which provides a preferred manner for performing the processes of the invention.

The various components or parts of the exemplary "closed loop" system of the invention shown in FIG. 1 may be generally arranged in the manner shown therein, or described hereinbelow, or otherwise. The present invention, however, is not limited to the precise arrangements, configurations, dimensions, instrumentalities, components, numbers of components, flow directions or conditions shown in FIG. 1, or described herein. These arrangements, configurations, dimensions, instrumentalities, components, numbers of components, flow directions and/or conditions may be otherwise, as circumstances require or are desired. For example, fewer or additional feed lines, pumps, valves, mix tanks, collection tanks, dye machines, centrifuges, control panels, substrate baskets, sources of water, sources of components of the flame retardant compositions, or other components shown in FIG. 1 or described herein, such as one or more optional filters, may be employed. Further, these components or parts may be arranged in a wide variety of different manners or configurations. The location of the various components or parts of the "closed loop" systems, and the means employed for attaching one or more components, parts and/or areas of the systems to one or more other components, parts and/or areas of the systems, may also be varied. Moreover, various components, parts and/or areas of the systems may be either permanently, or removably, attached with other components, parts and/or areas of the systems, and may be movable or not movable. Removably attached components and parts are often preferable because such components and parts may generally be replaced in a simpler and more cost-effective manner in the event that they become worn, damaged or destroyed.

Referring to FIG. 1, there is shown in FIG. 1 a preferred "closed loop" system of the invention ("system"), which is indicated generally by the number 10. The system 10 has two separate dye machines (32 and 34), and a separate treatment program (Phase 1 or Phase 2) for each of the two dye machines (32 and 34), as described in more detail below. Other components of this system include two separate mix tanks (28 and 30), seven pumps (36, 38, 40, 42, 44, 46 and 48), eight valves (50, 52, 54, 56, 58, 60, 62 and 64), fifteen lines (68, 70, 72, 74, 76, 78, 80, 82, 86, 88, 92, 96, 100, 104 and 106), two separate centrifuges (12 and 14), three separate collection tanks (16, 18 and 20) and three separate control panels (22, 24 and 26). The arrows set forth in FIG. 1 show the travel direction of substances employed in the system 10 (water, flame retardant compositions and the like). The symbols that are attached to the third valve 54 and fifth valve 58 indicate that waste material, such as flame retardant composition that is no longer desired for use, that becomes contaminated and/or that is otherwise to be discarded can travel out of these valves to a drain (not shown) for disposal.

All of the chemical compounds, agents, substances and compositions, such as the flame retardant substances, adhesion agents, aqueous liquid and optional stability enhancing agents, viscosity enhancing agents and wetting agents, and all of the application rates, employed in the system 10 shown in FIG. 1 are used in the weight percents, or application rates, described herein. The specific quantities of these items, such as water, that may be employed in the system 10 may vary depending upon a variety of factors, such as the size of the collection tanks, dye machines and mix tanks that are employed. Those of skill in the art know how to vary the quantities of these items depending upon the size of the various devices, apparatuses, and the components thereof, that are employed in the system 10.

The term "recycled" as used in connection with flame retardant composition employed in the system 10 means flame retardant composition that has previously been used at least one time in the system 10 to separately treat one or more of the same or different substrates.

The sources of (or means for containing) water that are shown in FIG. 1 (66, 84, 98 and 108), and that may be employed in the processes and systems of the invention, may be the same or different sources of water, and need not be pretreated in any manner. They may be, for example, one or more water lines of a municipal or other water system. Likewise, the sources of (or means for containing) chemicals that are shown in FIG. 1 (90, 94 and 102), and that may be employed in the processes and systems of the invention, may be the same or difference sources of chemicals.

One operation of the system 10 may include one or more (and usually several) cycles (a repetition of the process). Each cycle of the system 10 may include one or more phases, such as Phase 1 and Phase 2 described below.

When an operation of the system 10 shown in FIG. 1 is commenced, the components of the system 10 (mix tanks, collection tanks, centrifuges, dye machines, feed lines and the like) are generally empty.

To initiate the first phase of the first cycle of the system 10 (if two or more phases are employed, which will generally be phase 1), or to initiate the first cycle of the system 10 (if only one phase is employed), but not subsequent phases or cycles of the system 10, the third collection tank 20 is generally filled with untreated tap water. The water travels to the third collection tank 20 from a source of water 84 through an eighth line 82 (or through another means for allowing water to travel from a source of water to the third collection tank 20). Chemicals (flame retardant substances, adhesion agents, aqueous liquid, optional stability enhancing agents, viscosity enhancing agents, wetting agents, and the like) are also added to the third collection tank 20. If the chemicals are in a liquid form, they may travel to the third collection tank 20 from one or more sources of chemicals 90 (or other means for containing chemicals) through an eleventh line 92 (or through another means for allowing one or more chemicals to travel from a source of chemicals to the third collection tank 20). If the chemicals are in a solid form, such as a powder, they may be added to the third collection tank 20 manually. When more than one type of chemical is employed in the system 10, such as flame retardant substances and adhesion agents, each of the different types of chemicals will preferably be contained in a separate means for containing chemicals, such as separate chemical storage tanks. However, when the chemicals employed are in liquid form, a premix of chemicals can be formed, and contained in a means for containing such premix. The premix of chemicals may be added to the third collection tank 20, rather than quantities of individual chemicals. A sufficient amount of water and chemicals are added to the third collection tank 20 (in any order) to achieve a desired concentration of flame retardant composition for the treatment of substrates, such as fibers, to be treated. It is only during the first phase of the first cycle (or during the first cycle if only one phase is being employed) of the system 10 that water and chemicals are added to the third collection tank 20. After this first phase or cycle, flame retardant composition that has been recycled from the first dye machine 32 and/or the second dye machine 34 will generally travel to the third collection tank 20 (from the first and second centrifuges 12 and 14 via line 76), where it will generally be added to flame retardant composition that has initially been produced in the third collection tank 20 (at the start of the phase of the first cycle of the system 10), but that has not traveled from the first collection tank 20 to the first mix tank 28 or to the second mix tank 30 during one or more cycles of the system 10. No water or chemicals will generally travel to the third collection tank 20 from the source of water 84 or the source of chemicals 90.

Flame retardant composition that is recycled after each of one or more treatment cycles of the system 10 (whether a cycle of Phase 1 or Phase 2) will generally have the same concentrations and weight percents of chemicals (flame retardant substances, adhesion agents, aqueous liquid, optional stability enhancing agents, viscosity enhancing agents, wetting agents, and the like) as the flame retardant composition that is initially produced in the third collection tank 20 (at the start of the first cycle of the system 10).

The third collection tank 20 preferably will initially contain, and thereafter maintain (as a result of receiving "recycled" flame retardant composition from the first and second collection tanks, 16 and 18, which collect "recycled" flame retardant composition from the first and second centrifuges 12 and 14, respectively), a volume of flame retardant composition that is about two and a half times the total amount of flame retardant composition that travels into it from the first and second collection tanks, 16 and 18. In the system 10 shown in FIG. 1, it generally takes about 30 minutes (total) for the first centrifuge 12 and the second centrifuge 14 to extract excess flame retardant composition from treated substrates. Thus, by maintaining the volume of flame retardant composition described above in the third collection tank 20, Phase 2 of the system 10 is permitted to commence prior to the termination of Phase 1 of the system 10 (prior to the two centrifuges, 12 and 14, extracting flame retardant composition from treated substrates).

Phase 1

In Phase 1 of the system 10, a first dye machine 32 (or another means for applying flame retardant composition to one or more substrates), preferably has two baskets containing substrates, for example, from about 1,600 to about 2,200 fibers (total), loaded into the machine 32. Using a first control panel 22, which includes a PLC computer (not shown), and which is a component of the first dye machine 32, according to the recommendations of the manufacturer (or using another means for initiating or terminating the operation of, and/or controlling and/or monitoring, the first dye machine 32, or another application device), an operator may then initiate the treatment program of the first dye machine 32. A pump 40 (or another means for causing flame retardant composition to travel or flow from the third collection tank 30 to one or more other locations in the system 10) causes about 250 gallons of flame retardant composition to travel from the third collection tank 20 (or from another means for containing flame retardant composition) into a first line 68 (or into another means for permitting flame retardant composition to travel from the third collection tank 20 to one or more other locations in the system 10) though a valve 62 (or through another means for initiating, terminating and/or controlling the flow of flame retardant composition into a first mix tank 28) and into the first mix tank 28 (or into another means for containing, or permitting the mixing of, components of flame retardant compositions), which preferably has a level sensor (not shown), or another means for monitoring and/or controlling the level of the flame retardant composition in the first mix tank 28. When the level of the flame retardant composition reaches a desired level, which may be detected by the level sensor (not shown), then the seventh valve 62 closes, preventing additional flame retardant composition from traveling into the first mix tank 28.

Separately, the operator adds (either manually or automatically) a sufficient amount of chemicals (flame retardant substances, adhesion agents, optional stability enhancing agents, viscosity enhancing agents, wetting agents and the like) and water to aid in the creation (along with flame retardant composition that was produced in the third collection tank 20 at the start of the operation of the system 10, and that enters the first mix tank 28 via the first line 68 from the third collection tank 20) of a first "mother solution" in the first mix tank 28. If the chemicals are in a liquid form, they may travel to the first mix tank 28 from one or more sources of chemicals 94 (or other means for containing chemicals) through a twelfth line 96 (or through another means for allowing one or more chemicals to travel from a source of chemicals to the first mix tank 28). If the chemicals are in a solid form, such as a powder, they may be added to the first mix tank 28 manually. When more than one type of chemical is employed in the system 10, each of the different types of chemicals will preferably be contained in a separate means for containing chemicals, such as separate chemical storage tanks. However, when the chemicals employed are in liquid form, a premix of chemicals can be formed, in a similar manner as is described hereinabove. The water may travel through a thirteenth line 100 (or through another means for permitting water to travel from a source of water to the first mix tank 28) into the first mix tank 28 from a source of water 98 (or from another means for containing water). A sufficient amount of water and chemicals are added to the first mix tank 28 (in any order) to achieve a desired concentration of a first "mother solution."

The first "mother solution," which will generally only be employed in the first phase (Phase 1) of the first cycle of the system 10, is a concentrated flame retardant composition (having a higher concentration of flame retardant substances, adhesion agents and optional components in comparison with the flame retardant compositions that are employed in the first and second dye machines, 32 and 34, and that are in the third collection tank 20) that contains flame retardant composition initially produced in the third collection tank 20, water from the source of water 98 and chemicals from the source of chemicals 94. It does not contain any "recycled" flame retardant composition (because no flame retardant composition has yet been recycled at this point in the operation of the system 10). The first "mother solution" should have a sufficient amount of water, flame retardant substances, adhesion agents and, optionally, other components added to the flame retardant composition that enters into the first mix tank 28 from the third collection tank 20 to achieve a concentrated flame retardant composition, which can be diluted to desired flame retardant composition weight percents and concentrations in the first dye machine 32 by the addition of water.

In subsequent cycles of Phase 1 of the system 10, the first "mother solution" will be generally created in the same manner as described above. However, in these subsequent cycles of the system 10, the flame retardant composition that travels into the first mix tank 28 from the third collection tank 20 will generally either be "recycled" flame retardant composition (flame retardant composition that is removed from treated substrates by the first and second centrifuges, 12 and 14) or a combination of "recycled" flame retardant solution and flame retardant solution initially produced in the third collection tank 20. It does not, however, contain "recycled" flame retardant composition received directly from the second dye machine 34.

A pump 42 (or another means for causing the first "mother solution" to travel or flow from the first mix tank 28 into the first dye machine 32) causes about 350 gallons of the first "mother solution" to travel from the first mix tank 28 into a second line 70 (or into another means for permitting the first "mother solution" to travel from the first mix tank 28 into the first dye machine 32) and into the first dye machine 32 (or into another means for applying flame retardant composition to one or more substrates).

Tap water (not pretreated) that preferably has a temperature ranging from about 50° F. to about 80° F. (from about 10° C. to about 27° C.) flows under pressure from a source of (or means for containing) water 66 into a third line 72 (or into another means for permitting water to travel from the source of water to the first dye machine 32) and through a valve 50 (or another means for permitting, terminating and/or controlling the flow of water into the first dye machine 32, or into another application device), and then into the first dye machine 32. Generally, water will be added to the first dye machine 32 in an amount that, along with first "mother solution" that has entered therein, causes the first dye machine 32 to be full, thereby diluting the first "mother solution" that has entered into it from the first mix tank 28, and achieving the desired concentrations and weight percents of the various components present in the flame retardant composition employed to treat the substrates. Via a pump (not shown) that is present in the first dye machine 32, and the operation of the first dye machine 32 using the first control panel 22, the flame retardant composition that is present in the first dye machine 32 is then generally circulated around and through the substrates, such as fibers, preferably completely impregnating (penetrating) the substrates.

After the flame retardant composition has been caused to circulate around and through the substrates for a period of time that is sufficient to impregnate the substrates, which is generally from about 30 minutes to about 60 minutes, a valve 54 (or another means for permitting, terminating or controlling the flow of flame retardant composition into a fourth line 74), which will have been closed, opens, and permits flame retardant composition to travel into the fourth line 74.

A pump 46 (or another means for causing flame retardant composition to travel or flow from the first dye machine 32 to the second dye machine 34) causes the flame retardant composition that was present in the first dye machine 32, and that was used to treat the substrates, to travel from the first dye machine 32 through valve 54 and valve 56 (or through another means for permitting, terminating or controlling the flow of flame retardant composition into the second dye machine 34) and into the second dye machine 34 (or another means for applying flame retardant composition to one or more substrates). Once the first dye machine 32 becomes completely empty, valve 54 and valve 56 each close, and pump 46 is turned "off." This represents the end of an application cycle for the first dye machine 32, but not the end of Phase 1 of the system 10. The substrates that are present in the first dye machine 32 are not rinsed.

Once flame retardant composition has traveled from the first dye machine 32 to the second dye machine 34 (through line 74), Phase 2 of the system, which is optional, can commence (even though the remainder of Phase 1 of the system 10 has not yet been completed), as described hereinbelow.

Using a lifting device, preferably a crane, the baskets containing the substrates that are present in the first dye machine 32 are then separately transferred into a first centrifuge 12 and into a second centrifuge 14 (or into other means for removing excess flame retardant solution from the substrates), with one basket being placed into the first centrifuge 12 and the other basket being placed into the second centrifuge 14. The first and the second centrifuges, 12 and 14, are then turned "on" by the operator, and preferably operated at about 750 rpm until excess flame retardant composition has been removed from the substrates, which generally takes about 30 minutes. However, other centrifuge speeds may be employed. During this approximately 30-minute centrifuge process, Phase 2 of the system 10 may also be in operation. Excess flame retardant composition resulting from the first centrifuge 12 flows by gravity into a ninth line 86 (or into another means for allowing excess flame retardant composition to travel from the first centrifuge 12 to the first collection tank 16), and then into a first collection tank 16 (or another means for collecting and/or containing flame retardant composition from the first centrifuge 12), and excess flame retardant solution resulting from the second centrifuge 14 flows by gravity into a tenth line 88 (or into another means for allowing excess flame retardant composition to travel from the second centrifuge 14 to a second collection tank 18), and then into the second collection tank 18 (or into another means for collecting and/or containing flame retardant composition from the second centrifuge 14).

A pump 36 (or another means for causing flame retardant composition to travel or flow from the first collection tank 16 to the third collection tank 20) causes the flame retardant composition that is present in the first collection tank 16 to travel into a fifth line 76 (or into another means for permitting flame retardant composition to travel from the first collection tank 16 to the third collection tank 20), and then into the third collection tank 20, and a pump 38 (or another means for causing flame retardant composition to travel or flow from the second collection tank 18 to the third collection tank 20) causes the flame retardant composition that is present in the second collection tank 18 to travel into the fifth line 76, and then into the third collection tank 20. This represents the end of Phase 1 of the treatment program, which can now be repeated one, two, three or more times (an indefinite number of times) independently, or in connection with Phase 2 of the treatment program. The two baskets containing the substrates that are present in the first centrifuge 12 and in the second centrifuge 14 can then be removed from the centrifuges (12 and 14) and dried in the manner described herein.

In the process described above for Phase 1 of the system 10, flame retardant composition employed to treat substrates in the first dye machine 32 is "recycled" in two different manners. First, excess flame retardant composition present in the first dye machine 32 travels from the first dye machine 32 into the second dye machine 34 (quantity X). Second, excess flame retardant composition that is removed from substrates treated in the first dye machine 32 by the first and second centrifuges, 12 and 14, travels into the third collection tank 20 (quantity Y). Quantity X of flame retardant solution will travel into the second dye machine 34 via line 74. Quantity Y of flame retardant solution will travel into the second mix tank 30 via line 68. Some of the flame retardant composition that is initially produced in the first dye machine 32 (quantity W) will generally become depleted as a result of treating substrates (quantity Z). Thus, the amount of flame retardant composition that has been depleted during a cycle of Phase 1 of the system 10 (quantity Z) will generally be added back to the system 10 at the start of Phase 2 of the system 10. This will generally occur in the second dye machine 34 as a result of a second "mother solution" flowing therein from a second mix tank 30, as is described below. In the foregoing description, X+Y+Z=W.

Phase 2

In Phase 2 of the system 10, which generally commences after a portion of one cycle of Phase 1 of the system 10 has been completed (generally just before flame retardant composition travels from the first dye machine 32 to the second dye machine 34), the second dye machine 34 (or another means for applying flame retardant composition to one or more substrates) preferably has two baskets containing substrates, for example, from about 1,600 to about 2,200 fibers (total), loaded into the machine 34.

After about 800 gallons of "recycled" flame retardant composition flows out of the first dye machine 32 and into the second dye machine 34, an operator may start the treatment program of the second dye machine 34 using a third control panel 26, which also includes a PLC computer (not shown), and which is a component of the second dye machine 34, according to the recommendations of the manufacturer (or using another means for initiating or terminating the operation of, and/or controlling and/or monitoring, the second dye machine 34, or other application device).

A second control panel 24, which also includes a PLC computer, has an interface between the first control panel 22 and the third control panel 26, and coordinates Phase 1 and Phase 2 of the system (when both phases are employed), particularly the "recycling" of flame retardant composition, using input and output data received from the first and third control panels, 22 and 26. The second control panel 24 does not control the first dye machine 32 or the second dye machine 34, but controls the transfer of flame retardant composition from the first dye machine 32 to the second dye machine 34, and from the second dye machine 34 to the first dye machine 32. The second control panel 24 need not be used when Phase 2 of the system 10 is not employed.

The third pump 40 causes about 350 gallons of "recycled" flame retardant composition resulting from the centrifugation of substrates treated in the first dye machine 32 (or a combination of initially produced flame retardant composition and "recycled" flame retardant composition) to travel from the third collection tank 20 though the first line 68, and through valve 64 (or through another means for initiating, terminating and/or controlling the flow of flame retardant composition into a second mix tank 30) and into a second mix tank 30 (or into another means for containing, or permitting the mixing of, components of flame retardant composition), which also preferably has a level sensor (not shown), or another means for monitoring and/or controlling the level of flame retardant composition in the second mix tank 30. When the level of the flame retardant composition reaches the desired level, which may be detected by the level sensor (not shown), then valve 64 closes, preventing additional flame retardant composition from traveling into the second mix tank 30. Generally, after the first cycle of Phase 1 of the system 10, within the same operation of the system 10, which may include one or more cycles of Phase 1 and one or more cycles of Phase 2, the same amount of "recycled" flame retardant composition will travel from the third collection tank 20 into the second mix tank 30 (for a cycle of Phase 2 of the system 10), and into the first mix tank 28 (for a cycle of Phase 1 of the system 10).

Separately, the operator adds (either manually or automatically) a sufficient amount of chemicals (flame retardant substances, adhesion agents, optional stability enhancing agents, viscosity enhancing agents, wetting agents and the like) and water to aid in the creation (along with "recycled" flame retardant composition entering into the second mix tank 30 via the first line 68 from the third collection tank 20 after a prior cycle of the first dye machine 32) of a second "mother solution" in the second mix tank 30. If the chemicals are in a liquid form, they may travel to the second mix tank 30 from one or more sources of chemicals 102 (or other means for containing chemicals) through a fourteenth line 104 (or through another means for allowing one or more chemicals to travel from a source of chemicals to the second mix tank 30). If the chemicals are in a solid form, such as a powder, they may be added to the second mix tank 30 manually. When more than one type of chemical is employed in the system 10, each of the different types of chemicals will preferably be contained in a separate means for containing chemicals, such as separate chemical storage tanks. However, when the chemicals employed are in liquid form, a premix of chemicals can be formed, in a similar manner as is described hereinabove. The water may travel through a fifteenth line 106 (or through another means for permitting water to travel from a source of water to the second mix tank 30) into the second mix tank 30 from a source of water 108 (or from another means for containing water). A sufficient amount of water and chemicals are added to the second mix tank 30 (in any order) to achieve a desired concentration of a second "mother solution."

The second "mother solution" is a concentrated flame retardant composition (having a higher concentration of flame retardant substances, adhesion agents and optional components in comparison with the flame retardant compositions that are employed in the first and second dye machines, 32 and 34) that contains "recycled" flame retardant composition traveling from the third collection tank 20 to the second mix tank 30 (as described above), and that has sufficient water, flame retardant substances, adhesion agents and, optionally, other components added to the flame retardant composition that enters from the third collection tank 20 to the second mix tank 30 to achieve a concentrated flame retardant composition, which can be diluted to the desired flame retardant composition weight percents in the second dye machine 34 by combining with flame retardant composition present in the second dye machine 34 (that traveled therein from the first dye machine 32 via line 74) and, if necessary, by the addition of water.

In contrast with the second "mother solution," the first "mother solution," which is generally only employed one time during the operation of the system 10 (during the first cycle of Phase 1 of the system 10), is not combined with flame retardant composition traveling to the first dye machine 32 from the second dye machine 34. The first "mother solution" is mixed only with water in the first dye machine 32 (only during the first cycle of Phase 1 of the system 10). The second "mother solution" will generally contain a smaller quantity of chemicals (flame retardant substances, adhesion agents and optional components) in comparison with the first "mother solution." Because the second "mother solution" combines with flame retardant composition present in the second dye machine 34, which already contains chemicals, rather than with water only, as occurs during the first cycle of Phase 1 of the system 10, the second "mother solution" will generally require a smaller quantity of chemicals to achieve the concentration of flame retardant composition desired in the second dye machine 34, and desired in the first dye machine 32 (which two concentrations will generally be the same). After the first cycle of Phase 1 of the system, the "mother solution" employed in the first mix tank 28 and in the second mix tank 30 will generally be the same (have the same concentration of chemicals), and will have the concentration of the second "mother solution" described above, not of the first "mother solution." The second "mother solution" will generally be different from the first "mother solution," which should be more concentrated. Also, the second "mother solution" will generally contain the same chemicals, and the same quantities thereof, during the different cycles of Phase 1 and Phase 2 of the same operation of the system 10 (after a first cycle of Phase 1 of the system 10 has been completed).

Within the same operation of the system 10 (an operation of one or more cycles of Phase 1 and/or Phase 2), the components of the flame retardant compositions employed in the first dye machine 32 and in the second dye machine 34, and the weight percents thereof, will generally be approximately the same. The components employed in different operations of the system 10 (different operations of one or more cycles of Phase 1 and/or Phase 2), and the weight percents thereof, may be varied. However, such components, and their weight percents, will generally be approximately the same in each of the dye machines employed in the same operation of the system 10.

A pump 44 (or another means for causing the second "mother solution" to travel or flow from the second mix tank 30 to the second dye machine 34) causes about 350 gallons of the second "mother solution" to travel from the second mix tank 30 into a sixth line 78 (or into another means for permitting the second "mother solution" to travel from the second mix tank 30 to the second dye machine 34) and into the second dye machine 34 (or into another means for applying flame retardant composition to one or more substrates), where flame retardant composition received from the first dye machine 32 is present.

Tap water (not pretreated) that preferably has a temperature ranging from about 50° F. to about 80° F. flows under pressure from a source of (or means for containing) water 66 into the third line 72 and through valve 60 (or through another means for permitting, terminating or controlling the flow of water into the second dye machine 34), and then into the second dye machine 34. Generally, water will be added to the second dye machine 34 in an amount that, with the quantity of the second "mother solution" and the flame retardant composition that is already present in the second dye machine 34, causes the second dye machine 34 to be full, thereby diluting the second "mother solution" and such flame retardant composition, creating new flame retardant composition. The second dye machine 34 will, thus, generally contain both "recycled" flame retardant composition from the first dye machine 32 and new flame retardant composition (made by diluting the second "mother solution" with water), which will combine to achieve the desired weight percents of the various components present in the flame retardant composition employed to treat the substrates. Via a pump (not shown) that is present in the second dye machine 34, and the operation of the second dye machine 34 with the use of the third control panel 26, the flame retardant composition that is present in the second dye machine 34 is then circulated around and through the substrate, such as fibers, preferably completely impregnating (penetrating) the substrate.

After the flame retardant composition has been caused to circulate around and through the substrates for a period of time that is sufficient to impregnate the substrates, which is preferably from about 30 minutes to about 1 hour, a fifth valve 58 (or another means for permitting, terminating or controlling the flow of flame retardant composition into a seventh line 80), which will have been closed, is opened, and permits flame retardant composition to travel into the seventh line 80.

A pump 48 (or another means for causing flame retardant composition to travel or flow from the second dye machine 34 to the first dye machine 32) causes the flame retardant composition that was present in the second dye machine 34, and that was used to treat the substrates, to travel from the second dye machine 34 through valve 58 and valve 52 (or through another means for permitting, terminating or controlling the flow of flame retardant composition into the first dye machine 32) and into the first dye machine 32. Once the second dye machine 34 becomes completely empty, valve 58 and valve 52 close, and pump 48 is turned "off." This represents the end of an application cycle for the second dye machine 34, but not the end of Phase 2 of the system 10. (The substrates that are present in the second dye machine 34 are not rinsed.)

Once flame retardant composition has traveled from the second dye machine 34 to the first dye machine 32 (through line 80), another cycle of Phase 1 of the system can commence (even though the remainder of Phase 2 of the system 10 has not yet been completed). This next cycle of Phase 1 of the system, and other cycles of Phase 1 and/or Phase 2 of the same operation of the system 10, may occur in the same manner described above for Phase 2 of the system. (Only the first cycle of the first phase of the system, which could be Phase 1 or Phase 1, is somewhat different, as is described hereinabove.)

Using a lifting device, preferably a crane, the baskets containing the substrates that are present in the second dye machine 34 are then separately transferred into the first centrifuge 12 and into the second centrifuge 14 (one basket in the first centrifuge 12 and the other basket in the second centrifuge 14) in the manner described hereinabove in connection with Phase 1. The first and the second centrifuges, 12 and 14, are then turned "on" by the operator, and preferably are operated at the same speed, and in the same manner, described above in connection with Phase 1 of the system 10 until excess flame retardant composition has been removed from the substrates. Excess flame retardant solution resulting from the first centrifuge 12 may then be collected in the first collection tank 16, and excess flame retardant solution resulting from the second centrifuge 14 may then be collected in the second collection tank 18, in the manner described above in connection with Phase 1 of the system 10. Pump 36 causes the flame retardant solution that is present in the first collection tank 16 to travel into the third collection tank 20, and pump 38 causes the flame retardant solution that is present in the second collection tank 18 to travel into the third collection tank 20. This represents the end of Phase 2 of the treatment program, which can now be repeated one, two, three or more times (an indefinite number of times) independently, or in connection with Phase 1 of the treatment program.

The two baskets containing the substrates that are present in the first centrifuge 12 and in the second centrifuge 14 can then be removed from the centrifuges (12 and 14) and dried in the manner described hereinabove.

In the process described above for Phase 2 of the system 10, flame retardant composition employed to treat substrates in the second dye machine 34 is also "recycled" in two different manners. First, excess flame retardant composition present in the second dye machine 34 travels from the second dye machine 34 into the first dye machine 32 (quantity X). Second, excess flame retardant composition that is removed from substrates treated in the second dye machine 34 by the first and second centrifuges, 12 and 14, travels into the third collection tank 20 (quantity Y). Quantity X of flame retardant solution will travel into the first dye machine 32 via line 80. Quantity Y of flame retardant solution will travel into the first mix tank 28 via line 68. Some of the flame retardant composition that is initially produced in the second dye machine 34 (quantity W) will generally become depleted as a result of treating substrates (quantity Z). Thus, the amount of flame retardant composition that has been depleted during a cycle of Phase 2 of the system 10 (quantity Z) will be added back to the system 10 at the start of the next cycle of Phase 1 of the system 10. This will generally occur in the first dye machine 32 as a result of a second "mother solution" flowing therein from a first mix tank 28 in the same manner as is described above in connection with Phase 2 of the system 10. In the foregoing description, X+Y+Z=W.

The two phases of the treatment program shown in FIG. 1 can be carried out consecutively (as described above), or only one or the other of the two phases may be carried out. Alternatively, either the first dye machine 32 or the second dye machine 34 can be employed as a flame retardant composition storage tank, rather than being used as a machine for applying flame retardant composition to one or more substrates. In this situation, no baskets of substrates will be loaded into the dye machine (either the first dye machine 32 or the second dye machine 34) that is being used as a storage tank. If the first dye machine 32 is employed as a storage tank, flame retardant composition will be transferred (via line 74 and through valves 54 and 56) into the second dye machine 34 as it is needed or desired. If the second dye machine 34 is employed as a storage tank, flame retardant composition will be transferred (via line 80 and through valves 58 and 52) into the first dye machine 32 as it is needed or desired.

An alternative to adding chemicals to the first mix tank 28 via line 96, and to the second mix tank 30 via line 104, would be to add the chemicals directly to the first dye machine 32 and/or the second dye machine 34, respectively. However, it would likely be necessary to have the first and/or second "mother solutions" be less concentrated because, in this situation, less water would be able to travel into the first dye machine 32 from the source of water 66 and/or into the second dye machine 34 from the source of water 66, causing the resulting flame retardant compositions to be more concentrated.

Another alternative to adding chemicals to the first mix tank 28 via line 96, and to the second mix tank 30 via line 104, would be to permit the third collection tank 20 to function as both a means for containing water and chemicals, and a means for mixing together water and chemicals, and eliminate from the system 10 some or all of the following optional components: (a) the source of chemicals 94, and line 96; (b) the source of water 98, and line 100; (c) the first mix tank 28, and line 70; (d) the source of chemicals 102, and line 104; (e) the source of water 106, and line 108; and (f) the second mix tank 30, and line 78. In this manner, flame retardant composition produced in the third collection tank 20 could travel through line 68 directly into the first dye machine 32 and/or into the second dye machine 34, eliminating the requirement for two separate mix tanks, 28 and 30. In this situation, no "mother solutions" would generally need to be created or employed in the system 10, and no water would generally need to be added to the first dye machine 32 or the second dye machine 34 from the source of water 66 (because water would not be necessary for the dilution of any mother solutions). Alternatively, a more concentrated flame retardant composition than the flame retardant composition to be employed to treat substrates in the first dye machine 32 and/or second dye machine 34 could be created in the third collection tank 20, and such flame retardant composition could be diluted with water from the source of water 66 in the first dye machine 32 and/or in the second dye machine 34 in the manner described hereinabove in connection with Phase 1 and Phase 2 of the system 10.

As they are described above, Phase 1 and Phase 2 of the system 10 do not generally operate completely simultaneously, but generally operate only partially simultaneously, and have generally alternating cycles. However, another alternative to the system 10, which would permit Phase 1 and Phase 2 to operate simultaneously, would be to have one or more means for containing flame retardant solution connected with the first dye machine 32 and/or with the second dye machine 34 in a manner that flame retardant composition that has been employed to treat substrates after a cycle of Phase 1 can drain from the first dye machine 32 into such means for containing flame retardant composition, and after a cycle of Phase 2 can drain from the second dye machine 34 into the means for containing flame retardant composition.

The flow rates, temperatures, pressures and times employed in the "closed loop" system shown in FIG. 1 can be varied widely, depending upon the type and amount of substrate employed, the type and amount of flame retardant composition employed, the type of dye machines employed and other like considerations. However, those of skill in the art will know how to determine the foregoing and other conditions required or desired.

Any type of the same or different dye machines, which are commercially available, may be employed in the "closed loop" system shown in FIG. 1, and in other "closed loop" systems of the invention (containing one, two, three or more phases). The dye machines may be operated in accordance with recommendations of the manufacturer, and in a manner known by those of skill in the art to achieve the goals and results described herein.

Specific preferred embodiments of the flame retardant compositions, processes and systems of the present invention, as well as other aspects of the invention, are described and illustrated in the following non-limiting examples. The scope of the invention is not limited, however, to the specific compositions, processes and systems set out in these examples. These examples are intended to be merely illustrative of the flame retardant compositions, processes and systems of the present invention, and not limiting thereof in either scope or spirit.

All of the substances, agents, materials, components and equipment that are employed to carry out the processes and systems of the invention, and that are employed to make the compositions and treated substrates of the invention, and all of the substances, agents, materials, components and equipment that are employed to carry out the examples, are commercially available from sources known by those of skill in the art. Sources for these materials include those appearing hereinabove, as well as Troy Chemical Corporation (Newark, N.J.), U.S. Borax, Inc. (Valencia, Calif.), Sigma Chemical Co. (St. Louis, Mo.), Aldrich Chemical Co. (Milwaukee, Wis.), Fisher Scientific (Pittsburgh, Pa.), Boehringer Mannheim (Indianapolis, Ind.), Fluka Chemical Corp. (Ronkonkoma, N.Y.), Chemical Dynamics Corp. (South Plainfield, N.J.), Church & Dwight Co., Inc. (Princeton, N.J.), Tomah Products, Inc. (Milton, Wis.) and Niacet Corp. (Niagara Falls, N.Y.).

Specific processes, systems, compositions and treated substrates within the scope of the invention include, but are not limited to, the processes, systems, compositions and treated substrates discussed in detail herein. Contemplated equivalents of the processes, systems, compositions and treated substrates of the present invention include processes, systems, compositions and treated substrates that otherwise correspond thereto, and that have the same general properties, components and/or steps thereof, wherein one or more simple or other variations of components, materials, times, temperatures, pressures, application rates, steps or like variables are made.

The following examples describe the preparation and testing of compositions within the present invention. These examples are intended to be merely illustrative of the present invention, and not limiting thereof in either scope of spirit. Those of skill in the art will readily understand that variations of certain of the conditions, materials and/or steps employed in the procedures described in the examples can be used to prepare and test these compositions.

Parts and percentages described in the examples are by weight, unless otherwise indicated.

EXAMPLE 1

Treatment of Non-Thermoplastic Flax Fiber

About 30 parts by weight (38 weight percent) of liquid ammonia (fire retardant substance) was slowly mixed using a variable speed laboratory mixer with 50 parts by weight (62 weight percent) of phosphoric acid (fire retardant substance) at ambient temperature for 15 minutes in a beaker. Then, about 65 parts by weight (65 weight percent) of the resulting mixture product was slowly mixed with 80 part by weight (25 weight percent) of tap water and 10 part by weight (10 weight percent) of diethylene glycol (adhesion agent) for 15 minutes at ambient temperature using a variable speed laboratory mixer, resulting in an aqueous emulsion (solid in liquid). About 10 parts by weight (14 weight percent) of non-thermoplastic flax fibers without (not containing any) flame retardants was placed into, and completely submerged within, the aqueous emulsion for 40 minutes at 70° C. Excess liquid was removed from the non-thermoplastic flax fibers and transferred to a reclaim beaker for reuse at a later time.

The mass of fibers was then compressed using a laboratory roll padder at 10 psi for 2 seconds to remove excess aqueous emulsion, and was then air dried for a period of about 24 minutes to a moisture content of about 10 weight percent. The excess aqueous emulsion was also transferred to the reclaim beaker.

The dried flame retarded non-thermoplastic fiber mass was then flame tested using the well-known National Fire Protection Association (NFPA) "Methods of Fire Tests for Flame-Resistant Textiles and Films" Document Number NFPA (Fire) 701 test method ("NFPA 701"). NFPA 701 established two test procedures to asses the propagation of flame beyond the area exposed to an ignition source for textiles and films. The tests are appropriate for testing materials that are used as draperies, curtains, other window treatments, awnings, tents, traps and plastic films used for decorative or other purposes. This test, and other fire evaluation tests, may be performed by one or more of the fire evaluation testing companies known by those of skill in the art, such as Underwriters Laboratories, Inc. (Northbrook, Ill.) or Commercial Testing Laboratories (Dalton, Ga.).

The char length of the dried flame retarded non-thermoplastic fiber mass was determined to be less than 3 inches and, thus, passed the NFPA 701 test, which requires that the char length be less than or equal to 4 inches for a passing result. Additionally, there was no afterflame, indicating that the substrate had good fire resistance, and that the induced flame was self extinguishing.

When a sample of the same non-thermoplastic flax fibers described above, but that had not been treated with the flame retardant composition was tested using the NFPA 701 test, the sample was completely consumed by burning.

EXAMPLE 2

Treatment of Non-Thermoplastic Flax Fabric

Example 1 was performed again, but was modified by using a woven flax fabric (made of 100% non-thermoplastic fiber) without (not containing any) flame retardants in place of the non-thermoplastic fiber. The dried flame retarded non-thermoplastic fabric was then flame tested using the NFPA 701 test method. The char length of the dried flame retarded non-thermoplastic fabric was determined to be less than 3 inches. Additionally, there was no afterflame, indicating that the substrate had good fire resistance, and that the induced flame was self extinguishing.

EXAMPLE 3

Treatment of Non-Thermoplastic Flax Fibrous Composition

Example 1 was performed again, but was modified by using a nonwoven carded web of flax fiber (a fibrous composition made of 100% non-thermoplastic fiber) without (not containing any) flame retardants in place of the non-thermoplastic flax fibers. The dried flame retarded non-thermoplastic fibrous composition was then flame tested using the NFPA 701 test method. The char length of the dried flame retarded non-thermoplastic flax fibrous composition was determined to be less than 3 inches. Additionally, there was no afterflame, indicating that the substrate had good fire resistance, and that the induced flame was self extinguishing.

EXAMPLE 4

Replacement of Ammonia with other Fire Retardant Substances

Example 1 was performed several times again, but was modified by using 30 parts by weight (38 weight percent) of another fire retardant substance (compound), or of a mixture of fire retardant substances, in place of ammonia. The other fire retardant substances employed (each individually) are listed below, and the weight percent of the resulting composition was adjusted to 100%:

(a) ammonium phosphate;
(b) ammonium borate;
(c) melamine;
(d) urea;
(e) guanidine;
(f) dicyandiamide;
(g) ethyl urea;
(h) ethylamine;
(i) thiourea;
(j) diethylenediamine;
(k) ethylenediamine;
(l) ammonium molybdate; and
(m) mixtures of the above.

EXAMPLE 5

Treatment of other Non-Thermoplastic Fibers, Fibrous Compositions or Fabrics

Example 1 is performed several times again, but is modified by using another non-thermoplastic fiber, fibrous composition or fabric in place of the flax fiber. The other non-thermoplastic fibers, fibrous compositions or fabrics employed (each individually) are listed below as substrates (a)–(r), and each of these substrates is treated separately in each of three different forms (as a fiber, as a fibrous composition or as a fabric):

(a) kenaf;
(b) ramie;
(c) caroa;
(d) bagasse;
(e) ficque;
(f) banana fiber;
(g) cotton;
(h) linen;
(i) jute;
(j) coconut fiber;
(k) rayon;
(l) hemp;
(m) wood pulp;
(n) straw;
(o) recycled paper;
(p) cellulose-base waste product;
(q) wool; and
(r) silk.

EXAMPLE 6

Replacement of Phosphoric Acid with other Fire Retardant Substances

Example 4 is performed several times again, but is modified by using 20 parts by weight (62 weight percent) of another fire retardant substance in place of phosphoric acid. The other fire retardant substances employed (each individually) are listed below, and the weight percent of the resulting composition is 100%:

(a) ammonium polyphosphate;
(b) urea phosphate;
(c) melamine pyrophosphate;
(d) melamine salt of boron-polyphosphate;
(e) ammonium salt of boron-polyphosphate;
(f) melamine orthophosphate;
(g) ammonium urea phosphate;
(h) ammonium melamine phosphate;
(i) urea salt of dimethyl methyl phosphonate;
(j) melamine salt of dimethyl methyl phosphonate;
(k) melamine salt of dimethyl hydrogen phosphite;
(l) brominated epoxy oligomer;
(m) polypentabromobenzyl acrylate;
(n) decabromodiphenyl oxide;
(o) pentabromodiphenyl oxide;
(p) 2,3-dibromopropanol;
(q) octabromodiphenyl oxide;
(r) tris(2-chloroethyl) phosphite;
(s) diethyl phosphite;
(t) tris(dichlorobropropyl) phosphite;
(u) dicyandiamide pyrophosphate;
(v) triphenyl phosphite;
(w) ammonium dimethyl phosphate; and
(x) fyroltex HP.

EXAMPLE 7

Addition of Powdered Metal Containing Fire Retardant Substances

Example 6 is performed several times again, but is modified by adding 10 parts by weight (15 weight percent) of a powdered metal containing compound (fire retardant substance) to the aqueous emulsion product. The aqueous emulsion product is mixed at ambient temperature for 15 minutes using a variable speed laboratory mixer. The powdered metal containing compounds employed (each individually) are listed below:

(a) magnesium oxide;
(b) magnesium chloride;
(c) talcum;
(d) alumina hydrate;
(e) zinc oxide;
(f) zinc borate;

(g) alumina trihydrate;
(h) alumina magnesium calcium silicate;
(i) sodium silicate;
(j) zeolite;
(k) magnesium hydroxide;
(l) sodium carbonate;
(m) calcium carbonate;
(n) ammonium molybdate;
(o) iron oxide;
(p) copper oxide;
(q) zinc phosphate;
(r) zinc chloride;
(s) clay;
(t) sodium dihydrogen phosphate;
(u) tin;
(v) molybdenum; and
(w) zinc.

EXAMPLE 8

Addition of Additional Adhesion Agents

Example 7 is performed several times again, but is modified by adding an adhesion agent in the amount of 20 parts by weight (10 weight percent) to the aqueous emulsion product. The aqueous emulsion product is mixed at ambient temperature for 15 minutes using a variable speed laboratory mixer. The adhesion agents added (each individually) are listed below:

(a) modified starch;
(b) urea-formaldehyde resin;
(c) phenol-formaldehyde resin;
(d) aqueous suspension of vinyl acetate;
(e) flexible polyepoxy resin;
(f) flexible polyepoxy resin;
(g) polyamide resin;
(h) aqueous polyurethane resin;
(i) polyvinyl alcohol;
(k) melamine-formaldehyde resin;
(l) resorcinol resin;
(m) sodium silicate;
(n) methyl cellulose;
(o) polyacrylate resin;
(p) casein;
(q) polysulfide resin; and
(r) polymethacrylate.

EXAMPLE 9

Addition of Powdered Fillers

Example 8 is performed several times again, but is modified by adding 5 parts by weight (20 weight percent) of a powdered filler to the aqueous emulsion product. The aqueous emulsion product is mixed at ambient temperature for 15 minutes using a variable speed laboratory mixer. The powdered fillers added (each individually) are listed below:

(a) wood powder;
(b) expandable graphite;
(c) phenol-formaldehyde resin;
(d) urea-formaldehyde resin;
(e) melamine;
(f) urea;
(g) dicyandiamide;
(h) carbohydrate;
(i) coke;
(j) melamine-formaldehyde resin;
(k) fuel ash;
(l) glass beads;
(m) silicate beads;
(n) ammonium borate;
(o) gypsum;
(p) mica;
(q) chalk;
(r) apatite;
(s) aluminum hydroxide;
(t) calcium borate;
(u) aluminum silicate hollow beads;
(v) boron oxide;
(w) magnesium phosphate; and
(x) alumina trihydrate.

EXAMPLE 10

Replacement of Water with Additional Flame Retardant Substances

Example 9 is performed several times again, but is modified by adding 5 parts by weight (10 weight percent) of an additional flame retardant substance to the aqueous emulsion product. The aqueous emulsion product is mixed at ambient temperature for 15 minutes using a variable speed laboratory mixer. The additional flame retardant substances employed (each individually) are listed below:

(a) ammonium polyphosphate;
(b) urea phosphate;
(c) melamine pyrophosphate;
(d) melamine salt of boron-polyphosphate;
(e) ammonium salt of boron-polyphosphate;
(f) melamine orthophosphate;
(g) ammonium urea phosphate;
(h) ammonium melamine phosphate;
(i) urea salt of dimethyl methyl phosphonate;
(j) melamine salt of dimethyl methyl phosphonate;
(k) melamine salt of dimethyl hydrogen phosphite;
(l) brominated epoxy oligomer;
(m) polypentabromobenzyl acrylate;
(n) decabromodiphenyl oxide;
(o) pentabromodiphenyl oxide;
(p) 2,3-dibromopropanol;
(q) octabromodiphenyl oxide;
(r) tris(2-chloroethyl) phosphite;
(s) diethyl phosphite;
(t) tris(dichlorobromopropyl) phosphite;
(u) dicyandiamide pyrophosphate;
(v) triphenyl phosphite; and
(w) ammonium dimethyl phosphate.

EXAMPLE 11

Replacement of Water with Additional Flame Retardant Substances

Example 10 is performed several times again, but is modified by adding 5 parts by weight (10 weight percent) of an additional flame retardant substance to the aqueous emulsion product. The aqueous emulsion product is mixed at ambient temperature for 15 minutes using a variable speed laboratory mixer. The additional flame retardant substances employed (each individually) are listed below:

(a) urea;
(b) melamine;
(c) cyanoquanidine;
(d) ethylenediamine salt of phosphonic acid;

(e) ethanolamine dimethyl phosphate;
(f) ammonium carbonate;
(g) diammonium phosphate;
(h) urea-formaldehyde resin;
(i) ammonium urea polyphosphate;
(j) boric acid;
(k) thiourea;
(l) diethylenediamine polyphosphate;
(m) dicyandiamide polyphosphate;
(n) ethyl urea;
(o) melamine formaldehyde resin;
(p) methylamine boron-phosphate;
(q) potassium ammonium phosphate;
(r) ammonium silicate;
(s) quaternary ammonium hydroxide;
(t) aniline phosphate;
(u) ammonium oxalate;
(v) ammonium borate; and
(w) cyanuramide phosphate.

EXAMPLE 12

Addition of Powdered Fillers

Example 11 is performed several times again, but is modified by adding 4 parts by weight (10 weight percent) of a powdered filler to the aqueous emulsion product. The aqueous emulsion product is mixed at ambient temperature for 15 minutes using a variable speed laboratory mixer. The additional powdered filler employed (each individually) are listed below:

(a) wood powder;
(b) expandable graphite;
(c) phenol-formaldehyde resin;
(d) urea-formaldehyde resin;
(e) melamine;
(f) urea;
(g) dicyandiamide;
(h) carbohydrate;
(i) coke;
(j) melamine-formaldehyde resin;
(k) fuel ash;
(l) glass beads;
(m) silicate beads;
(n) ammonium borate;
(o) gypsum;
(p) mica;
(q) chalk;
(r) apatite;
(s) aluminum hydroxide;
(t) calcium borate;
(u) aluminum silicate hollow beads;
(v) boron oxide; and
(w) magnesium phosphate.

EXAMPLE 13

Replacement of Water with Additional Flame Retardant Substances

Example 12 is performed several times again, but is modified by adding 5 parts by weight (15 weight percent) of an additional flame retardant substance to the aqueous emulsion product. The aqueous emulsion product is mixed at ambient temperature for 15 minutes using a variable speed laboratory mixer. The additional flame retardant substances employed (each individually) are listed below:

(a) ammonium polyphosphate;
(b) urea phosphate;
(c) melamine pyrophosphate;
(d) melamine salt of boron-polyphosphate;
(e) ammonium salt of boron-polyphosphate;
(f) melamine orthophosphate;
(g) ammonium urea phosphate;
(h) ammonium melamine phosphate;
(i) urea salt of dimethyl methyl phosphonate;
(j) melamine salt of dimethyl methyl phosphonate;
(k) melamine salt of dimethyl hydrogen phosphite;
(l) brominated epoxy oligomer;
(m) polypentabromobenzyl acrylate;
(n) decabromodiphenyl oxide;
(o) pentabromodiphenyl oxide;
(p) 2,3-dibromopropanol;
(q) octabromodiphenyl oxide;
(r) tris(2-chloroethyl) phosphite;
(s) diethyl phosphite;
(t) tris(dichlorobropropyl) phosphite;
(u) dicyandiamide pyrophosphate;
(v) triphenyl phosphite; and
(w) ammonium dimethyl phosphate.

EXAMPLE 14

Replacement of Water with Additional Flame Retardant Substances

Example 12 is performed several times again, but is modified by adding 5 parts by weight (20 weight percent) of an additional flame retardant substance to the aqueous emulsion product. The aqueous emulsion product is mixed at ambient temperature for 15 minutes using a variable speed laboratory mixer. The additional flame retardant substances employed (each individually) are listed below:

(a) urea-formaldehyde resin;
(b) ammonium urea polyphosphate;
(c) boric acid;
(d) thiourea;
(e) diethylenediamine polyphosphate;
(f) dicyandiamide polyphosphate;
(g) ethyl urea;
(h) melamine formaldehyde resin;
(i) methylamine boron-phosphate;
(j) potassium ammonium phosphate;
(k) ammonium silicate;
(l) quaternary ammonium hydroxide;
(m) aniline phosphate;
(n) ammonium oxalate;
(o) ammonium borate; and
(p) cyanuramide phosphate.

EXAMPLE 15

Treatment of Non-Thermoplastic Flax Fiber with Recycled Flame Retardant Composition About 10 parts by weight (14 weight percent) of non-thermoplastic flax fibers without (not containing any) flame retardants was placed into, and completely submerged within, the aqueous emulsion described in EXAMPLE 1 that had been transferred to a reclaim beaker for 40 minutes at 70° C. Excess liquid was then removed from the non-thermoplastic flax fibers and transferred to the reclaim beaker for reuse at a later time. The mass of fibers was then compressed using a laboratory roll padder at 10 psi for 2 seconds to remove excess aqueous emulsion, and was then air dried for a period of about 24 minutes to a moisture content of about 10 weight percent. The excess aqueous emulsion was also transferred to the reclaim beaker.

The dried flame retarded non-thermoplastic fiber mass was then flame tested using the NFPA 701 test. The char length of the dried flame retarded non-thermoplastic fiber mass was determined to be less than 3 inches. Thus, this treated substrate also passed the NFPA 701 test. Additionally, there was no afterflame, indicating that the substrate had good fire resistance, and that the induced flame was self extinguishing.

EXAMPLE 16

Treatment of Cellulosic Fiber (Rayon)

The experiment described in this example was performed in a manner similar to the experiment described in EXAMPLE 1. Unless otherwise indicated below, the same conditions and equipment were employed.

About 30 parts by weight (38 weight percent) of ammonia (fire retardant substance) was mixed with 50 parts by weight (62 weight percent) of phosphoric acid (fire retardant substance) in an open beaker, relying on self-generated heat, and agitated for 30 minutes using a lightning mixer. Then, about 65 parts by weight (65 weight percent) of this mixture were added to 80 parts by weight (25 weight percent) of water and 10 parts by weight 10 weight percent) of diethylene glycol (adhesion agent) in a second beaker, which was also agitated for 30 minutes using a lightning mixer resulting in an aqueous emulsion. Several grams of loose rayon fibers, which had not been previously treated with flame retardants, were completely submerged in the aqueous emulsion for at least 30 minutes at a temperature of about 130–180° F. After removal from the bath, the mass of fiber was centrifuged and then compressed to remove excess aqueous emulsion and allowed to air dry.

The dried, flame retardant treated sample was then flame tested according to the NFPA 701 test. The char length of the dried flame retarded rayon sample was determined to be less than 0.5 inches. Additionally, there was no after-flame, indicating that the substrate had good fire resistance, and that the induced flame was self extinguishing.

EXAMPLE 17

Treatment of a Polyester Staple Fiber Using Phosphoric Acid as the Flame Retardant Substance A flame retardant emulsion was prepared according to the procedure described for EXAMPLE 16. A several gram sample of a polyester staple fiber was immersed in the bath and held for 30 minutes at 268° F. After centrifuging and compressing to remove excess fluid, the fiber sample was prepared for testing according to NFPA 701. Due to a tendency for the thermoplastic fiber to shrink away from the flame, the measured char length for the sample was approximately 2 inches, versus a less than 4 inch standard.

While the present invention has been described herein with some specificity, and with reference to certain preferred embodiments thereof, those of ordinary skill in the art will recognize numerous variations, modifications and substitutions of that which has been shown which can be made, and which are within the scope and spirit of the invention, as by adding, combining or subdividing steps, or by substituting equivalents, while retaining significant advantages of the processes, systems, compositions and treated substrates of the invention, which are defined in the claims that follow. It is intended, therefore, that all of these modifications, variations and substitutions be within the scope and spirit of the present invention as described and claimed herein, and that the invention be limited only by the scope of the claims which follow, and that such claims be interpreted as broadly as possible.

Throughout this application, various books, journal articles, patents, other publications and Internet web cites have been cited. The entireties of the teachings of each of these books, journal articles, patents, other publications and information contained in the Internet web sites are hereby incorporated by reference herein without admission that such is prior art.

What is claimed is:

1. A process for applying a flame retardant composition to a first and second substrate each of which have at least a 5 weight percent of non-thermoplastic material, the process comprising:

treating the first substrate in a first treatment vessel with the flame retardant composition which is free of dye or other contaminating agents;

transferring a first remaining portion of the flame retardant composition from the first treatment vessel to a second treatment vessel;

removing a first excess portion of the flame retardant composition from the first substrate;

drying the first substrate to a first desired moisture content;

treating the second substrate in a second treatment vessel which is different from said first treatment vessel with a flame retardant composition which includes the first remaining portion of the flame retardant composition transferred in said transferring a first remaining portion step;

transferring a second remaining portion of the flame retardant composition from the second treatment vessel to the first treatment vessel;

removing a second excess portion of the flame retardant composition from the second substrate; and drying the second substrate to a second desired moisture content.

2. The process of claim 1, further comprising forming the flame retardant composition by mixing a plurality of substances in a collection tank before treating the first substrate with the flame retardant composition.

3. The process of claim 2 wherein mixing a plurality of substances includes:

mixing a flame retardant substance;

mixing a solvent compatible with the first and second substrates, the solvent having a quantity sufficient to mix the flame retardant substance; and mixing an adhesion agent having a quantity sufficient to adhere the flame retardant substance to the first and second substrates.

4. The process of claim 2, wherein mixing a plurality of substances further includes:

mixing at least one of a stability agent;

mixing a viscosity enhancing agent; and mixing a wetting agent.

5. The process of claim 2, further comprising transferring the first excess portion to the collection tank, after removing the first excess portion.

6. The process of claim 2, further comprising transferring the second excess portion to the collection tank, after removing the second excess portion.

7. The process of claim 1, further comprising:

rinsing the first substrate with a rinse liquid, after the step of removing the first excess portion of the flame retardant composition from the first substrate and before the step of treating the second substrate with the first remaining portion of the flame retardant composition; and removing an excess rinse liquid from the first substrate, after the step of rinsing the first substrate and before the step of treating the second substrate with the first remaining portion of the flame retardant composition.

8. The process of claim 7, wherein rinsing the first substrate includes spraying the rinse liquid onto the first substrate.

9. The process of claim 1, wherein removing the first excess portion of the flame retardant composition from the first substrate includes using a centrifugation technique.

10. The process of claim 1, wherein removing the first excess portion of the flame retardant composition from the first substrate includes squeezing the first substrate between two rollers.

11. The process of claim 1, wherein removing the second excess portion of the flame retardant composition from the second substrate includes using a centrifugation technique.

12. The process of claim 1, wherein removing the second excess portion of the flame retardant composition from the second substrate includes squeezing the second substrate between two rollers.

13. The process of claim 1 wherein the substrates are filaments, microfibers or fibers.

14. A process for rendering fibers flame retardant, comprising the steps of:

applying a flame retardant composition which is free of dye to a first plurality of fibers comprising at least 5 weight percent non-thermoplastic material in a first vessel;

recovering flame retardant composition which is not applied to said first plurality of fibers in said first vessel from said first vessel;

supplying said flame retardant composition which is recovered in said recovering step to a second vessel which contains a second plurality of fibers comprising at least 5 weight percent non-thermoplastic material for application to said second plurality of fibers;

removing said first plurality of fibers from said first vessel;

drying said first plurality of fibers; and recovering flame retardant composition which is not applied to said second plurality of fibers in said second vessel from said second vessel, and supplying recovered flame retardant composition to said first vessel after said removing step.

15. The process of claim 14 wherein said applying said flame retardant composition which is free of dye to said first plurality of fibers step is performed under conditions sufficient to cause penetration of said flame retardant composition through a cross-section of individual fibers in said first plurality of fibers.

16. The process of claim 14 further comprising the steps of:

removing said second plurality of fibers from said second vessel; and drying said second plurality of fibers.

17. The process of claim 16 further comprising the step of centrifuging said second plurality of fibers before said drying said second plurality of fibers step.

18. The process of claim 14 further comprising the step of centrifuging said first plurality of fibers before said drying said first plurality of fibers step.

19. The process of claim 14 wherein the flame retardant composition includes one or more flame retardant substances selected from the group consisting of phosphoric acid, halogen-free phosphoric acid derivatives, ammonium polyphosphate, ammonia, ammonium phosphate, ammonium molybdate, ammonium borate, organophosphorus chemicals, melamine chemicals, intumescent chemicals, alumina trihydrate, urea, guanidine, dicyandiamide, ethyl urea, ethylamine, thiourea, diethylenediamine, ethylenediamine, brominated aromatic organic compounds and brominated cycloaliphatic organic compounds.

* * * * *